United States Patent [19]

Tamada et al.

[11] Patent Number: 4,785,714

[45] Date of Patent: Nov. 22, 1988

[54] POSITIVE-DISPLACEMENT FLUID MOTOR HAVING SELF-STOPPING FUNCTION, AND METHOD AND CONTROL CIRCUIT FOR STOPPING THE MOTOR

[75] Inventors: Toshiro Tamada, Gifu; Kei Hattori, Tokoname, both of Japan

[73] Assignee: Technol Inc., Aichi, Japan

[21] Appl. No.: 77,860

[22] Filed: Jul. 27, 1987

[30] Foreign Application Priority Data

Nov. 29, 1986 [JP] Japan ..... 61-285291

[51] Int. Cl.[4] ..... F01B 1/06

[52] U.S. Cl. ..... 91/491; 91/499; 60/327

[58] Field of Search ..... 60/325, 327, 487, 489, 60/493; 91/41, 42, 43, 44, 491, 499, 7; 418/270

[56] References Cited

U.S. PATENT DOCUMENTS 4,631,010 12/1986 Petersen et al. ..... 418/61 B 4,704,946 11/1987 Okada ..... 91/7

*Primary Examiner*—Edward K. Look

*Attorney, Agent, or Firm*—Parkhurst, Oliff & Berridge

[57] ABSTRACT

A positive-displacement fluid motor wherein a rotating member rotated by pressurized fluid flows to and from fluid chambers can be stopped at a desired one of at least one predetermined angular position by a torque produced by the motor itself. The fluid is supplied into at least one advancing fluid chamber of the fluid chambers which acts to rotate the rotating member in an operating direction of the motor, while causing the fluid to be discharged from at least one reversing fluid chamber of the fluid chambers which acts to rotate the rotating member in a direction opposite to the operating direction, if a motor stop command is generated when the desired angular position is ahead of a current position of the rotating member in the operating direction of the motor. The fluid is supplied into the at least one reversing fluid chamber while causing the fluid to be discharged from the at least one advancing fluid chamber, if the motor stop command is generated when the current position of the rotating member is ahead of the desired angular position in the operating direction of the motor. The rotating member functions to control the fluid flows into and from the advancing and reversing fluid chambers, depending upon the current position of the rotating member relative to the desired angular position.

35 Claims, 33 Drawing Sheets

FIG. 9
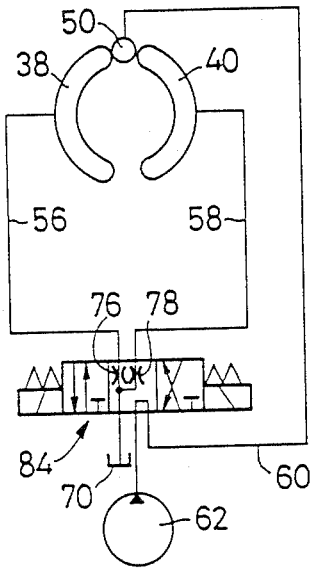
FIG. 10
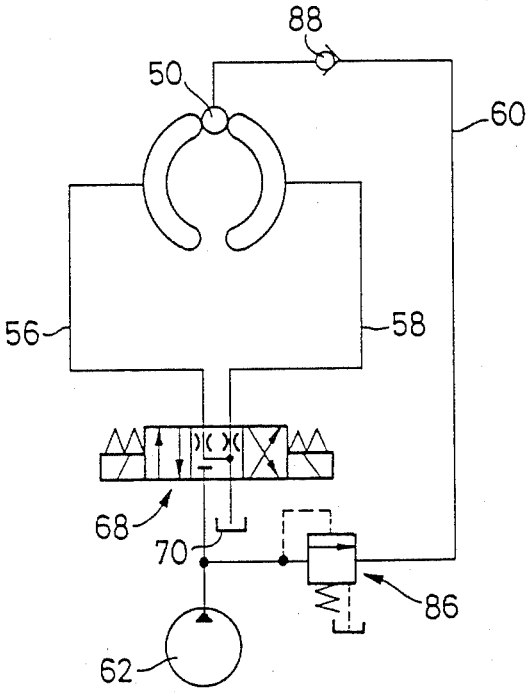
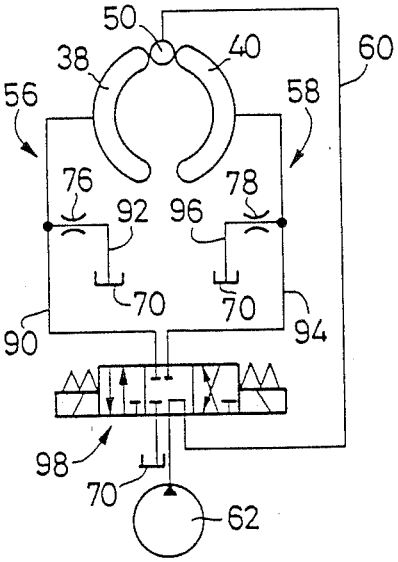
FIG. 11

FIG. 21
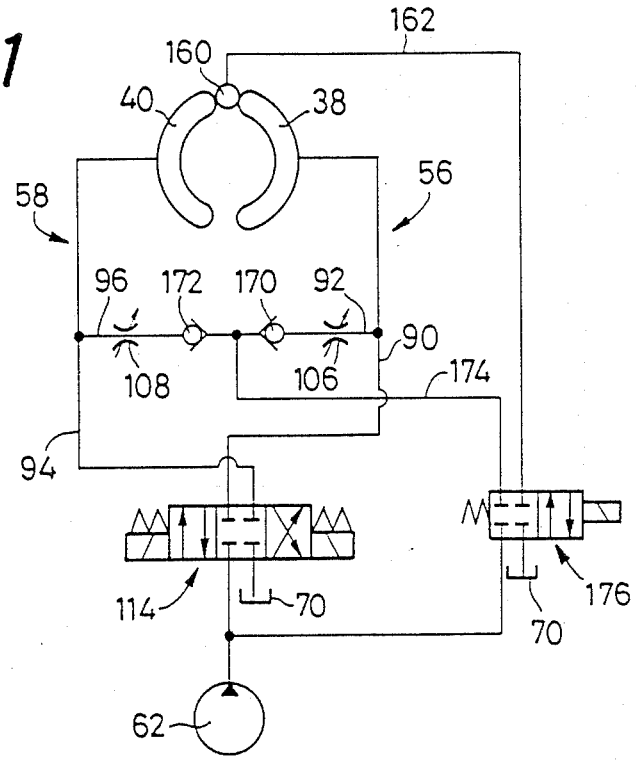
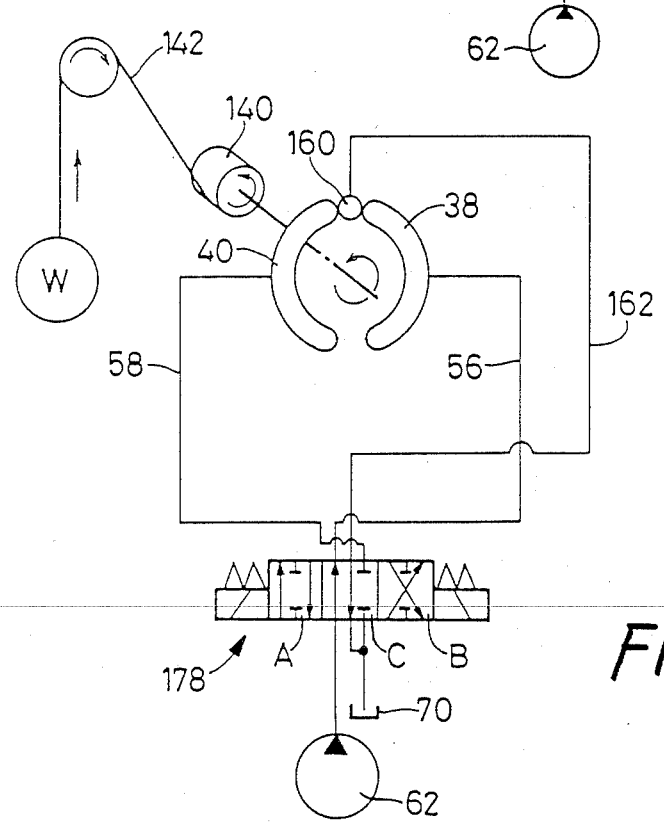
FIG. 22

FIG. 46
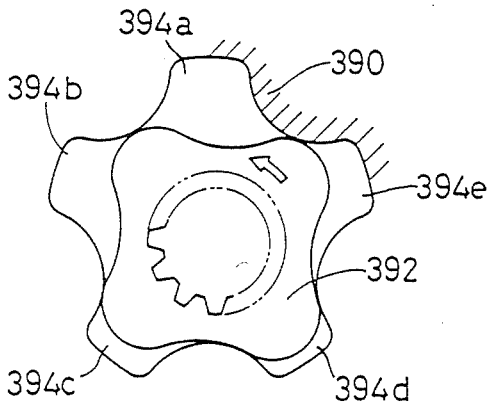
FIG. 47
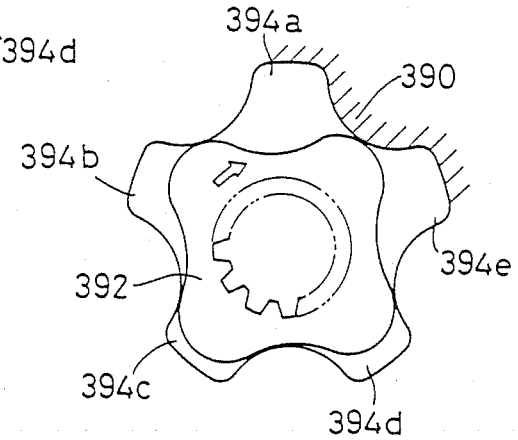
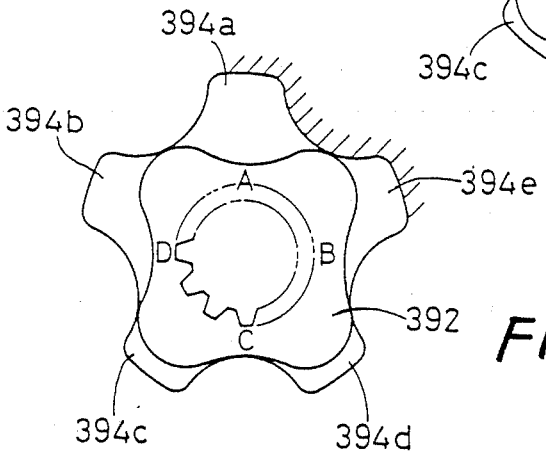
FIG. 48

POSITIVE-DISPLACEMENT FLUID MOTOR HAVING SELF-STOPPING FUNCTION, AND METHOD AND CONTROL CIRCUIT FOR STOPPING THE MOTOR

BACKGROUND OF THE INVENTION

1. Field of the Invention

The present invention as disclosed herein relates generally to a fluid motor operated by a pressurized fluid, such as a hydraulically or pneumatically operated motor, in particular, a positive-displacement fluid motor wherein a rotating member is rotated by means of flows of a pressurized fluid to and from a plurality of mutually independent fluid chambers. More particularly, the invention is concerned with a structure and a method of stopping such a positive-displacement fluid motor at a predetermined angular position, and a fluid control circuit for stopping the motor.

2. Discussion of the Prior Art

As a fluid motor, for example, a hydraulic motor, having a function of stopping at a predetermined operating position, there is known an indexing motor.

For stopping the indexing motor at a specific angular position, or positioning the motor, it is known to use a mechanism which is a combination of a mechanical valve, and a positioning cam with deceleration curves. In this mechanism, a lever is connected to the spool of the mechanical valve, so that the lever is pivoted about an axis as the spool is moved. The lever is provided at its one end with a roller pin. On the other hand, the positioning cam is attached to the shaft of the indexing motor, such that the roller pin on the lever engages a positioning groove formed in the circumferential surface of the positioning cam. The positioning cam is formed with the deceleration curves continuous with the leading and trailing ends of the positioning grooves. While the indexing motor is normally rotated, the mechanical valve holds the roller pin out of engagement with the positioning groove. When the motor is commanded to stop or to be indexed, the mechanical valve is activated, causing the lever to be pivoted in response to a movement of the spool, and thereby forcing the roller pin against the circumferential surface of the positioning cam, whereby the roller pin follows the deceleration curve at the leading end of the positioning groove. The resulting movement of the lever will enable the spool to restrict the flow of the fluid into the motor, thereby causing the motor to be slowed down. After the motor is slowed down following the deceleration curve, the roller pin comes into engagement with the positioning groove, whereby the motor shaft is mechanically stopped and positioned.

There is also known a brake motor which is similar to the indexing arrangement in that the motor is stopped, but uses a structurally different stopping arrangement. The conventional brake motor employs a mechanical braking mechanism, namely, utilizes friction to stop the rotation of the hydraulic motor. The mechanism includes a brake disc which is adapted to be forced against the rotating member of the motor. When the fluid supply and discharge flows to and from the motor are stopped, the brake disc is pushed onto the rotating member by a suitable push means such as a cylinder, which is actuated substantially in synchronization of a command to stop the fluid flows.

However, the conventional fluid motors have the following problems that must be solved. Referring first to the indexing motor, the need of the mechanical valve, lever, roller pin, positioning cam, etc. leads to complicating the construction. Further, the mechanism is disadvantageous in life expectancy and maintenance, since many portions of the mechanism are subject to friction. Moreover, the mechanical stopping of the motor with the roller pin engaging the positioning groove causes a comparatively large shock, and therefore a relatively long deceleration or slowdown period is necessary to mitigate the shock. Furthermore, if the motor overshoots the predetermined angular position, the motor phase cannot be returned back to that angular position, and the motor must be further rotated to be stopped during the next revolution, with another engaging action of the roller pin with the positioning groove.

The brake motor is also complicated due to the need of the brake disc and the push means for stopping the motor. The brake disc inevitably wears, and must be replaced by new one. This increases the frequency of maintenance services. Also, it is difficult to activate the braking mechanism at the moment when the flows of the fluid to and from the motor are stopped. Generally, the timing adjustment is such that the braking mechanism is activated a short time before the hydraulic flows are stopped. In this arrangement, the hydraulic motor continues to produce a torque even after the brake is applied, and the wear of the brake disc is aggravated.

SUMMARY OF THE INVENTION

The present invention was made to solve the problems indicated above, and the concept of the invention is applicable to both of the indexing and brake motors. It is therefore an object of the present invention to make it possible to stop a positive-displacement fluid motor at a sired one of at least one predetermined angular position, by a torque produced by the motor itself by utilizing a pressurized fluid, without using mechanical means such as cam, roller pin and brake disc.

According to one aspect of the invention, there is provided a method of stopping a positive-displacement fluid motor at a desired one of at least one predetermined angular position, the fluid motor having a rotating member which is rotated continuously by means of flows of a pressurized fluid to and from a plurality of fluid chambers, the method comprising: the step of supplying the pressurized fluid into at least one advancing fluid chamber of the plurality of fluid chambers which serves to rotate the rotating member in an operating direction of the motor, while causing the fluid to be discharged from at least one reversing fluid chamber of the plurality of fluid chambers which serves to rotate the rotating member in a direction opposite to the operating direction, if a motor stop command is generated when the desired angular position is ahead of a current position of the rotating member in the operating direction of the motor; and the step of supplying the pressurized fluid into the above-indicated at least one reversing fluid chamber while causing the fluid to be discharged from the above-indicated at least one advancing fluid chamber, if the motor stop command is generated when the current position of the rotating member is ahead of the desired angular position in the operating direction of the motor. The rotating member is used to control the fluid flows into and from the at least one advancing fluid chamber and the at least one reversing fluid chamber, depending upon the current position of the rotating member relative to the desired angular position.

The concept of the invention indicated above can embodied also as a method of controlling the motor. According to this concept, the method includes a step of continuously rotating the rotating member of the motor by effecting the fluid flows to and from the plurality of fluid chambers, and a step of stopping the motor while continuing the fluid supply to the motor, and causing the rotating member itself to switch the fluid flows into and from the motor, as described above.

To practice the method of the invention, a fluid motor constructed as described below may be suitably used. That is, according to another aspect of the invention, there is provided a positive-displacement fluid motor having a plurality of fluid chambers, and a rotating member which is rotated continuously by means of flows of a pressurized fluid to and from said fluid chambers, and which can be stopped at a desired one of at least one predetermined angular position, the fluid motor comprising: a motor-stop fluid passage selectively communicating with at least one advancing fluid chamber of the plurality of fluid chambers which serves to rotate the rotating member in an operating direction of the motor, or at least one reversing fluid chamber of the plurality of fluid chambers which serves to rotate the rotating member in a direction opposite to the operating direction; the rotating member being operable to select, by rotation thereof, the fluid communication of the motor-stop fluid passage with the above-indicated at least one advancing fluid chamber or the at least one reversing fluid chamber; and a motor-stop fluid control circuit connected to the motor-stop fluid passage, for permitting the fluid to flow therethrough for supplying and discharging the fluid to and from the above-indicated at least one advancing fluid chamber and the at least one reversing fluid chamber, so as to rotate the rotating member in a direction toward the desired angular position and thereby stop the rotating member at the desired angular position.

The fluid flows into and from the fluid chambers can be accomplished by providing either a motor-stop fluid supply passage through which the fluid is supplied to the at least one advancing fluid chamber which serves to rotate the rotating member in an advancing direction, i.e., in the selected operating direction of the motor, or a motor-stop fluid discharge passage through which the fluid is discharged from the at least one reversing fluid chamber which serves to rotate the rotating member in the reverse direction, i.e., in the direction opposite to the selected operating direction. Further, both the motor-stop fluid supply passage and the motor-stop fluid discharge passage may be provided. In any one of these three different forms, the fluid communication of the motor-stop fluid passage or passages with the fluid chambers is controlled by the rotating member.

The term "rotating member" used herein is not narrowly interpreted to mean a rotor, an output shaft and a rotary cylinder, but is interpreted to cover any members which are mechanically coupled to the rotor, etc. for rotation therewith. For example, the rotating member includes a rotary valve for controlling the fluid flows during normal operation of the motor.

While the motor described above is connected to the motor-stop fluid control circuit, the positive-displacement fluid motor itself according to a further aspect of the invention is constructed to include a plurality of fluid chambers, a rotating member which is rotated by means of flows of a pressurized fluid to and from the fluid chambers and can be stopped at a desired predetermined angular position, and at least one of a motor-stop fluid supply passage and a motor-stop fluid discharge passage.

The motor-stop fluid supply passage has a first end as a connection port for connection to a pressure source, and a second end which communicates with at least one advancing fluid chamber which serves to rotate the rotating member in an operating direction of the motor, when the desired angular position is ahead of a current position of the rotating member, and communicates with at least one reversing fluid chamber which serves to rotate the rotating member in a direction opposite to the operating direction of the motor, when the current position of the rotating member is ahead of the desired angular position. The fluid communications of the motor-stop fluid supply passage with the advancing or reversing fluid chamber or chambers is controlled by the rotating of the rotating member. The motor-stop fluid discharge passage has also a first end and a second end, but the first end serves as a connection port for connection to a reservoir. Contrary to the second end of the fluid supply passage, the second end of the fluid discharge passage communicates with the at least one reversing fluid chamber when the desired angular position is ahead of the current position of the rotating member, and communicates with the at least one adversing fluid chamber when the current position of the rotating member is ahead of the desired angular position. The fluid communication of the motor-stop fluid discharge passage is also controlled by the rotation of the rotating member. According to the instant embodiment, three different arrangements are available, namely, the arrangement having only the motor-stop fluid supply passage, the arrangement having only the motor-stop fluid discharge passage, and the arrangement having both of the fluid supply and discharge passages.

The principle of the instant invention may be practiced for any types of positive-displacement fluid motor, including a fixed-cylinder type piston motor, a rotary-cylinder type piston motor, an external-mesh or internal-mesh gear motor, a trochoid motor, and a vane motor. In any case, the manufacture of the motor is easier where the motor-stop fluid passage is formed in a fixed or non-rotating member, than in the rotating member. However, it is possible to form the motor-stop fluid passage in the rotating member (more generally, a moving element). In the case where the motor-stop fluid passage is open in a specific one of the plurality of fluid chambers (irrespective of whether these fluid chambers are formed in the fixed or rotating member), directly, or indirectly via another passage, there is only one stop position of the motor, which corresponds to that specific fluid chamber. If the motor-stop fluid passage is formed in the rotating member (e.g., rotary valve member) that rotates relative to the fixed fluid chambers, or if the fluid passage is formed in a fixed member (e.g., fixed valve member) that is stationary relative to the rotating fluid chambers, the position at which the motor is stopped is determined depending upon the time when the motor is commanded to stop.

According to a still further aspect of the invention, there is provided a fluid control circuit for controlling a positive-displacement fluid motor so as to stop the motor at a desired predetermined angular position.

More specifically, the fluid control circuit according to the invention is adapted to control a positive-displacement fluid motor which has (a) a rotating member, (b) a plurality of fluid chambers, (c) an entrance port and a discharge port, and (d) a motor-stop fluid supply passage which selectively communicates with at least one advancing fluid chamber of the plurality of fluid chambers which serves to rotate the rotating member in an operating direction of the motor, or at least one reversing fluid chamber of the plurality of fluid chambers which serves to rotate the rotating member in a direction opposite to the operating direction, the motor being normally operated with the rotating member rotated by means of flows of a fluid to and from the motor through the entrance and discharge ports, the rotating member being stopped at a desired predetermined angular position by means of a flow of the fluid into the motor through the motor-stop fluid supply passage. The fluid control circuit comprises: (1) a first fluid passage for connecting the entrance port and a pressure source for pressurizing the fluid; (2) a second fluid passage for connecting the discharge port and a reservoir; (3) a third fluid passage for connecting the motor-stop fluid supply passage and the pressure source; (4) shutoff means for closing the third fluid passage when the motor is normally operated, and opening the third fluid passage when the motor is commanded to stop; (5) restrictor means disposed in each of the first and second fluid passages; and (6) selector means for effecting fluid communication between the entrance port and the pressure source through the first fluid passage, and between the discharge port and the reservoir through the second fluid passage, without restricting the fluid flows through the first and second fluid passages by the restrictor means, while the motor is normally operated, the selector means being operable to effect restricted fluid communication of the first and second fluid psssages with the reservoir through the restrictor means, at least when the motor is stopped. This fluid control circuit is thus considered a "motor-stop fluid supply circuit" adapted to force the fluid into the motor through the motor-stop fluid supply passage for stopping the motor.

The connection of the discharge port to the reservoir may be accomplished directly by the second fluid passage only, or also through the discharge side of the circuit. Further, the term "reservoir" may be interpreted to generally mean a return or drain side of the circuit, other than a reservoir in the form of a tank in a substantive sense. The selector means may be adapted to permit the fluid to be discharged into the reservoir through the restrictor means, also while the motor is normally operating. In this sense, the expression "at least when the motor is stopped" is used above.

Regarding the restrictor means, it is desired that the cross sectional area of flow of the fluid through the first and second fluid passages is restricted to a value which is smaller than the maximum cross sectional area of communication between the motor-stop fluid supply passage and the entrance or discharge port when the motor is stopped. However, there is an exception in a special case. It can be said that the restrictor means functions to restrict the discharge flow of the fluid from the motor on the one hand, and also functions to permit the discharge flow on the other hand. (Thus, the restrictor means have dichotomous functions.) Since the restrictor means is provided in both of the first and second fluid passages, there can arise the fluid flows to and from the motor, necessary to rotate the rotating member toward the desired angular position, in either case where the motor is stopped in the advancing or reversing direction, with the motor-stop fluid supply passage communicating with the respective entrance or discharge port.

According to the invention, there is also provided a fluid control circuit ("motor-stop fluid discharge circuit") adapted to control the motor which has a motor-stop fluid discharge passage for discharging the fluid from the motor when the motor is stopped. This motor-stop fluid discharge circuit is different from the aforementioned motor-stop fluid supply passage, in the following points:

(1) The third fluid passage communicating with the motor-stop fluid discharge passage is connected to the reservoir. (2) The selector means effects restricted fluid communication between the first and second fluid passages, and the pressure source, through the restrictor means, at least when the motor is stopped. While there exist these differences arising from the difference in the direction of flows of the fluid through the motor-stop fluid supply and discharge passages, there is no difference in the significance of the restrictor means, between the motor-stop fluid supply circuit and the motor-stop fluid discharge circuit.

In a fluid control circuit for a motor which has the motor-stop fluid supply passage and the motor-stop fluid discharge passage, no restrictor means is necessary since these two exclusive supply and discharge passages permit the fluid supply and discharge flows for stopping the motor.

The restrictor means may be eliminated also in a fluid control circuit for an ordinary winch motor, or other motors which are subject to a load torque acting in one operating direction, and wherein the rotating member is rotated against the load torque, due to the fluid flows to and from the motor through the entrance and discharge ports. In this case, the elimination of the restrictor means is based on a fact that there exists a leak flow of the fluid from the motor or control circuit.

For example, a motor-stop fluid supply circuit for such motors includes the same first, second and third fluid passages, and the same shutoff means, as described above. Namely, the circuit includes the first fluid passage connected to the entrance port, the second fluid passage connected to the discharge port, the third fluid passage connected to the motor-stop fluid supply passage, and the shutoff means for opening and closing the third fluid passage. In addition, the circuit includes selector means arranged as follows. When the motor is normally operated, the selector means effects fluid communication between the entrance port and the pressure source through the first fluid passage, and fluid communication between the discharge port and the reservoir through the second fluid passage. When the motor is commanded to stop, the selector means is activated to close the first fluid passage, and maintain the fluid communication between the second fluid passage and the reservoir. In the case of a motor-stop fluid discharge circuit, the selector means is modified so as to maintain the fluid communication between the first fluid passage and the pressure source, and close the second fluid passage, when the motor is commanded to stop. In either case, the rotating member which has passed the desired stop position is returned to that stop position by the load torque acting on the motor, as the fluid leaks from the motor or circuit.

While the motor-stop fluid supply or discharge passage formed in the motor controlled by the fluid control circuit described above is used to supply or discharge the fluid to and from the motor for stopping the motor at a desired one of at least one angular position, the motor may be stopped by using the motor-stop fluid passage as a source of a pilot pressure to be applied to switching means for controlling fluid communication of the first and second fluid passages with respect to the pressure source and reservoir, where the motor is operated against a load torque. In this case, the motor is controlled by a fluid control circuit also constructed according to the present invention, which comprises: (a) a first fluid passage whose one end is adapted to be connected to said entrance port; (b) a second fluid passage whose one end is adapted to be connected to the discharge port; (b) a third fluid passage whose one end is adapted to be connected to the motor-stop fluid passage; (c) first switching means connected to the other ends of the first and second fluid passages, the first switching means being operable between a first position in which the first fluid passage communicates with a pressure source while the second fluid passage communicates with a reservoir, and a second position in which the first fluid passage is closed while the second fluid passage is held in communication with the reservoir; and (d) second switching means connected to the first fluid passage, and receiving a pressure in the third fluid passage as a pilot pressure, the second switching means being normally closed, and being opended when the pilot pressure exceeds a predetermined limit and thereby connecting the first fluid passage which has been disconnected from the pressure source by the first switching means, to the pressure source. The rotating member is rotated in the operating direction against the load torque while the first switching means is placed in the first position, and is stopped at a desired predetermined angular position when the first switching means is operated to the second position.

While the fluid control circuits have been mentioned, the description goes back to the motor arrangements according to the invention. Normally, there is provided only one stop or indexing position, where the motor-stop fluid supply or discharge passage, i.e., the motor-stop fluid passage is formed for a predetermined one of the fluid chambers of the motor. However, the motor-stop fluid passage may be provided for each of all the fluid chambers. That is, a plurality of motor-stop fluid passages may be provided for all of the fluid chambers, respectively. If these motor-stop fluid passages are fluid supply passages, they are adapted to selectively communicate with the pressure source. If a plurality of motor-stop fluid discharge passages are provided, they are adapted to selectively communicate with the reservoir. Thus, the motor can be stopped at one of a plurality of angular stop or indexing positions.

It is also possible that the motor-stop fluid supply passage and the motor-stop fluid discharge passage are both provided in the functional sense, and one of these two passages is selectively used. Since the angular stop positions obtained when the motor-stop fluid supply and discharge passages are usually offset or displaced from each other, the number of stop positions may be doubled, as compared with the number of stop positions when only one of these two passages is provided. The instant arrangement will be described in greater detail.

According to this aspect of the invention, there is provided a positive-displacement fluid motor having a plurality of fluid chambers, and a rotating member which is rotated by means of flows of a pressurized fluid to and from the fluid chambers, and which can be stopped at one of a first and a second predetermined angular position, comprising: (a) a motor-stop fluid supply passage and a motor-stop fluid discharge passage selectively communicating with at least one advancing fluid chamber of the plurality of fluid chambers which serves to rotate the rotating member in an operating direction of the motor, or at least one reversing fluid chamber of the plurality of fluid chambers which serves to rotate the rotating member in a direction opposite to the operating direction, the rotating member being operable to select, by rotation thereof, the fluid communication of the motor-stop fluid supply and discharge passages with the at least one advancing fluid chamber and the at least one reversing fluid chamber; (b) switching means operable between a first position in which the motor-stop fluid supply passage communicates with a pressure source for pressurizing the fluid, and a second position in which the motor-stop fluid discharge passage communicates with a reservoir; (c) first fluid supply/discharge means, operable when the switching means is placed in the first position, for supplying the fluid from the pressure source to at least one approaching fluid chamber of the plurality of fluid chambers through the motor-stop fluid supply passage to rotate the rotating member toward the first predetermined position, while permitting the fluid to be discharged from at least one departing fluid chamber of the plurality of fluid chambers, the above-indicated at least one approaching fluid chamber serving to rotate the rotating member in a direction toward the one of the first and second predetermined angular positions, while the above-indicated at least one departing fluid chamber serving to rotate the rotating member in a direction away from the one predetermined angular position; and (d) second fluid supply/discharge means, operable when the switching means is placed in the second position, for discharging the fluid from the at least one departing fluid chamber to the reservoir through the motor-stop fluid discharge passage while supplying the fluid from the pressure source to the at least one approaching fluid chamber to rotate the rotating member toward the second predetermined position.

The above arrangement of the fluid motor may be provided in two different forms. That is, where the motor-stop fluid passage means is provided for a specific fluid chamber (where there is only one angular stop position), a single common passage may be selectively used as the motor-stop fluid supply and discharge passages. On the other hand, if the motor-stop fluid passage means is formed in a member of the motor which is rotated relative to the fluid chambers (if two or more stop positions are provided), the motor-stop fluid supply and discharge passages are provided by separate exclusive passages.

The present invention may also be embodied as a composite motor arrangement. In this arrangement, a first motor portion and a second motor portion are mechanically coupled to each other, and their corresponding fluid chambers communicate with each other. Only the first motor portion is provided with a motor-stop fluid passage as described so far. Consequently, the second motor portion can be stopped at a position determined by the first motor portion, by a torque produced by the second motor itself. The second motor portion may be replaced by a cylinder portion. This modified form of the composite motor arrangement can be regarded as an application or utility of the motor of the invention, or a method of using the motor according to the invention.

Although the present invention which has been described is normally applied in connection with hydraulically operated motors, the invention is equally applicable to other types of fluid motors such as pneumatically operated motors.

According to the invention which has been described, the motor can be stopped and positioned by the fluid flows, that is, by utilizing the function inerent in a fluid motor. The rotating member can be positioned to the desired predetermined angular position, and maintained in this position, by a torque substantially equal to a torque produced during a normal running of the motor. The motor provided with this stopping function may be used either as an indexing motor or as a brake motor. Accordingly, the motor according to the invention does not require a complicated mechanism as used in a conventional indexing or brake motor. In other words, the instant motor may be provided with a stopping capability, by making a minor modification of a basic arrangement of a fluid motor. Further, the motor has increased durability, because of the stopping principle that requires no parts that are subject to friction. In addition, the instant arrangement provides a high shock damping or absorbing ability, due to the stopping action by means of a fluid pressure.

If the present motor is viewed as an indexing motor, this means a fast positioning of the motor with a reduced shock, without exclusive slowdown means. Furthermore, even if the motor is commanded to stop when it has passed the desired angular stop position, a fluid brake is applied to the rotating member and the motor is returned to the stop position, provided the motor position upon generation of the stop command falls within a certain angular range away from the stop position in the operating direction of the motor. Namely, the rotating member is returned to the stop position by a fluid pressure.

If the motor is used as a brake motor, the motor suffers from reduced shock and slip, and does not require an intricate control of the timing to stop. More specifically, the conventional brake motor requires synchronization between stopping of the fluid supply and discharge flows, and activation of the mechanical brake, as previously discussed. The motor of the invention does not require such synchronization, and is easier to control.

For a motor which is not subject to an external force upon stopping (for example, a motor for an index table), a fluid control circuit according to the invention is given an expected pressure relation and is capable of producing a pressure difference necessary to stop the motor, by employing a combination of suitable valves, as described in greater detail in connection with the preferred embodiments. However, where the motor is subject to an external force, such an expected pressure relation is disturbed or difficult to rely upon. That is, it is impossible to exactly estimate the pressure, flow rate and flow direction of the fluid in the circuit. According to the invention, however, the previously indicated dichotomous function of the resistor means assures necessary fluid flows for stopping the motor, regardless of whether an external force acts on the motor or not, or irrespective of the direction of the external force. Thus, the utility of the motor is considerably expanded.

In the case where a load torque or external force acts in the same operating direction of the motor, the restrictor means may be replaced by a leak flow of the fluid from the motor or fluid control circuit itself. Conventionally, such a leak flow necessitates the use of a mechanical brake or other means for holding the motor at the stop position. To the contrary, the present form of the invention positively utilizes the leak of the fluid from the motor or circuit, for the purpose of stopping and positioning the motor.

BRIEF DESCRIPTION OF THE DRAWINGS

The above and other objects, features and advantages of the present invention will be better understood by reading the following detailed description of a variety of preferred embodiments of the invention, when considered in connection with the accompanying drawings, in which:

FIG. 9 through FIG. 15 are diagrammatic views showing different modified forms of the hydraulic circuit for the radial piston motor;

FIG. 21 is a diagrammatic view of one modification of a hydraulic circuit for the motor of FIG. 18;

FIG. 22 is a diagrammatic view of one modification of a hydraulic circuit for the winch motor of FIG. 16;

FIGS. 46, 47 and 48 are views illustrating the operation of the trochoid motor of FIG. 45;

DETAILED DESCRIPTION OF THE PREFERRED EMBODIMENTS

Figure 1:
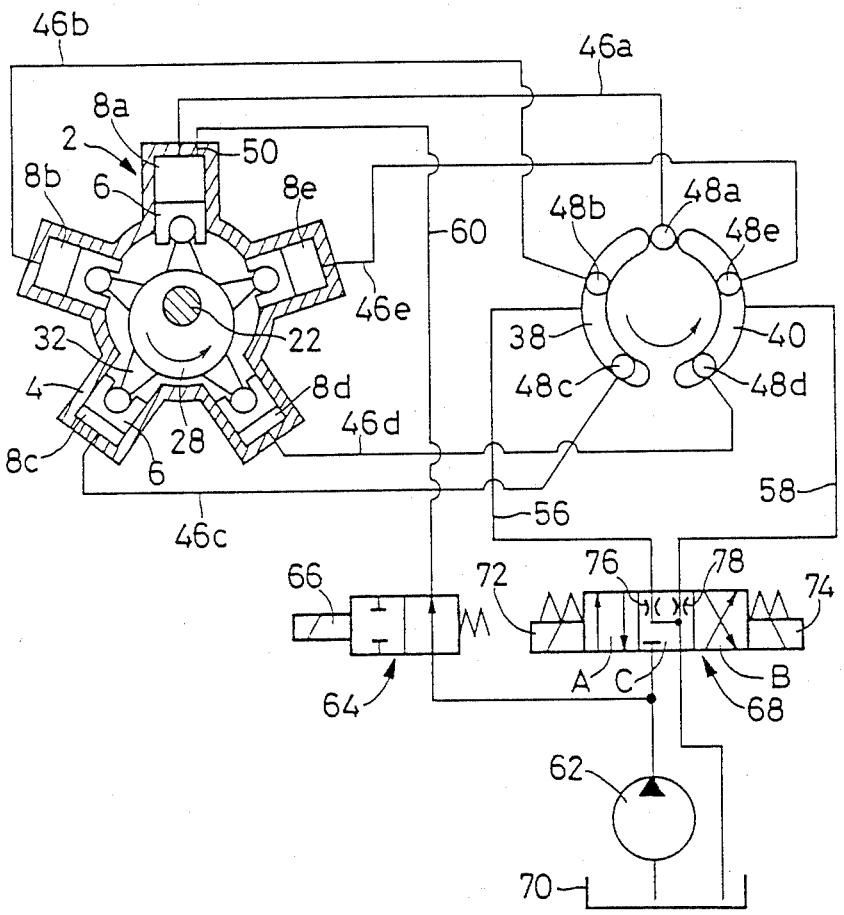
FIG. 1 is a schematic view showing one embodiment of a star-shaped, radial piston motor of a fixed-cylinder type of the present invention, together with a circuit for the motor.

Referring first to FIG. 1, there is schematically shown a radial piston motor of a fixed-cylinder type, which is one type of positive-displacement motors. Also shown in the figure is a hydraulic circuit connected to the motor. The term "motor" used herein may be interpreted to mean either an arrangement including a motor and a hydraulic circuit connected thereto, or alternatively in a narrow sense, a motor without a hydraulic circuit. For the sake of easy explanation and understanding, the following description refers to the terms "motor" and "hydraulic circuit" separately, as distinguished from each other.

The radial piston pump has a fixed casing 2. The casing 2 has five cylinders 4 which are formed in the radial direction of the motor such that the five cylinders 4 are evenly spaced from each other in the circumferential direction. In these cylinders 4, there are slidably received respective pistons 6, so as to define corresponding five variable-volume fluid chambers 8*a*, 8*b*, 8*c*, 8*d* and 8*e* (hereinafter collectively designated as "8*a*–8*e*", where appropriate: Other reference numerals other than 8 may follow this collective designation where appropriate).

Figure 2:
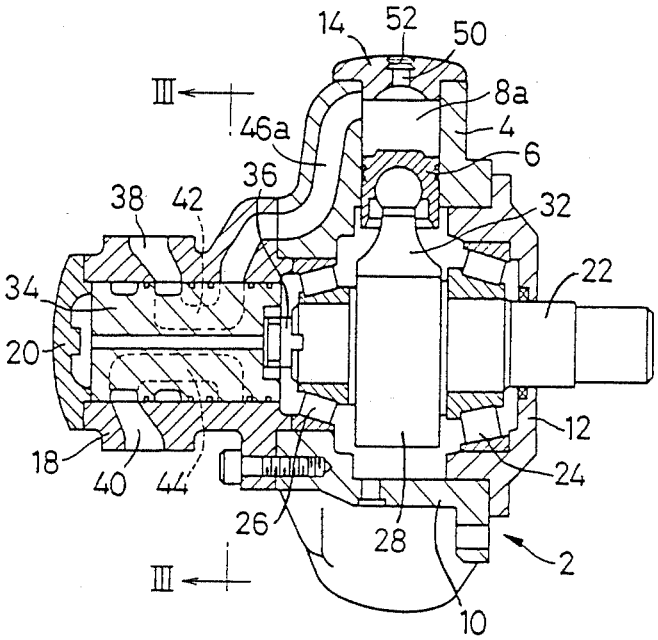
FIG. 2 is an elevational view in cross section of the radial piston motor.

As clearly seen in FIG. 2, the casing 2 consists of a fluid-tight assembly of a main body 10, a front covering 12, a cylinder covering 14, valve casing 18 and a rear covering 20. In this casing 2, a crankshaft 22 is rotatably supported by bearings 24, 26, in coaxial relation with the centerline of the casing 2. The crankshaft 22 has an eccentric cam 28 formed integrally therewith. The cam 28 has a circular cross section and is disposed in eccentric relation with the axis of rotation of the crankshaft 22. Connecting rods 32 are coupled at their one end to the respective pistons 6. The other ends of these rods 32 are held in sliding contact with the outer circumferential surface of the eccentric cam 28. As will be apparent from the following description, the cam 28 and the rods 32 function as converting means for converting linear movements of the pistons 6 to a rotating movement of the crankshaft 22.

Figure 3:
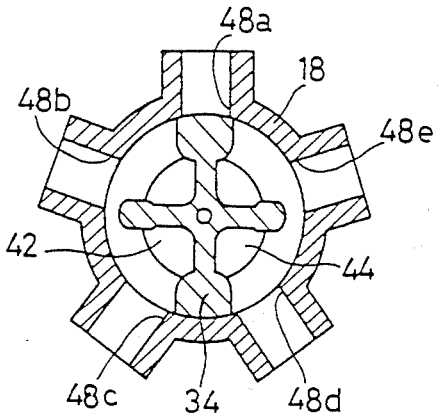
FIG. 3 is a cross sectional view taken along line III—III of FIG. 2.

Within the valve casing 18, there is rotatably received a rotary valve 34 coaxially with the crankshaft 22. The rotary valve 34 is connected by a cross coupling 36 to the inner end of the crankshaft 22, so that the rotary valve 34 is rotated synchronously with the crankshaft 22. This rotary valve 34 cooperates with the crankshaft 22 to constitute a rotating member. The valve casing 18 has an A-port 38 and a B-port 40 formed therein. One of these two ports 38, 40 which is connected to a pump (which will be described) is referred to as "entrance port", while the other port connected to a reservoir (which will be described) is referred to as "discharged port". The rotary valve 34 has a fluid passage 42, and another fluid passage 44 independent of the fluid passage 42. Irrespective of a rotating motion of the rotary valve 34, the fluid passage 42 is held in communication with the A-port 38, while the fluid passage 44 is held in communication with the B-port 40. The main body 10 and the valve casing 18 have connecting passages 46*a*, 46*b*, 46*c*, 46*d* and 46*e* (see FIG. 1) formed therethrough for conducting the fluid to and from the fluid chambers 8*a*–8*e*. These connecting passages open at their one end in the corresponding fluid chambers 8*a*–8*e*, and at their other end in the inner surface of the valve casing 18. These other ends of the connecting passages 46*a*–46*e* are indicated at 48*a*, 48*b*, 48*c*, 48*d* and 48*e* in FIG. 3, and are referred to as "fluid-chamber ports". In this arrangement, the A-port 38 and the B-port 40 are connected via the fluid passages 42, 44 to the different fluid-chamber ports 48*a*–48*e* one after another, as the rotary valve 34 is rotated, whereby the fluid is supplied to and discharged from the fluid chambers 8*a*–8*e* through the connecting passages 46*a*–46*e*. The fluid-chamber ports 48*a*–48*e* are temporarily closed by the rotary valve 34 when the selective connections of the ports 48*a*–48*e* to the A-port and B-port 38, 40 are changed. When the fluid-chamber ports 48*a*–48*e* are closed, the corresponding fluid chambers 8*a*–8*e* are placed in their phase in which their volume is maximum.

The crankshaft 22 has an outer end portion which projects out of the casing 2, as an output shaft (motor shaft) which is connected directly to a driven member, or alternatively provided with a gear or a sprocket for engagement with another gear or a chain for exerting a torque to the driven member.

In FIG. 1 schematically illustrating the general arrangement of the motor, the A-port 38 and fluid passage 42, and the B-port 40 and fluid passage 44, which are shown in FIG. 2, are indicated at 38, 40 simply as arcuate shapes. In operation, these arcuate A-port 38 and B-port 40 connected to the fluid passages 42, 44 may be considered to rotate in synchronized relation with the crankshaft 22, since the rotary valve 34 having the passages 42, 44 are rotated with the crankshaft 22.

A motor-stop inlet port 50 (referred to as "motor-stop port" where appropriate) is formed in desired one of the cylinders 4 corresponding to the five fluid chambers 8*a*–8*e*. In this specific example, the motor-stop inlet port 50 is formed in the cylinder 4 which has the fluid chamber 8*a*. As indicated in FIG. 2, this motor-stop inlet port 50 is formed through the cylinder covering 14 which defines the outer end of the cylinder 4. The outer or first open end of the inlet port 50 serves as a connection port 52 which is connected to the previously indicated pump 62, when needed. While the inlet port 50 directly opens in the fluid chamber 8*a*, the inlet port 50 communicates with the fluid-chamber port 48*a* through the fluid chamber 8*a* and the connecting passage 46*a*. In the present example, the fluid passage from the connection port 52 to the fluid-chamber port 48*a* functions as a motor-stop fluid supply passage, which has the connection port 52 as the first open end, and the fluid-chamber port 48*a* as the second open end. This motor-stop fluid supply passage selectively communicates, at the fluid-chamber port 48*a*, with the other fluid chambers 8*b*–8*e* through the A-port 38 or B-port 40, and the respective connecting passages 46*b*, 46*c*, 46*d* and 46*e*. The selective communication of the motor-stop fluid supply passage with the fluid chambers 8*b*–8*e* is effected through rotation of the rotary valve 34. When the volume of the fluid chamber 8*a* is maximum, that is, when the piston 6 in the fluid chamber 8*a* is placed in its bottom dead point, the fluid-chamber port 8*a* is located at a neutral position intermediate between the A-port 38 and the B-port 40, as shown in FIG. 1. In this position, the motor-stop inlet port 50 exclusively communicates with the fluid chamber 8*a*.

The radial piston motor constructed as described above is connected to, and used in combination with, a hydraulic circuit as indicated in FIG. 1. The hydraulic circuit will be described.

The A-port 38 is connected to a fluid passage 56, while the B-port 40 is connected to a fluid passage 58. The connection port 52 of the motor-stop inlet port 50 is connected to a fluid passage 60. The fluid passage 60 is connected to a hydraulic pressure source in the form of the previously indicated pump 62. In the fluid passage 60, there is provided a solenoid-operated shutoff valve 64 which functions as shutoff means. The shutoff valve 64 is adapted to open and close upon deenergization and energization of a solenoid 66.

On the other hand, a solenoid-operated directional control valve 68 functioning as directional control means or selector means is provided in the fluid passages 56 and 58, such that the fluid passages 56, 58 are connectable to the pump 62 and the previously indicated reservoir 70 via the valve 68. In a position A (FIG. 1) of the directional control valve 68 established by energization of a solenoid 72, the fluid passage 56 is connected to the pump 62, while the fluid passage 58 is connected to the reservoir 70. In a position B (FIG. 1) established by a solenoid 74, the connections of the passages 56, 58 to the pump 62 and the reservoir 70 are reversed with respect to those in the position A. With the valve 68 placed in its neutral position C, the fluid passages 56, 58 are both connected to the reservoir 70. In a part of the directional control valve 68, there are provided two mutually independent passage portions connected to the respective fluid passages 56, 58, and a common passage portion which connects the two independent passage portions to the reservoir 70. The independent passage portion connected to the fluid passage 56 is provided with a restrictor 76, while the other independent passage portion connected to the fluid passage 58 is provided with a restrictor 78 similar to the restrictor 76. Thus, the directional control valve 68, when placed in its neutral position C, operates to effect fluid communication between the fluid passages 56, 58 and the reservoir 70, through the respective restrictors 76, 78.

The restrictors 76, 78 are adjusted to provide restrictions of fluid flows therethrough, such that the cross sectional area of the fluid flows through the fluid passages 56, 58 is smaller than the maximum area of fluid communication of the fluid-chamber port 48*a* with the A-port 38 or B-port 40.

An operation of the radial piston motor connected to the thus arranged hydraulic circuit (i.e., motor-circuit arrangement) will be described. The description also explains one embodiment of a method of stopping the radial piston motor according to the present invention.

In a normal operation of the motor, the solenoid-operated shutoff valve 64 is held in its closed position, in which the fluid passage 60 is disconnected from the motor-stop inlet port 50. In other words, the motor is operated as if the inlet port 50 was not provided. In the meantime, the directional control valve 68 is placed in its operating position A or B. With the valve 68 placed in its position A, for example, the fluid passages 56, 58 communicate with the pump 62 and the reservoir 70, respectively. As a result, the fluid is delivered from the pump 62 to the A-port 38, while the fluid is discharged from the B-port 40 to the reservoir 70. In this case, the A-port 38 serves as an inlet port while the B-port 40 serves as an outlet port. Further, the fluid passages 56, 58 serve as first and second fluid passages, respectively. However, the fluid passage 60 always serves as a third fluid passage. In the position of the motor shown in FIG. 1, the A-port 38 communicates with the fluid-chamber ports 48*b* and 48*c*, while the B-port 40 communicates with the fluid-chamber ports 48*d* and 48*e*. Accordingly, the fluid is supplied to the fluid chambers 8*b* and 8*c* while the fluid is discharged from the fluid chambers 8*d* and 8*e*, whereby a torque is generated so as to rotate the crankshaft 22 as the output shaft in the counterclockwise direction as viewed in the Figure. The crankshaft 22 is continuously rotated, with the rotation of the rotary valve 34 with the crankshaft 22, which causes a continuous change in the fluid communication between the A-port and B-port 38, 40 and the fluid-chamber ports 48*a*–48*e*. If the directional control valve 68 is switched to its operating position B, the direction of rotation of the crankshaft 22 is reversed.

When the motor is stopped, the shutoff valve 64 is operated to its open position to open the fluid passage 60, as indicateed in FIG. 1, thereby permitting the motor-stop inlet port 50 to communicate with the pump 62 through the fluid passage 60. At the same time, the directional control valve 68 is operated to its neutral position C as indicated in FIG. 1, causing the fluid passages 56, 58 (and therefore the A-port and B-port 38, 40)

to communicate with the reservoir 70 through the respective restrictors 76, 78.

Figure 4:
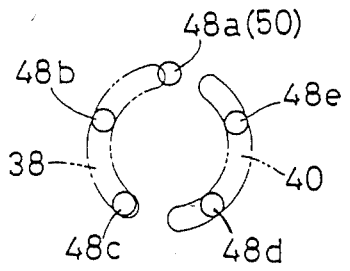
FIGS. 4 and 5 are views illustrating the operation of the arrangement of FIG. 1.

As a result of the fluid passage 60 being open, the fluid entering the motor-stop inlet port 50 is supplied into the fluid chamber 8*a*, fed through the connecting passage 46*a*, and is eventually discharged from the fluid-chamber port 48*a*. The angular position of the motor at which the motor 1 is stopped and positioned (hereinafter referred to as "stop position" of the motor, when appropriate), corresponds to a neutral position at which the fluid-chamber port 48*a* is located between the A-port 38 and the B-port 40. For instance, if the motor is rotated in the counteerclockwise direction (in FIG. 1) and a motor stop command is generated before the stop position has been reached (or when the stop position is ahead of the current motor position in the rotating direction), the fluid-chamber port 48*a* communicates with the A-port 38 as shown in FIG. 4, and further with the fluid chambers 8*b* and 8*c* through the A-port 38 and the connecting passages 46*b*, 46*c*. These fluid chambers 8*b*, 8*c* serve to further rotate the crankshaft 22 in the counterclockwise direction, when they are supplied with the pressurized fluid. The chambers 8*b*, 8*c* are therefore referred to as "advancing chambers". In this case, the fluid flows from the fluid-chamber port 48*a* to the A-port 38, contrary to a fluid flow from the A-port 38 to the port 48*a* during the normal counterclockwise rotation of the crankshaft 22. For simplification, the following description is given on the assumption that the motor stopped at the stop position is not subject to an external force, like a motor for an indexing table. Although the fluid is discharged from the A-port 38 to the reservoir 70 through the fluid passage 56, the pressure in the A-port 38 is increased because of the restrictor 76 provided in the fluid passage 56 connected to the A-port 38. Consequently, the pressurized fluid is fed to the fluid chambers 8*b*, 8*c* through the connecting passages 46*b*, 46*c*.

On the other hand, the fluid chambers 8*d*, 8*e* communicate with the B-port 40 through the connecting passages 46*d*, 46*e* and the fluid-chamber ports 48*d*, 48*e*. These chambers 8*d*, 8*e* serve to rotate the crankshaft 22 in the clockwise direction when they are supplied with the pressurized pressure. Thus, the chambers 8*d*, 8*e* are referred to as "reversing chambers". Since the B-port 40 communicates with the reservoir 70 through the fluid passage 58 and the restrictor 78, the fluid is discharged from the reversing chambers 8*d*, 8*e* to the reservoir 70. Consequently, a pressure difference is created between the A-port 38 and the B-port 40, namely, a comparatively high pressure is present in the A-port 38 while a comparatively low pressure is present in the B-port 40. Accordingly, the advancing chambers 8*b*, 8*c* are subject to the high pressure while the reversing chambers 8*d*, 8*e* are subject to the low pressure. This pressure difference produces a torque to rotate the crankshaft 22 further toward the stop position. The amount of this torque falls within a range of variation of the normal operating torque of the motor, and is considered substantially equal to the normal operating torque.

As described above, the current motor position is advanced to the stop position in which the fluid-chamber port 48*a* is located at the neutral position between the A-port and B-port 38, 40, as indicated in FIG. 1. As a result, the above-indicated pressure difference is removed, and the advancing torque (counterclockwise torque) produced by the two pistons 6 in the fluid chambers 8*b*, 8*c* counterbalances the reversing torque produced by the two pistons 6 in the fluid chambers 8*d*, 8*e*. Thus, the crankshaft 22 is stopped at the stop position wherein the volume of the fluid chamber 8*a* is maximum, or the corresponding piston 6 is positioned at its bottom dead point.

Figure 5:
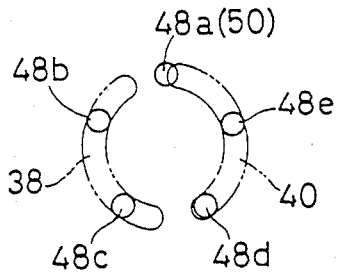

If a command to stop the motor is generated after the stop position has been reached (when the current motor position is ahead of the stop position) as indicated in FIG. 5, the fluid-chamber port 48*a* communicates with the B-port 40, and further with the reversing chambers 8*d*, 8*e* through the connecting passages 46*d*, 46*e*, causing the crankshaft 22 to be reversed, i.e., in the clockwise direction, as described below. In this case, the B-port 40 is subject to a comparatively high pressure while the A-port 38 is subject to a comparatively low paressure, contrary to the preceding case where the motor stop command is generated when the stop position is ahead of the current motor position. As a result, the pressurized fluid is supplied to the reversing fluid chambers 8*d*, 8*e*, while the fluid is discharged from the advancing fluid chambers 8*b*, 8*c* to the reservoir 70. Thus, the crankshaft 22 is rotated in the clockwise direction toward its stop position, and is finally stopped at the stop position, as in the preceding case.

The torque to return the crankshaft 22 toward the stop position is also produced based on a pressure difference due to the restrictors 76, 78. Namely, the restrictor 78 associated with the B-port 40 acts to raise the fluid pressure. More specifically, one of the restrictors 76, 78 which is on the high-pressure side (generally, the pressure input side), serves to restrict the fluid discharge from the motor, while the other restrictor on the low-pressure side (generally, the pressure release side) serves to permit the fluid discharge. The pressure input and release sides are reversed depending upon the operating position of the crankshaft 22 with respect to the stop position at the moment when the motor is commanded to stop. Therefore, the fluid passages 56, 58 must be provided with the respective restrictors 76, 78, so that the pressure difference indicated above can be produced in both instances, i.e., the case where a motor stop command is generated before the stop position has been reached, and the case where the stop command is generated after the current motor position is ahead of the stop position.

While the above operational description of the motor is based on the assumption that no external forces are exerted to the motor at the stop position, for simplification of the description, the operation where the motor at rest is subject to an external force cannot be explained simply based on a pressure difference between the high and low pressure sides of the motor, as in the case where an external force does not act on the motor. In the case where an external force acts on the motor in a direction toward the stop position, the pressure in one of the A- and B-ports 38, 40 which communicates with the motor-stop inlet port 50 may be lower than that in the other port 38, 40. In the same case, the pressures in the A-port 38 and B-port 40 while the motor is stopped are not balanced. That is, the motor torque acting in a direction away from the stop position balances the sum of the motor torque acting in the direction toward the stop position, and the external force acting on the motor. For instance, if the external force acts on the motor in the clockwise direction in FIG. 1, the torque produced by the pressures in the fluid chambers 8*b*, 8*c* which resist the external force, balances the sum of the torque based on the external force, and the torque produced by the pressures in the fluid chambers 8d, 8e which act in the same direction as the external force. In this case, there is a tendency that the motor is stopped such that the fluid-chamber port 48a is more or less nearer to the A-port 38 than to the B-port 40.

In the present motor, the produced torque which may vary over a certain range can withstand an external force acting in either direction. Even if the external force exceeding the produced motor torque temporarily acts on the motor at the stop position and moves the motor away from the stop position, the motor torque will cause the motor to be returned back to the stop position. The motor torque is maximum when the area of communication of the fluid-chamber port 48a with the A-port 38 or B-port 40 amounts to a level at which the fluid-chamber port 48a no more functions as a variable restrictor. Therefore, the maximum motor torque produced does not necessarily correspond to the full communication of the fluid-chamber port 48a with the A-port or B-port 38, 40. While the motor is maintained at its stop position by the torque produced thereby, the principle of the present invention does not exclude the use of an additional means (such as a mechanical brake or notch) for locking the motor at the stop position. Such an additional means is effective in the event of a failure in the hydraulic circuit, and assures increased reliability of positioning of the motor at the stop position.

In the case where the operating speed is comparatively high at the time the motor is commanded to stop, the motor tends to slightly overshoot the predetermined stop position due to inertia of the rotating mass, and return to the stop position. This contributes to providing a shock absorbing effect.

The operation to bring the motor to the stop position as described above is initiated when the solenoid-operated valves 64, 68 are provided with appropriate signals. If these signals are generated when the current operating position or phase of the motor is within 180 degrees of angle before the stop position of FIG. 1, a torque produced by the motor causes the crankshaft 22 to be rotated further in the advancing or operating direction. If the signals are generated when the current phase of the motor is within 180 degrees past or ahead of the stop position in the operating direction, a torque produced by the motor causes the crankshaft 22 to be rotated in the reverse direction. The stop position shown in FIG. 1 is established when the volume of the fluid chamber 8a is maximum. That is, there exists only one stop position corresponding to the maximum volume of the fluid chamber 8a. In the case where the motor is used as an indexing motor, there is one indexing position, and an indexing or stop command is generated within 180 degrees of angle preceding or following this indexing position (stop position). While it is theoretically possible that the motor is stopped at a position diametrically opposite to the stop position (180 degrees spaced away from the stop position in the operating direction), there is actually no possibility that the motor is in equilibrium at the position opposite to the predetermined stop position.

The accuracy of positioning of the motor at the stop position is principally determined by machining accuracy of the A-port 38, B-port 40 and the fluid-chamber ports 48a–48e. A displacement of the motor due to an external force (load) is also affected by the machining accuracy of these ports, namely, by the precision with which the ports 48a–48e are selectively connected to the A- and B-ports 38, 40. The size of the fluid-chamber ports 48a–48e relative to the wall thickness between the corresponding ends of the A- and B-ports 38, 40 is a matter of manufacturing or design choice. That is, the fluid trapping characteristic, fluid pressure loss, operating noises, etc. associated with the selective communication between the ports 38, 40 and the ports 48a–48e are changed depending upon whether the size of the ports is smaller than, equal to, or larger than, the above-indicated wall thickness. In any case, the principle of the present invention to stop the motor may be practiced. However, the operating response of the valve elements 38, 40, 48a–48e to a displacement of the motor is improved as the difference between the ports 48a–48e and the wall thickness is reduced (the difference being zero when the port size is equal to the wall thickness). Therefore, the accuracy of positioning the motor at its stop position is improved, and the valving response to a motor displacement from the stop position is also improved. Further, the positioning accuracy may be improved when the ports 38, 40, 48a–48e have configurations which permit a relatively sudden change in the area of communication between the ports 48a–48e and the ports 38, 40. Of course, the accuracy is improved with reduced manufacturing errors of mechanical parts (such as a play of the cross coupling 36).

Figure 6:
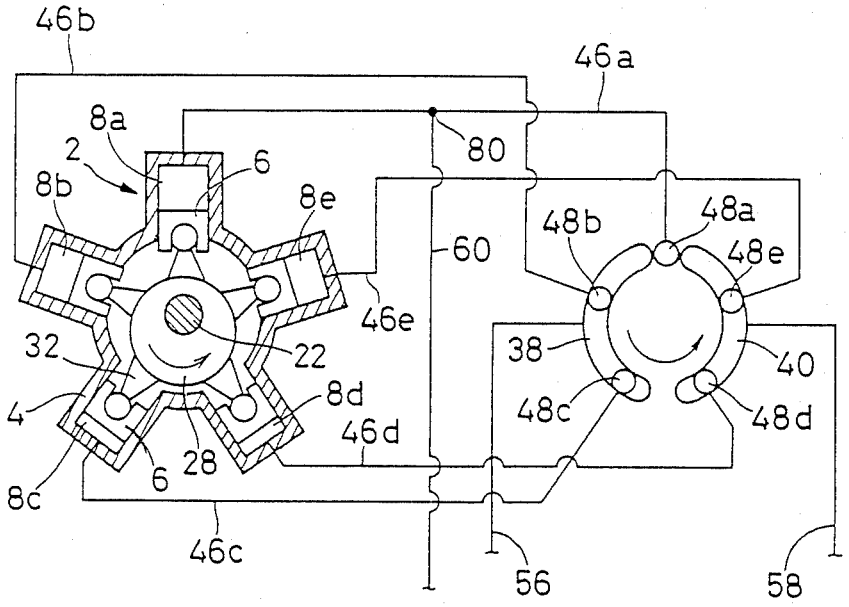
FIG. 6 is a schematic view of one modification of the embodiment of FIG. 1.
Figure 7:
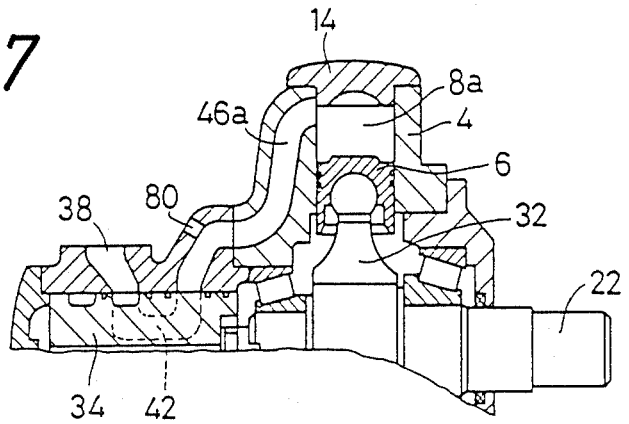
FIG. 7 is a fragmentary elevational view of the radial piston motor of FIG. 6.

A modified arrangement of the embodiment of FIG. 1 is illustrated in FIGS. 6 and 7. In this modified arrangement, a motor-stop inlet port 80 is provided in an intermediate portion of the connecting passage 46a which connects the rotary valve 34 and the fluid chamber 8a, as clearly shown in FIG. 7. In other words, the connecting passage 46a is open at its intermediate portion, and this portion (80) serves as a connection port connected to the fluid passage 60 leading to the pump, as indicated in the circuit diagram of FIG. 6. The portion of the connecting passage 46 between the motor-stop inlet port 80 and the fluid-chamber port 48a serves not only as the ordinary fluid supply and discharge passage, but also as a motor-stop fluid supply passage. The motor-stop inlet port or connection port 80 serves as the first end of the motor-stop fluid supply passage, and the fluid-chamber port 48a serves as the second end of the motor-stop fluid supply passage. The fluid passage 60 connected to the pump 62 and the inlet port 80 is functionally identical to that used in the embodiment of FIG. 1.

Figure 8:
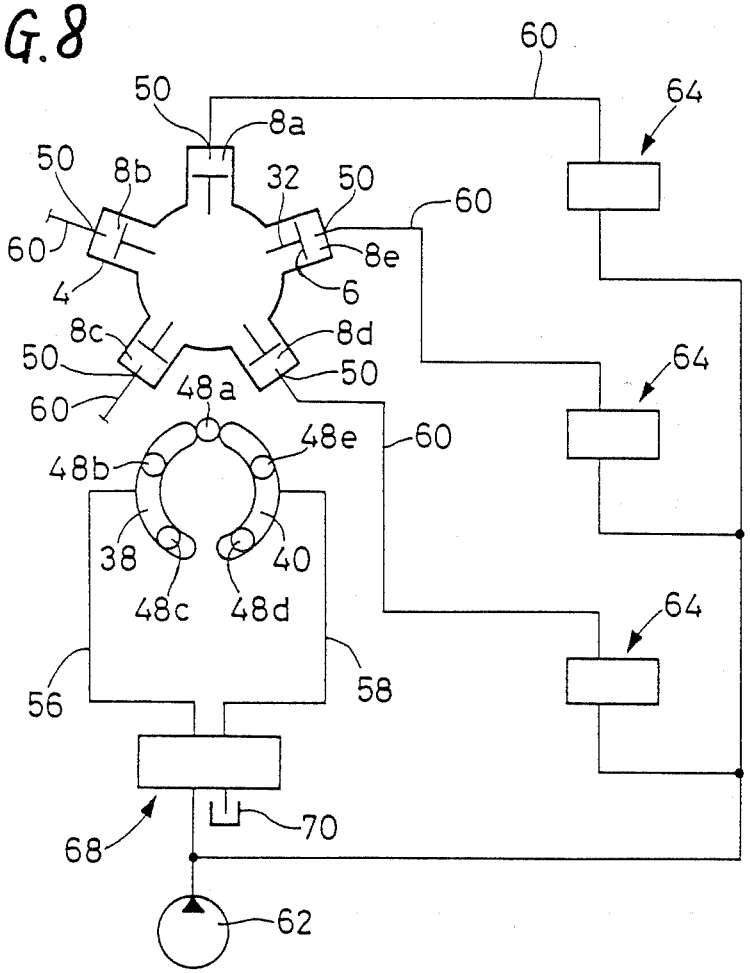
FIG. 8 is a schematic view of another modification of the embodiment of FIG. 1.

The motor-stop inlet port 50 or 80 which is open to the fluid chamber 8a or connecting passage 46a, may be formed so as to be open to any one of the other fluid chambers 8b–8e or connecting passages 46b–46e. The stop position of the motor is determined by one of the fluid chambers 8a–8e or connecting passages 46a–46e to which the motor-stop inlet port 50 or 80 is open. If each of the fluid chambers 8a–8e or passages 46a–46e is provided with a motor-stop inlet port, the motor can be stopped at each of five positions corresponding to the five motor-stop inlet ports. One form of this arrangement is schematically illustrated in FIG. 8.

In this figure, the connecting passages 46a–46e are not shown. As indicated in the Figure, each of the fluid chambers 8a–8e (or each of the connecting passages 46a–46e) is formed with a motor-stop inlet port 50. Namely, the motor has five motor-stop inlet ports 50 corresponding to the five fluid chambers 8a–8e. The motor-inlet stop ports 50 are connected to the respective fluid passages 60, which are connected to the pump 62 via respective solenoid-operated shutoff valves 64. In the figure, only three valves 64 are shown in the interest of brevity. In other aspects, the embodiment of FIG. 8 is similar to those of FIGS. 1 and 6.

With the solenoid-operated shutoff valves 64 selectively operated to their open position, the fluid from the pump 62 is selectively supplied to one of the fluid-chamber ports 48*a*–48*e* through the corresponding one of the fluid passages 60, whereby the fluid-chamber ports 48*a*–48*e* selectively function to stop the motor, in the manner described above. For example, if the pressurized fluid is supplied to the fluid-chamber port 48*b*, the motor is stopped at a position in which the volume of the corresponding fluid chamber 8*b* is maximum. Similarly, the motor is stopped at each one of the other positions corresponding to the other fluid chambers. Thus, the motor has a total of five stop positions, and can be indexed at these five positions in increments of 72 degrees. For instance, the five solenoid-operated shutoff valves 64 are successively operated to their open position, in the order corresponding to the operating direction of the motor, each valve 64 being operated after a given angle of rotation of the motor. In this case, the motor may be indexted successively at the stop position, by simply operating the shutoff valves 64 successively while holding the directional control valve 68 in its neutral position, i.e., without operating the valve 68 to and from its neutral position. Although the indexing of the motor is effected at a higher speed when the directional control valve 68 is operated between the selective successive operations of the shutoff valves 64, the operations of the shutoff valves 64 will suffice if the angle of rotation of the motor preceding each indexing action is relatively small. In the instant case of the 5-position equiangular indexing of the motor, too, different indexing or stopping motions will occur depending upon whether the current operating position or phase of the motor is within 180 degrees to or from the desired stop position in the operating direction.

While each of the five fluid chambers 8*a*–8*e* is provided with the motor-stop inlet port 50 in the above embodiment, it is possible to provide a plurality of motor-stop inlet ports 50 whose number is smaller than the number of the fluid chambers. In this case, the stop or indexing positions of the motor are not evenly spaced apart from each other. For instance, only the two fluid chambers 8*b*, 8*e* may be provided with the respective motor-stop inlet ports 50.

While a variety of modifications of the hydraulic circuit for the radial piston motor of the invention are available, only typical examples of such modifications will be described by reference to FIGS. 9–17. In the interest of brevity and simplification, only the A-port 38, B-port 40 and motor-stop inlet port 50 of the motor are shown in the figures. In these figures, the motor-stop inlet port 50 (replaceable by the functionally equivalent port 80) is shown in place of the corresponding one of the fluid-chamber ports 48*a*–48*e*, for easy understanding of the principle of the invention.

In the hydraulic circuit shown in FIG. 9, a single solenoid-operated directional control valve 84 is provided. This control valve 84 replaces the shutoff valve 64 and the directional control valve 68 used in the embodiment of FIG. 1. That is, the single control valve 84 is assigned to perform the functions of the two valves 64, 68. Described in greater detail, the directional control valve 84 is a 5-port 3-position valve which includes additional ports for connecting and disconnecting the pump 62 to and from the motor-stop inlet port 50 of the motor. Thus, this 5-port 3-position valve 84 serves not only as shutoff means for effecting connection and disconnection of the fluid passage 60 to and from the inlet port 50, but also as selector means operable for connecting the fluid passages 56, 58 communicating with the A-port and B-port 38, 40 to the reservoir 70 through the respective restrictors 76, 78, when the motor is commanded to stop. The directional control valve 84 which is solenoid-operated as shown in the figure, may be manually operated. This is true for all of the other solenoid-operated valves shown in the figures.

In the hydraulic circuit shown in FIG. 10, a sequence valve 86 and a check valve 88 are substituted for the shutoff valve 64 of FIG. 1, and cooperate to serve as the shutoff means. When the directional control valve 68 is operated to the neutral position shown in the figure and the delivery pressure of the pump 62 rises above a given level, the sequence valve 86 is activated to open the fluid passage 60, thereby permitting the pressurized fluid to be delivered to the motor-stop inlet port 50.

In the hydraulic circuit shown in FIG. 11, the fluid passage 56 connected to the A-port 38 is split into a first branch line 90 and a second branch line 92. Similarly, the fluid passage 58 connected to the B-port 40 is split into a first branch line 94 and a second branch line 96. Each of the first branch lines 90, 94 is connected to a directional control valve 98 so that these first branch lines 90, 94 may be connected to either the pump 62 or the reservoir 70. Each of the second branch lines 92, 96 is held in communication with the reservoir 70. The restrictor 76 is provided in the second branch line 92 while the restrictor 78 is provided in the second branch line 96. Thus, the restrictors 76, 78 are disposed in the second branch lines of the fluid passages 56, 58, respectively, rather than incorporated within the directional control valve 98. In the neutral position (motor stop position) of the control valve 98, the first branch lines 90, 94 of the fluid passages 56, 58 are both disconnected, while the fluid passage 60 is in communication with the pump 62. Thus, the instant arrangement is different from the arrangement of FIG. 9 wherein the fluid passages 56, 58 are connected to the reservoir 70 through the restrictors 76, 78 within the valve 84 when the valve 84 is placed in the neutral position. Since the restrictors 76, 78 are provided in the fluid passages 56, 58, the directional control valve 98 may be an ordinary one commercially available.

In the instant circuit arrangement, the fluid passages 56, 58 which are held in communication with the reservoir 70 through the restrictors 76, 78, function in the same manner as in the preceding embodiments, in positioning the motor at its stop position. However, since the communication of the passages 56, 58 is also maintained during an ordinary operation of the motor, the operating efficiency is lowered to an extent corresponding to an amount of leak flows of the fluid into the reservoir 70 through the restrictors 76, 78.

Figure 12:
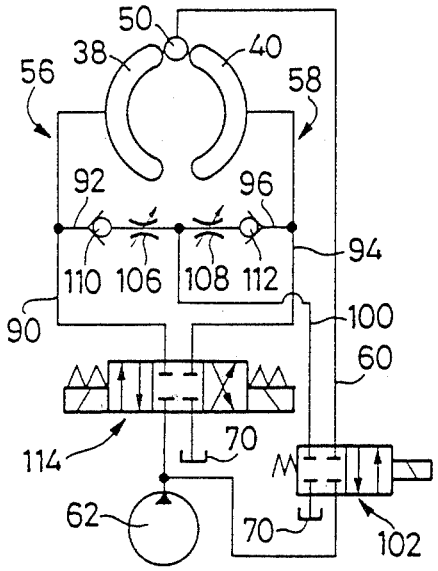

A modification of the circuit of FIG. 11 is illustrated in FIG. 12, wherein the second branch lines 92, 96 of the fluid passages 56, 58 merge into a common line 100, which is connected to a solenoid-operated shutoff valve 102, for communication with the reservoir 70. In the second branch lines 92, 96, there are provided check valves 110, 112 as well as restrictors 106, 108. The check valve 110 is disposed between the A-port 38 and the restrictor 106, so as to permit a fluid flow from the A-port 38 toward the restrictor 106, and block a fluid flow in the opposite direction. Similarly, the check valve 112 is disposed between the B-port 40 and the restrictor 108, so as to permit a fluid flow from the B-port 40 toward the restrictor 108, and block a fluid flow in the opposite direction. Thus, these check valves 110, 112 prevent fluid communication between the A-port 38 and the B-port 40. The motor-stop inlet port 50 is connected to the pump 62 via the shutoff valve 102, while the first branch lines 90, 94 of the fluid passages 56, 58 are connected to the pump 62 or reservoir 70 through the directional control valve 114.

When the motor is operated in the normal forward direction, the directional control valve 114 connects the first branch lines 90, 94 to the pump 62 and the reservoir 70, respectively. For rotation of the motor in the reverse direction, the valve 114 connects the branch lines 90, 94 are connected to the reservoir 70 and the pump 62, respectively. Therefore, the pressurized fluid is supplied to one of the A- and B-ports 38, 40, while the fluid is discharged from the other port 38, 40. In this condition, the common line 100 and the fluid passage 60 are closed by the shutoff valve 102. In in the present circuit, the fluid does not leak into the reservoir 70 through the restrictors 106, 108, whereby the motor can be operated continuously, without a decrease in the operating efficiency due to such leakage of the fluid.

For positioning the motor at the predetermined stop position, the directional control valve 114 is operated in order to disconnect the first branch lines 90, 94, while the shutoff valve 102 is operated to open the fluid passage 60 and the common line 100, so that the pump 62 is connected to the motor-stop inlet port 50 while the fluid passages 56, 58 are connected to the reservoir 70 through the respective restrictors 106, 108. In the present hydraulic circuit, the shutoff valve 102 functions as the shutoff means for connecting and disconnecting the fluid passage 60, and also cooperates with the directional control valve 114 to constitute the selector means for controlling the communication between the passages 56, 58, and the pump 62 and the reservoir 70, depending upon whether the motor is normally operated or in a process of being stopped. It is possible that the shutoff valve 102 is brought to its neutral or stop position a suitable time after the directional control valve 114 is operated to the neutral position (this operation of the valve 114 resulting in stopping a rotating motion of the motor, if no load is applied to the motor). In this case, the stopping and indexing or positioning of the motor take place at different times. It is also possible to replace the valves 102, 114 by a single multi-port control valve. In either case, the pressurized fluid is supplied to the motor-stop inlet port 50 through the fluid passage 60, to bring the motor to its stop position as previously described. For example, if the fluid is supplied to the A-port 38, the restrictor 106 causes the supplied fluid to act on the motor in the advancing direction, while the fluid is discharged from the B-port on the motor reversing side, and returned to the reservoir 70 via the restrictor 108 and the shutoff valve 102. In the case where the pressurized fluid is supplied to the B-port 40, the directions of fluid flows indicated above are reversed.

The restrictors 76, 78 or 106, 108 may be either fixed restrictors, or variable restrictors as shown in FIG. 12. Generally, a fixed restrictor is provided in the form of a choke or orifice formed in a fluid passage, while a variable restrictor is a flow control valve disposed in the fluid passage. The flow control valve as a variable restrictor may be of a pressure compensation type in which the flow restriction is constant irrespective of a variation in the fluid pressure.

Where the motor is used as an indexing motor, the positioning or indexing accuracy of the motor is improved with an increase in the degree of restriction of the restrictor. However, as the restriction is increased, the speed at which the motor approaches the stop position is reduced, and the indexing time is accordingly increased. Hence, it is necessary to determine the flow restriction so as to provide a practically optimum compromise between the indexing accuracy and the approaching or stopping speed of the motor. Where a variable restrictor is used, the stopping speed may be adjusted by positively changing the restriction degree of the restrictor.

Where the motor is used as a brake motor, the restriction of the restrictors is determined so as to provide a sufficient fluid pressure for braking the motor. For higher operating efficiency of the motor, it is advantageous to hold the restrictors at a relatively high restriction level. If the restriction is excessively low, a pressure difference between the A-port 38 and the B-port 40 cannot be large enough to assure a sufficient braking force.

As described before in connection with the embodiment of FIG. 1, it is desired that the size (cross sectional area) of the restrictors is smaller than the maximum area of communication of the motor-stop inlet port 50 (more precisely, the fluid-chamber port 48*a*, etc.) with the A-port 38 or B-port 40. However, this arrangement is not always absolutely true, since a pressure difference between the A- and B-ports 38, 40 may possibly be created even if the size of the restrictors is equal to or larger than the maximum area of communication indicated above.

It is significant to further consider the degree of restriction of the restrictors. It will be understood from the foregoing description that the size of the restrictors is determined by the desired maximum permissible rate of flow of the fluid, in other words, a cross sectional area (A) of the restrictors is determined so as to restrict the fluid flow therethrough, as compared with a fluid flow (Q) into the motor-stop inlet port 50. The following formula defines a standard relation useful to determine the cross sectional area of the restrictors:

$$A < \frac{Q}{C\sqrt{P}}$$

where,

C: Constant

P: Pressure difference between A-port and B-port necessary to produce a required motor torque Where pressure-compensated flow control valves are used as the restrictors, the following formula may be used as a standard in determining the cross sectional area A:

$$A < \frac{Q}{C\sqrt{P'}}$$

where,

C: Constant

P': Pressure difference at a flow restricting portion of the pressure-compensated flow control valve There are no specific absolute conditions to determine the minimum fluid flow through the restrictors. However, it can be said that the minimum fluid flow is usually greater than a leak flow of the fluid through the motor and the hydraulic circuit.

Figure 13:
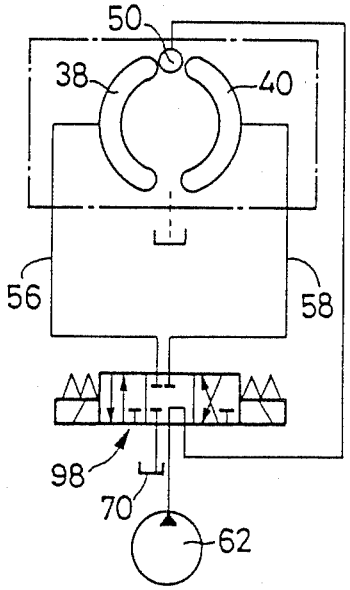

While the restrictors are used in the embodiments illustrated above, they are not essential. For example, the leak flow through the motor may be utilized in place of exclusive restrictors, as indicated in FIG. 13. In this case, the leak flow provides substantially the same effect as provided by the exclusive restrictors. When the motor is commanded to stop, the directional control valve 98 similar to that shown in FIG. 11 is operated to shut the fluid passages 56, 58. Although this form of arrangement utilizing a leak flow may not be available for some special types of motors, the arrangement is usually applicable to any ordinary types of motors. The operability of the present arrangement was confirmed on specimen motors.

Figure 14:
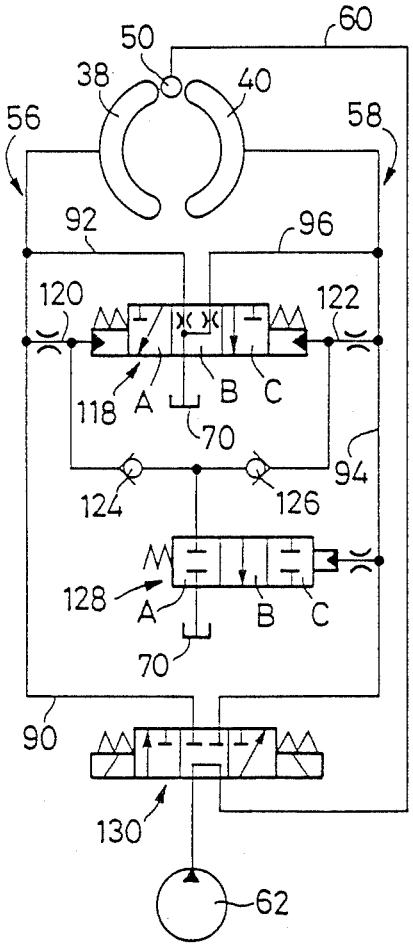

The hydraulic circuit shown in FIG. 14 does not use any restrictors in the sense explained above, i.e., does not use any restrictors which function to cause fluid flows to and from the motor for stopping the motor. Instead, the instant circuit utilizes a combination of valves. More specifically, the second branch lines 92, 96 of the fluid passages 56, 58 are connected to the reservoir 70 through a pilot-operated control valve 118 (hereinafter referred to as "pilot valve"). This pilot valve 118 receives at its opposite ends pilot pressures from the fluid passages 56, 58, through respective third branch lines 120, 122 of the passages 56, 58. The third branch lines 120, 122 are provided with respective check valves 124, 126, and are connected to each other, into a common line which is connected to the reservoir 70 via a pilot-operated control valve 128. On the other hand, the first branch lines 90, 94 of the fluid passages 56, 58 are connected to the pump 62 via a solenoid-operated directional control valve 130. The pilot valves 118, 128 are provided with a restrictor at each input of the pilot pressure, for controlling the operating speed of the valves. Further, the pilot valve 118 incorporates restrictors that are operable when the valve 118 is placed in its position B, in order to raise the pressures in the fluid passages 56, 58 and thereby enable the valve 118 to be operated. Thus, the restrictors used in the present circuit are functionally different from the restrictors used in the preceding arrangements.

When the motor is normally operated, the solenoid-operated valve 130 is placed in a position in which the pressurized fluid delivered from the pump 62 is supplied to the A-port 38 or the B-port 40. If the fluid is supplied to the A-port 38, for example, the pilot valve 128 is placed in its position A, and the pilot valve 118 is operated from its position B to its position A due to the pilot pressure received from the passage 56. As a result, the fluid discharged from the B-port 40 is returned to the reservoir 70 through the pilot valve 118. If a command to stop the motor is generated in this condition, the solenoid-operated valve 130 is activated to supply the pressurized fluid to the motor-stop inlet port 50. If the activation of the valve 130 occurs before the predetermined stop position has been reached, the motor-stop inlet port 50 communicates with the A-port 38, whereby the pilot valves 118, 128 are both maintained in their position A, permitting the fluid from the B-port 40 to be returned to the reservoir 70.

If the motor is moved past the predetermined stop position in the operating direction, the motor-stop inlet port 50 is brought into communication with the B-port, whereby the pressure in the fluid passage 56 is lowered, causing the pilot valve 118 to be returned to its position B. Consequently, the pressure in the fluid passage 58 becomes higher and acts on the pilot valve 118, but the valve 118 will not be operated unless the pressure in the branch line 120 is sufficiently lowered. However, a rise in the pressure in the branch line 94 will cause the pilot valve 128 to be operated from the position A to the position C via the position B. Since the fluid in the branch line 120 is permitted to be discharged into the reservoir 70 when the pilot valve 128 is temporarily placed in its position B, the pilot valve 118 is operated to its position C, whereby the fluid passage 58 is disconnected while the fluid passage 56 is held in communication with the reservoir 70. As a result, a torque to return the motor to its stop position is produced.

The present arrangement has an improved operating efficiency, since the stopping of the motor is not effected while the discharge flow from the motor is restricted by a restrictor. However, this type of circuit is suitable for a motor which is not subject to a load while it is stopped, for example, a motor for an index table. If a load (external force) is exerted to the motor, the levels of the pressures in the various portions of the circuit are not determined as described above. To the contrary, the hydraulic circuits (such as the circuit of FIG. 12) using the restrictors are applicable to any motors irrespective of whether the motor is subject to an external force, and the circuit arrangement may be made simpler.

Figure 15:
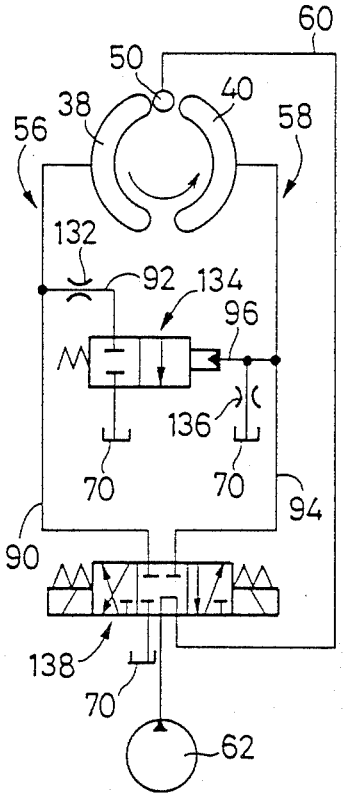

The hydraulic circuit shown in FIG. 15 is adapted to not only a motor which is not subject to a load when placed in its stop position, but also to a motor for a winch, or other motors which, when placed in its stop position, are subject to a load that acts to cause the motor to be displaced in one fixed direction.

In this circuit, the second branch line 92 of the fluid passage 56 is provided with a restrictor 132, and connected to the reservoir 70 via a pilot-operated control valve (hereinafter referred to as "pilot valve") 134. This pilot valve 134 receives a pilot pressure from the second branch line 96 of the fluid passage 58. The branch line 96 is provided with a restrictor 136 and is connected also to the reservoir 70. The first branch lines 90, 94 of the passages 56, 58 are connected to the pump 62 or the reservoir 70 via a solenoid-operated directional control valve 138.

When the present winch motor is operated in a direction indicated by arrow, for example, to lift a load, the control valve 138 is operated to supply the pressurized fluid to the A-port 38 through the fluid passage 56, and discharge the fluid from the B-port 40. Since the pressure in the fluid passage 58 is low, the pilot valve 134 is held in the position indicated in the figure, and the second branch line 92 of the fluid passage 56 is held disconnected.

Upon generation of a command to stop the lifting motion, the control valve 138 is activated to supply the fluid to the motor-stop inlet port 50. By the time the load has been lifted to the predetermined position (the stop position of the winch motor has been reached), the motor-stop inlet port 50 communicates with the A-port 38, and the pressure in the B-port 40 is lower. In this condition, therefore, the pilot valve 134 remains, and the fluid from the B-port 40 is returned to the reservoir 70 through the restrictor 136, whereby the load is further lifted. If the load has been lifted past the predetermined stop position, the motor-stop inlet port 50 is brought into communication with the B-port 40, and the fluid supplied to the B-port 40 is discharged through the restrictor 136, whereby the pressure in the branch line 96 is elevated. As a result, the pilot valve 134 is operated to a position in which the fluid passage 56 communicates with the reservoir 70 through the restrictor 132, and the fluid is discharged from the A-port 38 to the reservoir 70 through the restrictor 132. Thus, the motor is permitted to be returned back to the predetermined stop position by the load applied thereto. The motor may also be returned to the stop position by a pressure difference between the higher and lower sides of the motor, even if a load is not applied to the motor.

It is noted here that the restrictor 132 functions primarily for restricting the speed at which the motor is returned to its stop position, while the restrictor 136 functions to produce a pressure for activating the pilot valve 134. While the present hydraulic circuit permits comparatively high efficiency in stopping the motor in the load-lifting direction, it is not suitable where the direction in which an external load acts on the motor is not fixed.

Figure 16:
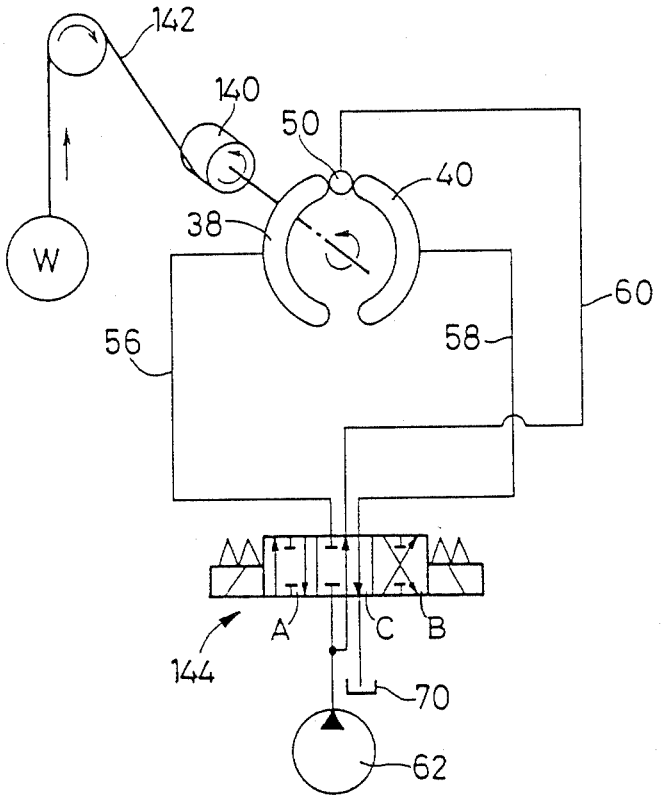
FIG. 16 is a diagrammatic view of one example of a hydraulic circuit for a winch motor.

While the hydraulic circuits using the restrictors 76, 78, etc. discussed above are considered versatile in utility, it is almost true that any hydraulic motor usually has a leak flow, or a hydraulic motor completely free of a leak flow does not exist. Given such a leak, it can be said that restrictors are unnecessary rather than necessary, in a hydraulic circuit for a winch motor or other motors which are subject to a load that acts in one rotating direction of the motors. A typical example of a circuit utilizing the leakage in a motor, as applied to a winch, is illustrated in FIG. 16.

The hydraulic circuit in the present embodiment is conencted to the motor to drive a winch 140, which is adapted to wind a wire 142 for lifting a load W. If the motor is operated in the counterclockwise direction as indicated by arrow, for lifting the load W, the load is exerted on the motor in the clockwise direction. Namely, the motor is subject to a force that acts to cause the motor to be rotated in the reverse direction. In the position shown in the figure, the A-port 38 is on the load-lifting side, while the B-port 40 is on the reversing side.

The fluid passages 56, 58 connected to the A-port and B-port 38, 40, respectively, are connected through a solenoid-operated directional control valve 144 to the pump 62 or the reservoir 70. The fluid passage 60 connected to the motor-stop inlet port 50 is connected to the pump 62, also through the control valve 144. This control valve 144 is a 6-port 3-position valve which closes the fluid passage 60 when placed in its position A for lifting the load, or its position B for lowering the load, and which opens the fluid passage 60 when placed in its position C for stopping the motor. Thus, the valve 144 serves as the shutoff means. In the load-lifting position A of the valve 144, the fluid passages 56 and 58 are connected to the pump 62 and the reservoir 70, respectively. In the load-lowering postion B, the connections are reversed. In the stop position C, the fluid passage 56 on the load-lifting side is closed, and the fluid passage 58 on the load-lowering side is connected directly to the reservoir 70. The directional control valve 144 also serves as the selector means for selectively establishing the above conditions of the circuit.

When the load W is lifted, the directional control valve 144 is placed in its position A for supplying the fluid from the pump 62 to the A-port 38, and discharging the fluid from the B-port 40 to the reservoir 70. When the load W is lowered, the valve 144 is switched to its position B for reversing the connections of the A- and B-ports 38, 40. For stopping the motor, the valve 144 is set to its position C for supplying the fluid from the pump 62 to the motor-stop inlet port 50. In the case where the motor stop command is generated before the predetermined stop position has been reached, the fluid flows from the motor-stop inlet port 50 into the A-port 38, and the pressure in the A-port 38 is raised since the fluid passage 56 is disconnected. On the other hand, the fluid passage 58 communicates with the reservoir 70, permitting the fluid to be discharged from the B-port 40. Thus, the motor is further operated toward its stop position in the load-lifting direction.

If the motor is operated past the predetermined stop position, the motor does not produce a torque resisting the load W, since the pressurized fluid is not supplied to the A-port 38 from the motor-stop inlet port 50. Conversely, the fluid is supplied to the B-port 40 from the motor-stop inlet port 50. However, the pressure in the B-port 40 will not rise because the B-port 40 communicates with the reservoir 70. The fluid supplied to the B-port 40 is further fed into the reversing fluid chambers whose volumes are increased as the motor is rotated in the reverse direction. While the fluid passage 56 connected to the A-port 38 on the load-lifting side is disconnected, the fluid may leak from the load-lifting side of the motor. Accordingly, the motor is returned to the stop position by the load W. Although the instant circuit permits higher efficiency as compared with the circuits using restrictors such as the restrictor 76, its utility or application is limited. The circuit of FIG. 15 described above can function even if the motor or circuit does not permit the fluid to leak.

Figure 56:
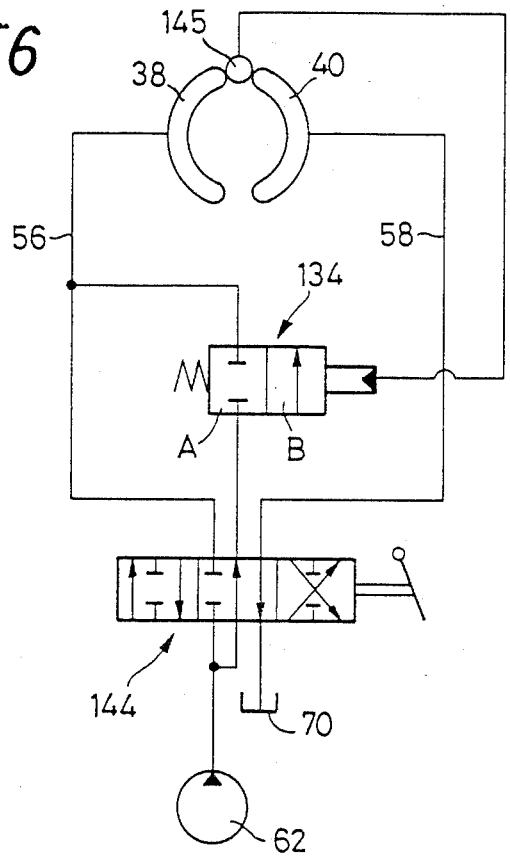
FIG. 56 is a diagrammatic view of a modification of the hydraulic circuit of FIG. 15 or 16.

The hydraulic circuit of FIG. 15 or 16 may be modified as illustrated in FIG. 56, for example. In this modified circuit, a motor-stop inlet port 145 is provided not to positively supply or discharge the fluid into or from the motor, but to function as a pressure sensing port. The fluid supply and discharge to and from the motor for stopping the motor is controlled by a pilot-operated control valve 134. Described more specifically, the pressure in the pressure sensing port (145) is used as a pilot pressure acting on the pilot valve 134. If the A-port 38 is on the load-lifting side and the motor is operated in the counterclockwise direction to lift the load, the pressure sensing port (145) communicates with the A-port 38 on the high pressure side if a motor stop command is generated before the stop position has been reached. In this case, the pilot valve 134 is placed in its position B, so that the motor is further rotated in the load-lifting direction. If the motor is commanded to stop after it has passed the stop position, the pressure sensing port (145) communicates with the B-port 40 on the low pressure side, and the pilot valve 134 is consequently operated to the position A, whereby the load acting on the motor causes the motor to be returned to the stop position.

Figure 17:
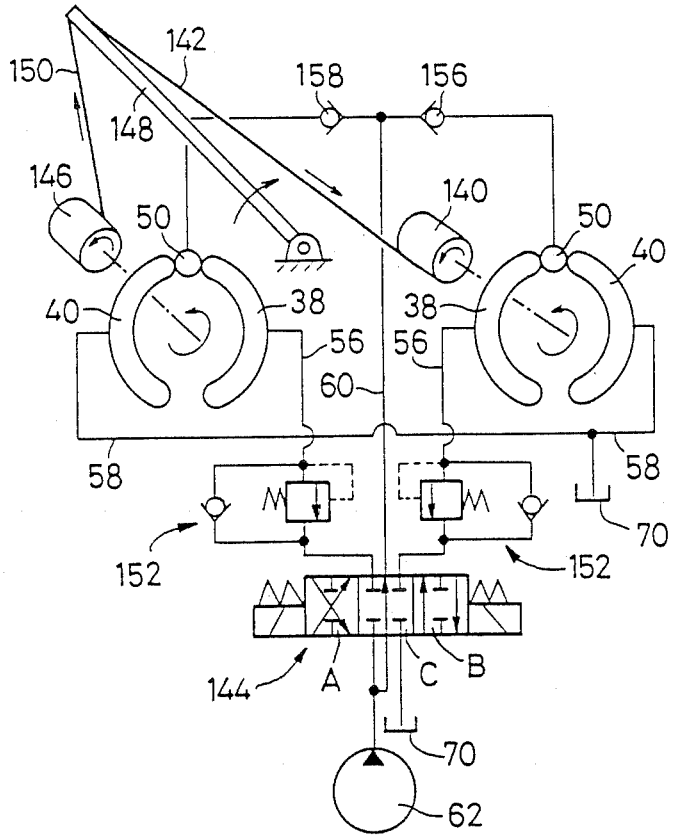
FIG. 17 is a diagrammatic view of one form of a hydraulic circuit for two winch motors connected to each other.

Referring to FIG. 17, there is illustrated an example of application of the circuit of FIG. 16, adapted to drive a pair of motors for a guy winch which includes a winch 140 and another winch 146. The winches 140, 146 are operated to wind and rewind respective wires 142, 150, for moving a driven member 148 pivotally about a pivot axis at its one end, over a predetermined angular range. The motor for the winch 140 is operated in the counterclockwise direction (in the figure) to wind the wire 142 while overcoming a load of the driven member 148, and in the clockwise direction to rewind the wire 142. The motor for the winch 146 is operated in the clockwise direction to wind the wire 150, and in the counterclockwise direction to rewind the wire 150. Thus, the two motors are operated in the opposite directions, and the rewinding motion of one of the motors follows the winding motion of the other motor. The fluid passages 56, 56 connected to the A-ports 38 are connected to the pump 62 or the reservoir 70 via the solenoid-operated directional control valve 144. Each of the fluid passages 56, 56 is provided with a counterbalancing valve 152, which permits a comparatively easy flow of the fluid toward the A-port 38 and restricts a flow of the fluid toward the control valve 144, thereby providing a resistance to a rotating movement of the motor in the rewinding direction, and thus preventing a slack of the wire 142, 150. The fluid passages 58, 58 connected to the B-ports 40 are connected directly to the reservoir 70, and the fluid passage 60 is connected to the motor-stop inlet port 50 of each motor through a check valve 156 or 158. While a detailed description of the operation of the present arrangement will be omitted herein, the arrangement is similar to that of FIG. 16, in the principle of operation to stop the motors.

While several modified hydraulic circuits have been described and illustrated, the following description refers to further motor-circuit arrangements according to the invention.

Figure 18:
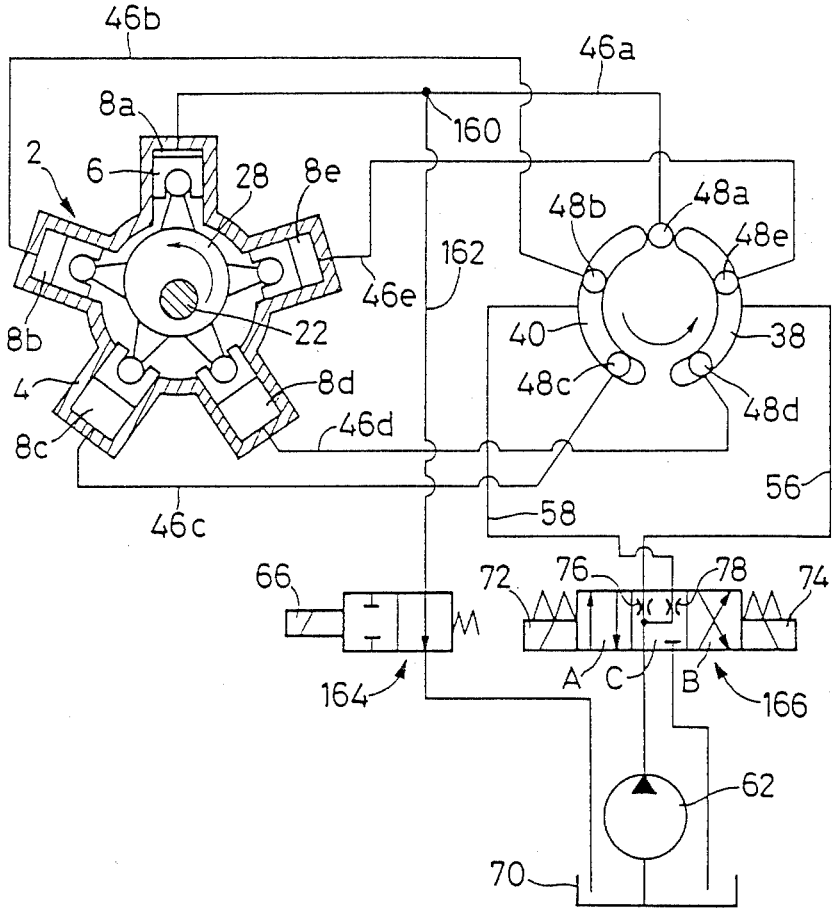
FIG. 18 is a schematic view of another modification of the embodiment of FIG. 1, wherein the motor is provided with a motor-stop outlet port.

In all of the embodiments illustrated above, the motor is stopped and positioned by forcing the pressurized fluid into the motor, i.e., by effecting a forced supply of the fluid to the motor. According to another aspect of the invention, the motor can be stopped and positioned by causing a discharge flow of the fluid from the motor. An embodiment according to this aspect of the invention is illustrated in FIG. 18. The same reference numerals as used in FIG. 1 are used in FIG. 18 to identify the corresponding components, and their detailed description will not be provided.

The motor employed in the present embodiment is formed with a motor-stop outlet port 160. This outlet port 160 is structurally identical with the motor-stop inlet port 50 of FIG. 1 or 80 of FIG. 6, and is held in communication with the fluid chamber 8*a* and the fluid-chamber port 48*a*. The outlet port 160 cooperates with the connecting passage 46*a* and the fluid-chamber port 48*a*, to provide a motor-stop fluid discharge passage. The outlet port 160 and the port 48*a* serve as opposite first and second ends of this fluid discharge passage. The outlet port 160 also functions as a connection port at which the motor-stop fluid discharge passage is connected to a fluid passage 162. The passage 162 is connected to the reservoir 70 via a solenoid-operated shutoff valve 164 (shutoff means).

The operating phase of the motor, as shown in FIG. 18, is 180 degrees rotated counterclockwise from that as shown in FIG. 1. Hence, the A-port 38 is positioned on the right-hand side of FIG. 18, while the B-port 40 is on the left-hand side. The fluid passages 56, 58 connected respectively to these A- and B-ports 38, 40 are connected to the pump 62 or the reservoir 70 via a solenoid-operated directional control valve 166. When the control valve 166 is placed in its stop position (position C) of FIG. 18, the fluid passages 56, 58 are connected to the pump 62, through the respective restrictors 76, 78.

An operation to stop the motor rotating in the counterclockwise direction (in the figure) will be described, assuming that the motor is not subject to a load, in the interest of simplification of the description. Upon operation of the control valve 166 to its position C, the pressurized fluid is supplied to the A-port 38 and the B-port 40 through the respective fluid passages 56, 58 and through the restrictors 76, 78. In the meantime, the shutoff valve 164 is switched to its position to open the fluid passage 162, for communication of the motor-stop outlet port 160 (and consequently the fluid-chamber port 48*a*) with the reservoir 70.

Figure 19:
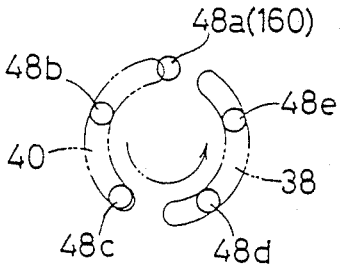
FIGS. 19 and 20 are views illustrating the operation of the arrangement of FIG. 18.

In the case where the above switching operations of the valves 166, 164 take place before the predetermined stop position of the motor has been reached, as indicated in FIG. 19, the B-port 40 is brought into communication with the motor-stop outlet port 160. Consequently, the fluid is discharged from the reversing fluid chambers 8*a*, 8*b* and 8*c*, whereby the motor is further advanced. More specifically, the fluid supplied to the A-port 38 is fed into the advancing fluid chambers 8*d* and 8*e*. At the same time, the fluid is also supplied from the pump 62 to the B-port 40. This supply to the B-port 40 is restricted by the restrictor 78, while the fluid is discharged from the B-port 40 through the motor-stop outlet port 160. As a result, the pressure in the B-port 40 (motor reversing side) is made lower than that in the A-port 38, whereby a torque produced due to a pressure difference therebetween causes the motor to be further rotated in the advancing direction.

Figure 20:
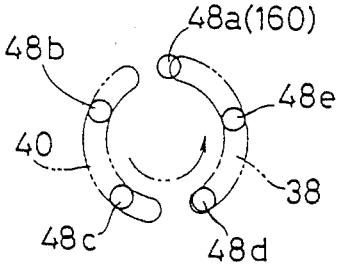

In the case where the motor stop is commanded when the current operating position of the motor is ahead of the predetermined stop position as indicated in FIG. 20, the A-port 38 is brought into communication with the motor-stop outlet port 160. Consequently, the fluid is discharged from the advancing fluid chambers 8*a*, 8*d* and 8*e*, while the pressurized fluid is supplied through the B-port 40 to the reversing fluid chambers 8*b* and 8*c*. As a result, the motor is rotated toward its stop position. At this time, the restrictor 76 acts to lower the pressure in the A-port 38.

The motor is eventually positioned without a deviation from the predetermined stop position in either direction. Namely, the motor is stopped at a position in which the fluid-chamber port 48*a* communicating with the motor-stop outlet port 160 is located at a position intermediate between the corresponding ends of the A- and B-ports 38, 40. In this condition, the advancing and reversing torques are balanced, and the volume of the fluid chamber 8*a* is minimized with the corresponding piston 6 placed at its top dead point. In the case where the motor rotating in the clockwise direction is stopped, the same operation as described above will result, except that the advancing and reversing sides of the motor are reversed. If the motor is subject to an external force even after it is stopped, the external force acts as a component which contributes to the equilibrium of the forces acting on the motor in the advancing and reversing direction, as previously described on the case where the motor is stopped by means of a forced supply of the fluid through the motor-stop inlet port. In principle, the conditions of the restrictors 76, 78 used in the circuits for the motor having a motor-stop inlet port are applicable to the restrictors in the instant and other circuits adapted to a motor having a motor-stop outlet port.

Referring to FIG. 21, there is shown a modified circuit for a motor having the motor-stop outlet port 160, that is, a modified circuit for causing a discharge flow of the fluid from the motor for stopping the motor. The second branch lines 92, 96 of the passages 56, 58 of the instant circuit are provided with check valves 170, 172. As is apparent by referring back to FIG. 12 for comparison, these check valves 170, 172 are oriented in the directions opposite to those of the check valves used in the motor-stop fluid supply circuit of FIG. 12. The branch lines 92, 96 merge into a common line 174 which is connected to the pump 62 via a solenoid-operated shutoff valve 176. This shutoff valve 176 has a stop position in which the fluid passage 162 communicates with the reservoir 70 while the common line 174 communicates with the pump 62. In the other aspects, the instant circuit is identical with that of FIG. 12. When the motor is stopped and positioned, the pressurized fluid is supplied from the pump 62 to the A-port 38 and the B-port 40, through the common line 174 and through the respective check valves 170, 172 and the respective restrictors 106, 108. At the same time, the fluid is discharged from the motor to the reservoir 70, through the motor-stop outlet port 160.

There are available various other modifications of the motor-stop fluid discharge circuit, for example, those corresponding to the circuits of FIGS. 9–11. In essence, such motor-stop fluid discharge circuits are adapted such that upon stopping of the motor, the motor-stop outlet port 160 is brought into communication with the reservoir 70 while the A-port and B-port 38, 40 are put into communication with the pump 62 through respective restrictors. Further, the motor-stop fluid discharge circuits may be modified for which motors or other motors which are subject to an external load, which acts on the motor in one of the opposite operating directions.

Referring to FIG. 22, there is illustrated a motor-stop fluid discharge circuit used, for example, for a winch motor. The instant circuit corresponds to the circuit shown in FIG. 16, but is different therefrom in that a solenoid-operated directional control valve 178, when placed in its stop position C, effects communication between the fluid passage 56 (A-port 38) and the pump 62, disconnection of the fluid passage 58 (B-port 40), and communication between the fluid passage 162 and the reservoir 70. According to this arrangement, the motor is stopped in the advancing direction such that the pressure in the A-port 38 is made higher, and the fluid is discharged to the reservoir 70 through the B-port 40 and the motor-stop outlet port 160. When the motor is stopped in their reversing direction, the fluid is discharged to the reservoir 70 through the A-port 38 and the outlet port 160, while the fluid is admitted into the motor through the B-port 40 due to a leak through the motor, whereby the motor is returned to its stop position by the load W.

According to the present concept of the invention wherein the fluid is discharged through the motor-stop outlet port 160, a multi-position indexing arrangement as depicted in FIG. 8 is also available. The only difference in the principle of operation lies in the direction in which the fluid flows through the motor-stop inlet and outlet ports.

Figure 23:
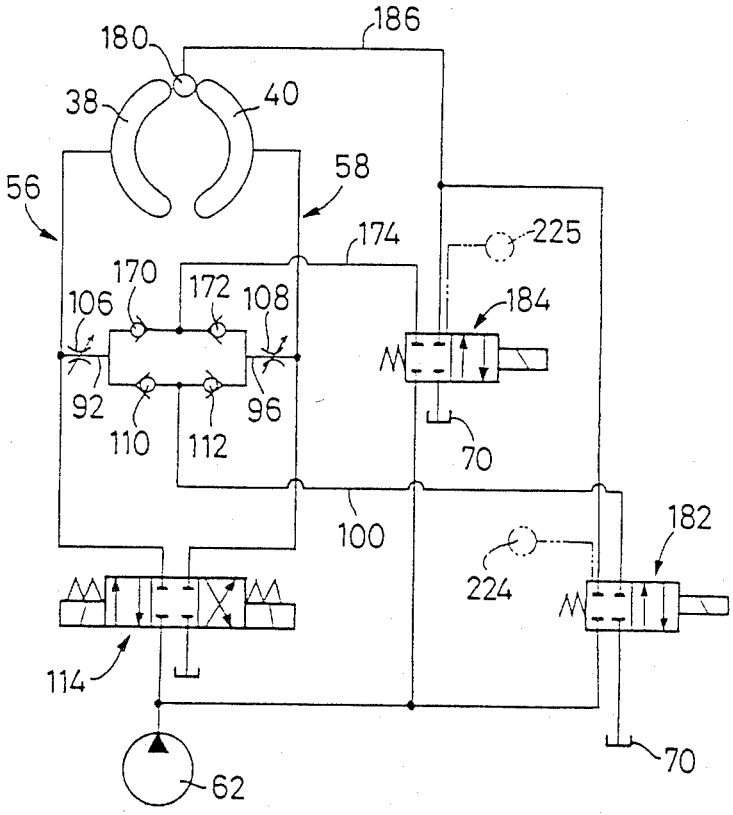
FIG. 23 is a diagrammatic view of a hydraulic circuit, which is a combination of the circuits of FIGS. 12 and 21.

It is possible that a single port is used selectively as a motor-stop inlet port or as a motor-stop outlet port. In other words, a single common port may function as the motor-stop inlet and outlet ports. An example of this arrangement is shown in FIG. 23, wherein a reference numeral 180 designates a motor-stop port used as the inlet port or outlet port. Although this port 180 corresponds to the port 50 of FIG. 1 or port 80 of FIG. 6 (port 160 of FIG. 18), the new reference numeral 180 is used in order to distinguish the present embodiment from those embodiments of FIGS. 1 and 6. The hydraulic circuit shown in FIG. 23 is considered to be a combination of the circuits shown in FIGS. 12 and 21. The second branch lines 92, 96 of the fluid passages, 56, 58 are provided with two pairs of check valves 110, 112 and 170, 172, which are disposed in parallel to each other. The check valves 110, 112 are connected to the common line 100, while the check valves 170, 172 are connected to the common line 174. The pair of check valves 110, 112 permit flows of the fluid into the common line, while the pair of check valves 170, 172 permit flow of the fluid from the common line 174 into the branch lines 92, 96. Both of these two pairs of check valves similarly function to prevent fluid communication between the two second branch lines 92, 96. The common lines 100, 174 are connected to the reservoir 70 or the pump 62, through respective solenoid-operated shutoff valves 182, 184. A fluid passage 186, which is connected to the motor-stop port 180, is connected to the pump 62 through the shutoff valve 182, and to the reservoir 70 through the shutoff valve 184 in parallel connection with the shutoff valve 182.

When the motor is stopped, the shutoff valve 182 is operated to a position in which the fluid passage 186 and the common line 100 communicate with the pump 62 and the reservoir 70, respectively. Further, the directional control valve 114 is operated to a position for disconnecting the fluid passages 56, 58 from the pump and reservoir 62, 70. In this case, the pressurized fluid is delivered from the pump 62 to the motor-stop port 180, while the fluid is discharged from the A- and B-ports 38, 40 to the reservoir 70 through the restrictors 106, 108, check valves 110, 112 and common line 100. Thus, the present case uses the motor-stop port 180 as a motor-stop inlet port for forcing the fluid into the motor for stopping the same at its stop position, in which the volume of the fluid chamber **8*a* (in FIG. 1**) is maximum. This position is referred to as "first predetermined stop position".

Conversely, the motor-stop port 180 is used as a motor-stop outlet port, if the shutoff valve 182 is placed in its closed position while the shutoff valve 184 is set in a position for connecting the passage 186 and the common line 174 to the reservoir 70 and the pump 62, respectively. In this case, the motor is stopped at a position in which the volume of the fluid chamber **8*a* is minimum. This position is referred to as "second predetermined stop position", which is 180 degrees spaced from the first predetermined stop position in which the volume is maximum. This means one additional stop position diametrically opposite to the stop position corresponding to the maximum volume of the fluid chamber 8*a***. Thus, the instant arrangement provides a total of two stop or indexing positions of the motor.

Therefore, if the hydraulic circuit described above is applied for each of the five motor-stop ports 50 (180) shown in FIG. 8, the 5-position indexing motor may be modified into a 10-position indexing motor.

In the embodiment of FIG. 23, the control valve 114 and the shutoff valves 182, 184 cooperate to constitute selector means for changing the fluid communications of the circuit, to selectively establish a fluid supply mode or a fluid discharge mode. In the fluid supply mode, the shutoff valve 182, fluid passages 186, 56, 58, restrictors 106, 108, common line 100, etc. constitute first fluid supply/discharge means. In the fluid discharge mode, the shutoff vale 184, common line 174, restrictors 106, 108, fluid passages 56, 58, 186, etc. constitute second fluid supply/discharge means.

There will next be described an embodiment of a piston motor of a rotary-cylinder type of the present invention.

Figure 24:
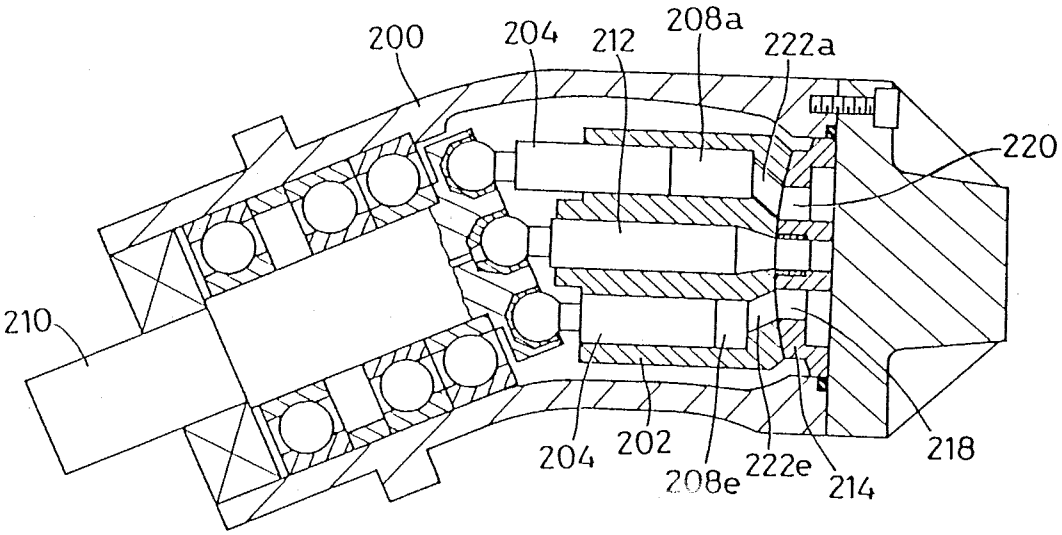
FIG. 24 is a cross sectional view of one embodiment of an inclined-axis, radial piston motor of a rotary-cylinder type of the present invention.

Referring to FIG. 24, there is shown one example of such a rotary-cylinder type of piston motor, in the form of an inclined, axial piston motor. As well known in the art, the piston motor has a cylinder (cylinder block) 202 which is rotatable within a casing 200. The cylinder 202 accommodates a plurality of pistons 204 (nine pistons, for example), which are disposed so as to extend in the axial direction of the cylinder. With the fluid supplied and discharged to and from fluid chambers 208*a*, 208*b* . . . 208*i*, the corresponding pistons 204 are reciprocated. Reciprocating movements of the pistons 204 are converted into rotary movements of the cylinder 202 and an output shaft 210 coupled thereto in an inclined relation with each other. The cylinder 202 is supported rotatably about an axis of an integral cylinder shaft 212. The fluid supply and discharge to and from the fluid chambers 208*a*–208*i* are achieved through a valve plate 214 secured to the casing 200. The valve plate 214 has arcuate valve ports 218 and 220 (hereinafter referred to "A-port" and "B-port") formed therein. As the cylinder 202 is rotated, nine fluid-chamber ports 222*a*–222*i* open to the respective fluid chambers 208*a*–208*i* are selectively brought into communication with the A-port 218 and the B-port 220.

Figure 25:
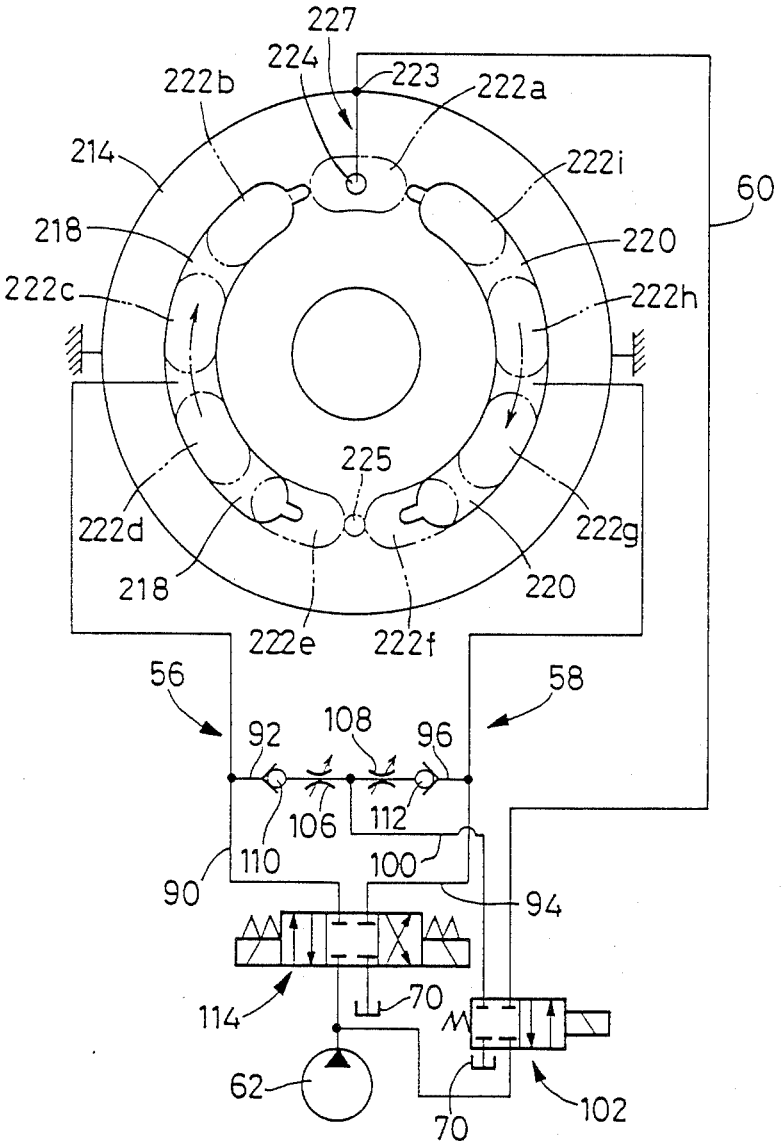
FIG. 25 is a schematic view showing the radial piston motor of FIG. 24, together with a hydraulic circuit for stopping the motor by forcing a fluid into a motor-stop inlet port.

As shown in FIG. 25, the valve plate 214 (stationary valve member) has a motor-stop inlet port 224 formed therein such that the inlet port 224 lies on a circle concentric with the arcuate A- and B-port 218, 220, and is located between the corresponding ends of the A- and B-ports 218, 220. The motor-stop inlet port 224 can communicate selectively with the A-port 218 and the B-port 220 through one of the fluid-chamber ports 222*a*–222*i*. In the neutral position, the inlet port 224 is held in communication with one of the fluid-chamber ports 222*a*–222*i* whose volume is maximum (with the corresponding piston 204 placed at its bottom dead point). The size of the inlet port 224 is determined so that the inlet port 224 may be closed by the end of each wall of the cylinder 202 located between the adjacent two fluid-chamber ports 222, and so that the inlet port 224 does not simultaneously communicate with the adjacent two fluid-chamber ports 222. The motor-stop inlet port 224 is connected to a connection port 223 through a motor-stop fluid supply passage 227. In other words, the connection port 223 and the inlet port 224 serve as the opposite ends of the motor-stop fluid supply passage 227.

Figure 26:
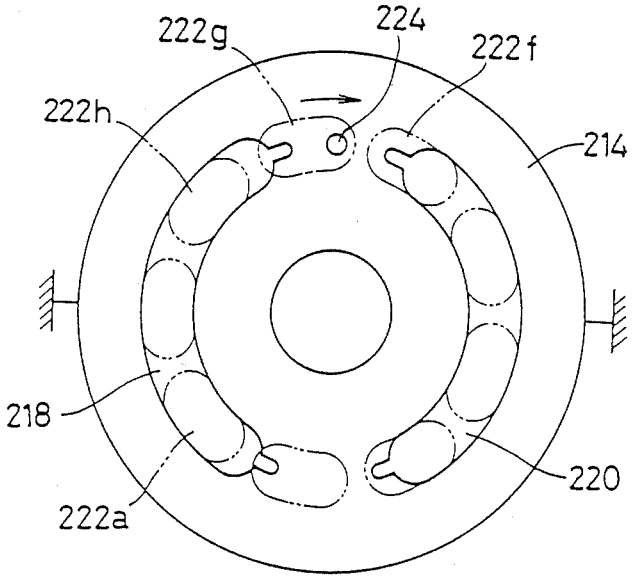
FIGS. 26 and 27 are views illustrating the operation of the arrangement of FIG. 25.
Figure 27:
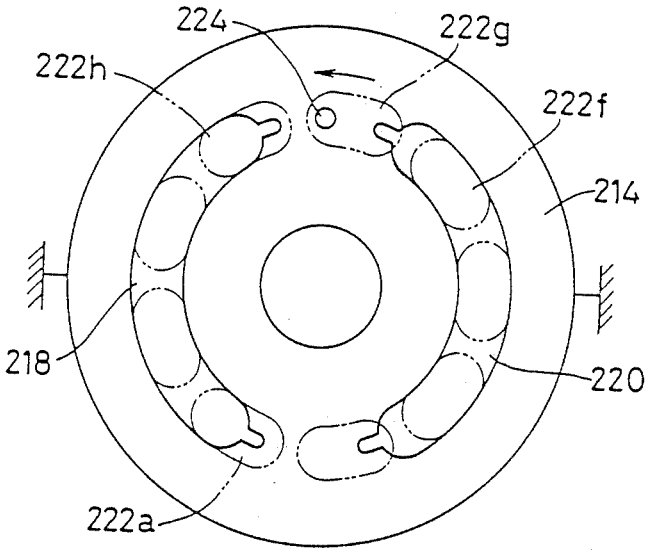

The motor-stop inlet port 224 (motor-stop fluid supply passage 227) is connected to the fluid passage 60 of a suitable motor-stop fluid supply circuit (to a circuit similar to that shown in FIG. 12, in this specific example). For the sake of explanation, it is assumed that the cylinder 202 is operated in the clockwise direction (in FIG. 25) with the fluid supplied through the A-port 218 and discharged through the B-port 220. The following description refers to an operation when the motor rotating in the clockwise direction is stopped. For example, if the motor is in a position shown in FIG. 26 when the fluid supply to the motor-stop inlet port 224 is initiated, the fluid flows from the inlet port 224 into the A-port 218 through the fluid-chamber port 222*g*, whereby the motor (cylinder 202) is further rotated in the clockwise direction. If the motor is rotated to a position shown in FIG. 27, the fluid flows into the B-port 220 through the fluid-chamber port 222*g*, and the motor is therefore reversed. Eventually, the motor is stopped at a position in which the fluid-chamber port 222*g* is located at an intermediate position between the A- and B-ports 218, 220. Stated differently, the motor is stabilized at a position in which the volume of the fluid chamber 208*g* is maximum. If the fluid-chamber port 222*g* overshoots the motor-stop inlet port 224 due to inertia, another fluid-chamber port such as the following fluid-chamber port 222*h* will communicates with the motor-stop inlet port 224, thereby providing a torque to stop the motor. Thus, the motor is stopped with the motor-stop inlet port 224 held in communication with one of the fluid-chamber ports 222*a*–222*i*. Accordingly, the motor has a total of nine stop or indexing positions corresponding to the fluid-chamber ports 222*a*–222*i*. The stop or indexing position to which the motor is actually stopped depends upon the timing at which the valves 114, 102 are activated for stopping the motor.

The motor-stop inlet port 224 may be replaced by a motor-stop outlet port 225 which is formed in the valve plate 214, at a position diametrically opposite to the inlet port 224, as indicated in two-dot chain line in FIG. 25. This outlet port 225 is connected to a suitable motor-stop fluid discharge circuit. In this case, the motor is stopped at a position corresponding to one of the fluid-chambers 208*a*–208whose volume is minimum (with the corresponding piston 204 placed at its top dead point). There are a total of nine stop positions as in the case using the inlet port 224, but these stop positions are offset from the stop positions provided by the inlet port 224, by a distance equal to a half of the angular or circumferential spacing of the fluid chambers 208*a*–208*i* in the circumferential direction of the cylinder 202. Therefore, if both the inlet port 224 and the outlet port 225 are provided for selective utilization, the motor has a total of 18 stop positions. For instance, the inlet and outlet ports 224, 225 may be connected to the shutoff valves 182, 184 of FIG. 23, respectively, independently of each other.

The motor-stop inlet port 224 and/or outlet port 225 may be formed in the rotary valve 34 (rotary valve member) of the radial piston motor of FIGS. 1 and 2, for connection to the appropriate circuits, so as to control the fluid flows into and from the motor for stopping the motor in the same manner as described above. In this case, the inlet port 224 and/or outlet port 225 is/are displaced relative to the stationary fluid-chamber ports.

Figure 28:
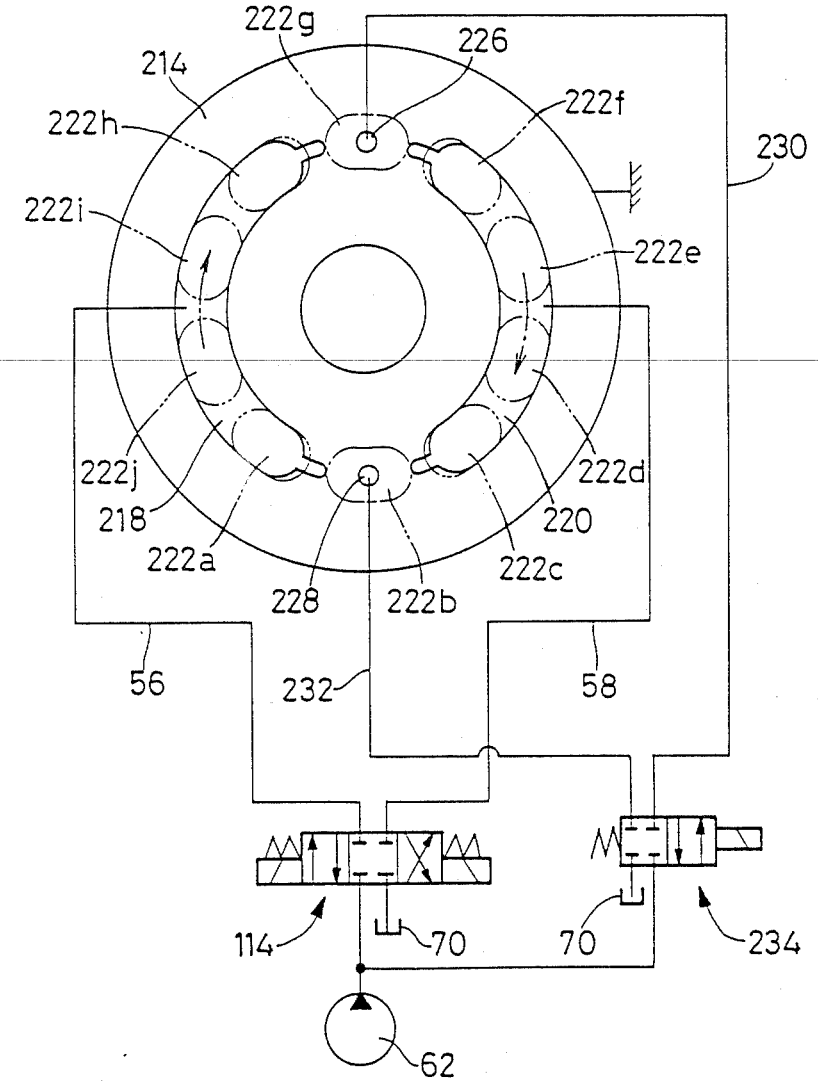
FIG. 28 is a schematic view showning one modification of the embodiment of FIG. 25, together with a hydraulic circuit.

Referring next to FIG. 28, there is illustrated a rotary-cylinder type piston motor having a motor-stop inlet port and a motor-stop outlet port which are used simultaneously.

In this embodiment, the motor has an even number of pistons 204 (ten pistons, in this example), and the corresponding ten fluid chambers 208*a*–208*j* and ten fluid-chamber ports 222*a*–222*j*. The valve plate 214 has a motor-stop inlet port 226 disposed between one end of the A-port 218 and the corresponding end of the B-port 220, and further has a motor-stop outlet port 228 disposed between the other end of the A-port 218 and the corresponding end of the B-port 220. Although these inlet and outlet ports 226, 228 are similar in structure to the ports 224, 225 shown in FIG. 25, different reference numerals are used to clarify their functional difference. The inlet and outlet ports 226, 228 are located symmetrically with each other, with respect to the center of the valve plate 214, so that the ports 226, 228 communicate simultaneously with any two of the fluid-chamber ports 222a–222j, that are spaced 180 degrees from each other, namely, any two diametrically opposite fluid-chambers.

The inlet port 226 is connected to the pump 62 by a fluid passage 230, while the outlet port 228 is connected to the reservoir 70 by a fluid passage 232. A shutoff vale 234 is provided as common shutoff means for opening and closing the fluid passages 230, 232. The A-port 218 and the B-port 220 are connected to the pump 62 and the reservoir 70, respectively, through the directional control valve 114. When the motor is commanded to stop, the valve 114 is operated to close the passages 56, 58, and the valve 234 is operated to its open position to open the passages 230, 232.

Figure 29:
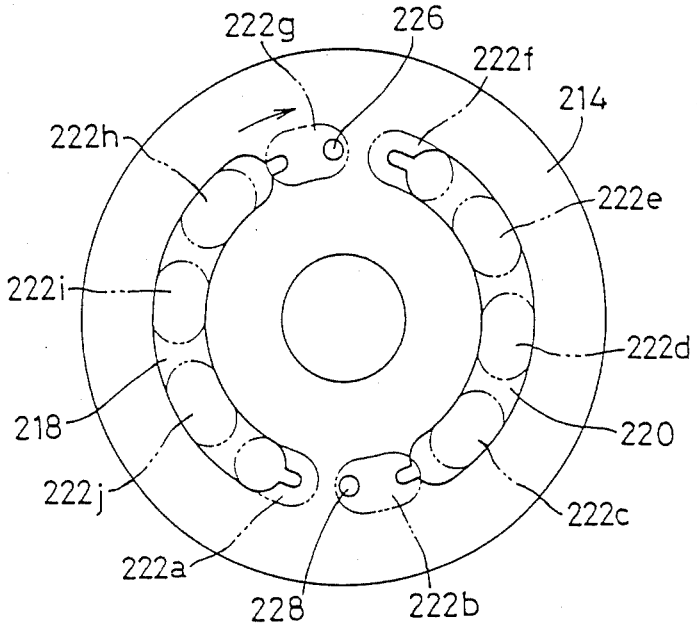
FIGS. 29 and 30 are views illustrating the operation of the arrangement of FIG. 28.
Figure 30:
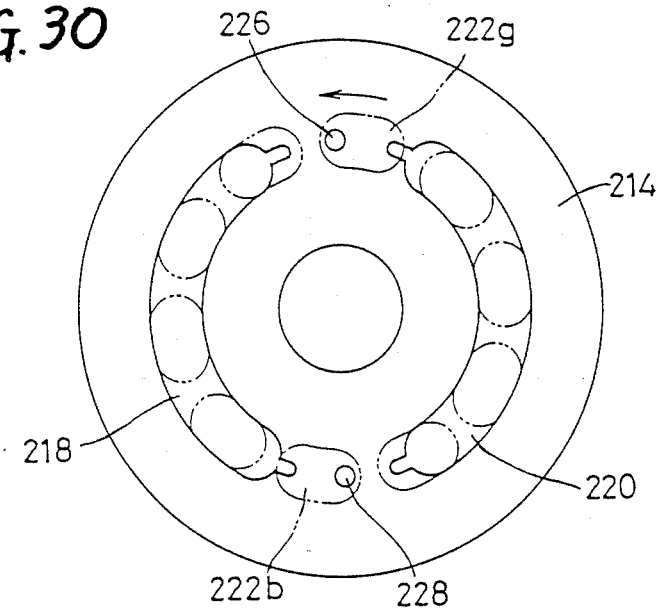

Suppose the motor is in a position as indicated in FIG. 29 when the motor is commanded to stop, the inlet and outlet ports 226, 228 communicate with the A-port 218 and the B-port 220 through the fluid-chamber ports 222g and 222b, respectively. Accordingly, the fluid flows into the A-port 218 through the inlet port 226, while the fluid flows from the B-port 220 through the outlet port 228. Described more specifically, the pressurized fluid is supplied to the advancing fluid-chamber ports 222g, h, i, j and a, while the fluid is discharged from the reversing fluid-chambers 222b, c, d, e and f. Consequently, the motor is further operated in the advancing direction. When the motor is in a position as indicated in FIG. 30, the inlet and outlet ports 226, 228 communicate with the B-port 220 and the A-port 218, respectively, and the the motor is operated in the reverse direction. Therefore, the motor is eventually stopped in equilibrium, at the position of FIG. 28 in which the volume of the fluid chamber 208g communicating with the port 222g is maximum while the volume of the fluid chamber 208b communicating with the port 222b is minimum. Since the equilibrium may occur for the other four pairs of the fluid-chamber ports 222a–j, there are five indexing positions at which the motor can be stopped.

When the fluid supply and discharge flows through the inlet and outlet ports 226, 228 occur simultaneously, the disconnection of the passages 56, 58, and the communication of the passage 232 with the reservoir 70, will cause fluid flows to and from the motor necessary to produce a motor stopping torque. Since this torque is created in substantially the same way as the torque produced for rotating the motor during a normal operation, the instant arrangement does not require restrictors as indicated at 76, 78 in FIG. 1. In other words, the present embodiment using no restrictors is advantageous in terms of fluid pressure loss, indexing speed, adaptability to an external load, etc., although the even number of the pistons may have an adverse influence on the motor performance.

Figure 31:
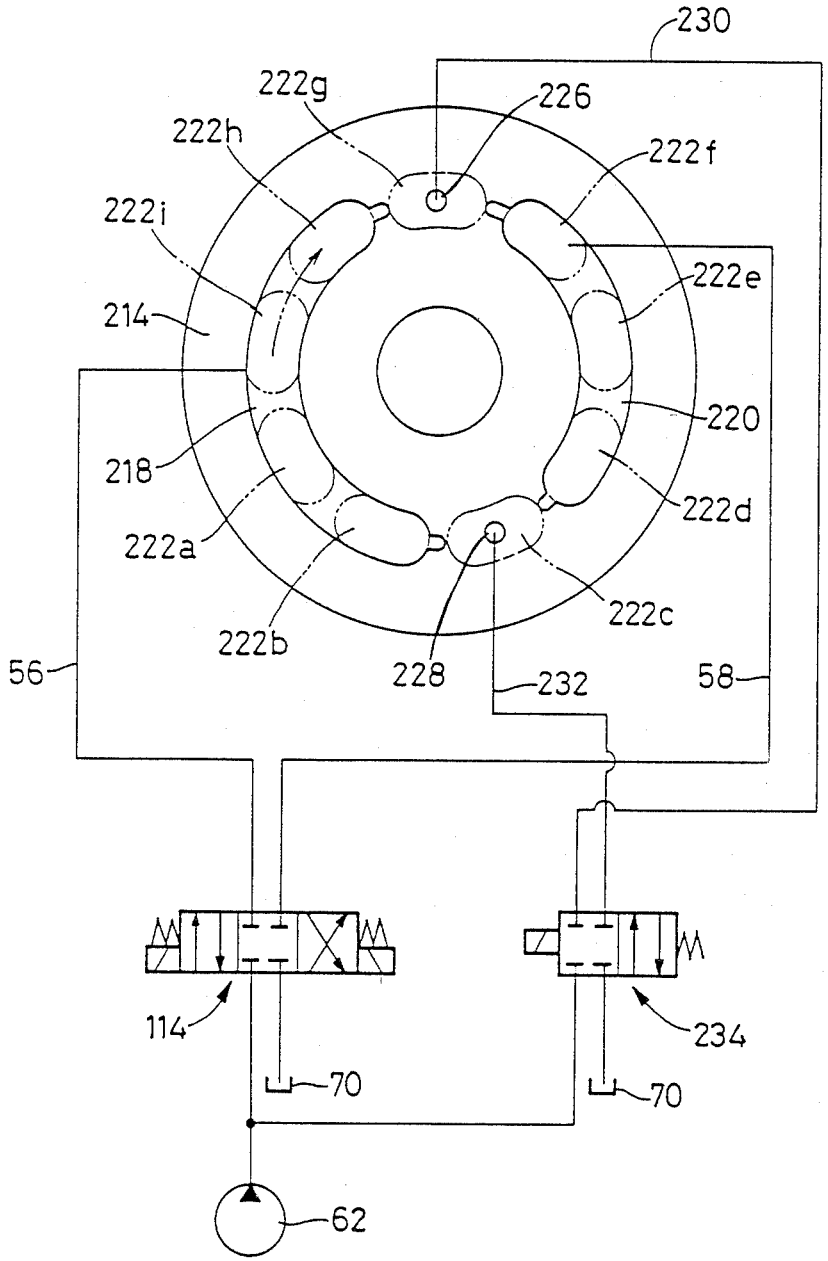
FIGS. 31, 32 and 33 are schematic views showing other modified arrangements of the embodiment of FIG. 28, together with hydraulic circuits for the respective arrangements.

FIG. 31 shows an embodiment wherein simultaneous fluid supply and discharge are effected for stopping a motor having an odd number of pistons 204 (nine pistons, in this case). The A-port 218 has a larger length than that formed in the valve plate 214 of FIG. 25, and the B-port 220 has an accordingly reduced length. In the equilibrium position indicated in FIG. 31, the A-port 218 communicates with four of the fluid-chamber ports 222a–222i, while the B-port 220 communicates with three of the other fluid-chambers. In this condition, the remaining two fluid-chamber ports are aligned with two areas between the corresponding ends of the A- and B-ports 218, 220. The motor-stop inlet port 226 is formed in one of these two areas, while the motor-stop outlet port 228 is formed in the other area. Thus, the inlet and outlet ports 226, 228 are not located opposite to each other diametrically of the valve plate 214. Namely, if one of the ports 226, 228 is formed at one of two diametrically opposite positions on the valve plate 214, the other port is formed at a position whcih is spaced away from the other of the two positions by a distance equal to a half of the angular spacing of the fluid-chamber ports 222a–222i.

Suppose the fluid-chamber port 222g has not reached the position shown in the figure in the clockwise operating direction of the motor, allowing communication between the inlet port 226 and the A-port 218, while the fluid-chamber port 222c allows communication between the outlet port 228 and the B-port 220. In this condition, the pressurized fluid flows to the five fluid-chamber ports, i.e., 222g, 222h, 222i, 222a and 222b, producing a torque to further advance the motor in the clockwise direction. Conversely, if the fluid-chamber port 222g has moved past the position shown, the inlet port 226 communicates with the B-port 220 while the outlet port 228 communicates with the A-port 218. In this condition, the fluid flows to the four fluid-chamber ports 222g, 222f, 222e and 222d, thereby creating a torque to reverse the motor. The fluid chamber 208c communicating with the fluid-chamber port 222c does not contribute to the reversing torque.

Figure 32:
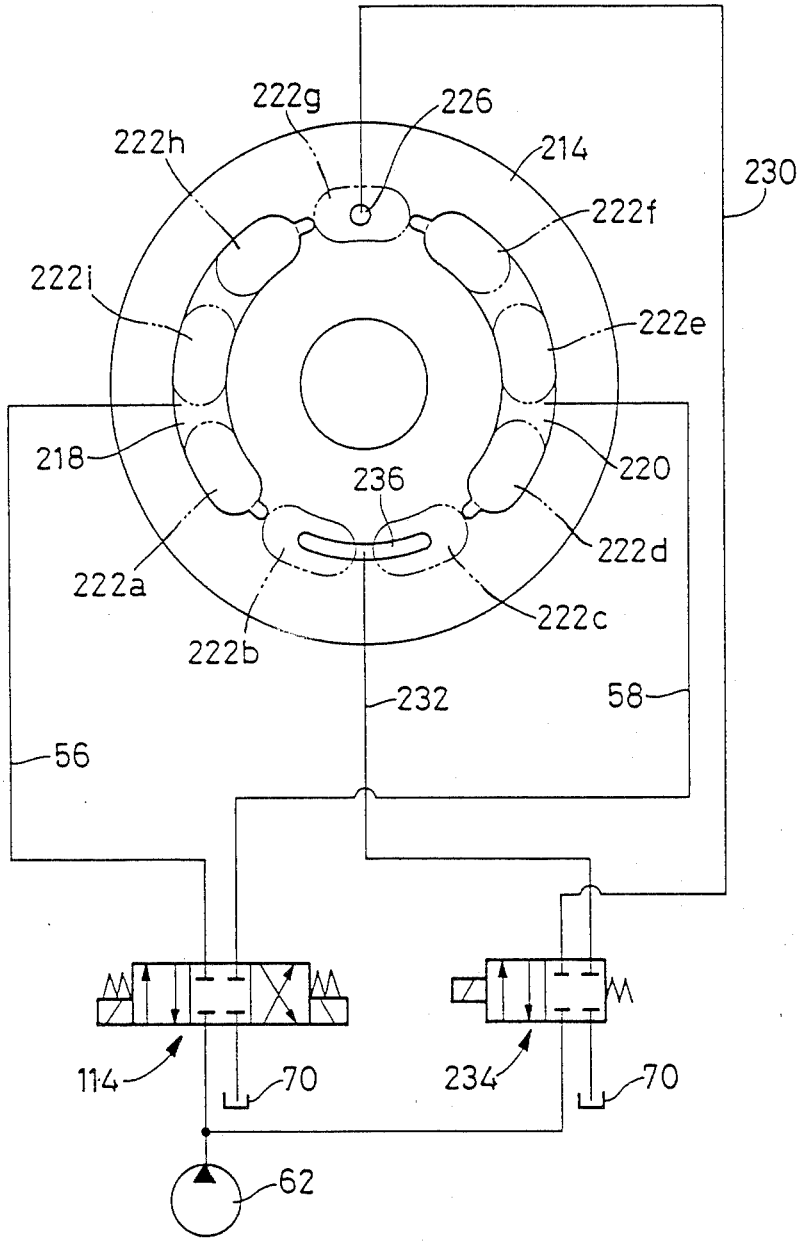

In a further modified embodiment shown in FIG. 32, the A-port 218 and the B-port 220 are formed so as to be shorter than those of the embodiment of FIG. 25, by a length equal to a half of the angular or circumferential spacing of the fluid-chamber ports 222a–i, such that a longer circumferential distance is provided between one end of the A-port 218 remote from the inlet port 226, and the corresponding end of the B-port 220. Along this longer circumferential distance is formed an elongate arcuate motor-stop outlet port 236. This outlet port 236 is symmetrical with respect to a straight line which passes the center of the inlet port 226 and the center of the valve plate 214. The circumferential length of the outlet port 236 is determined so as to concurrently communicate with the adjacent two members of the fluid-chamber ports 222a–i. In this embodiment, the pistons 204 in the fluid chambers communicating with the motor-stop outlet port 236 through the adjacent two fluid-chamber ports 222 will not produce a torque for driving the motor.

Figure 33:
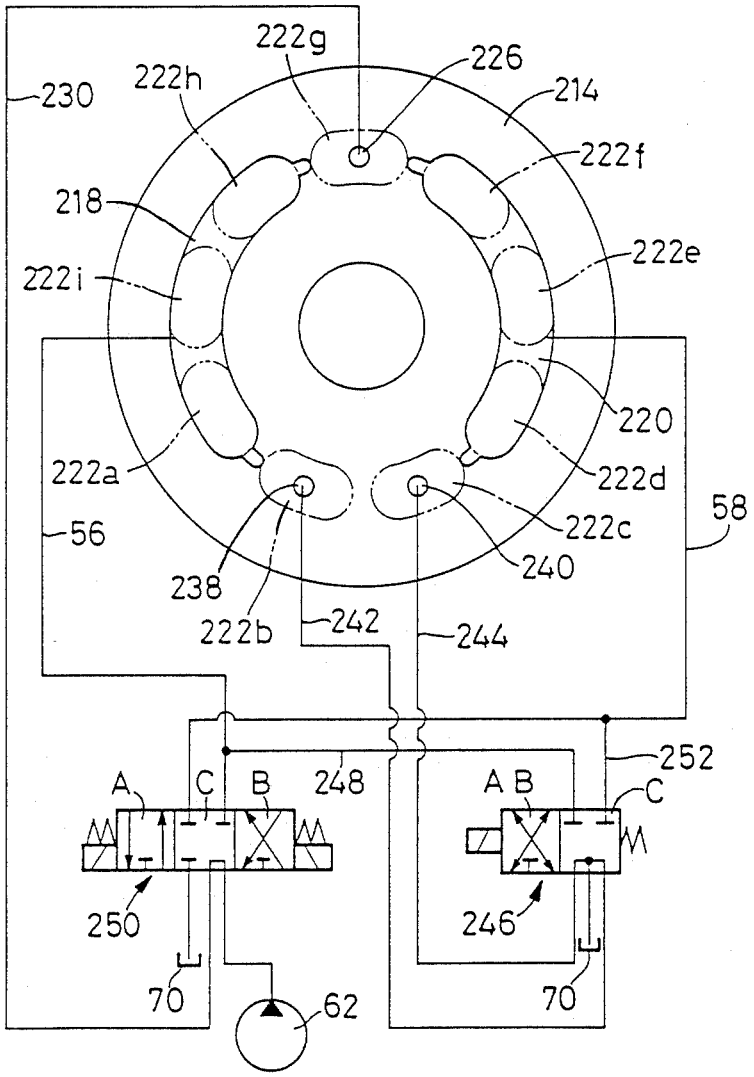

In a still further modified embodiment shown in FIG. 33, the A-port 218 and the B-port 220 have a shorter length as in the preceding embodiment of FIG. 32. However, the present embodiment is different from the preceding embodiment in that two outlet ports 238, 240 are formed in place of the elongate output port 236 of FIG. 32, at two respective positions corresponding to the opposite ends of the outlet port 236. These outlet ports 238, 240 are adapted so that each port 238, 240 is not able to concurrently communicate with the adjacent two members of the fluid-chamber ports 222a–i. The outlet ports 238, 240 are connected to the reservoir 70 through a shutoff valve 246. The shutoff valve 246 is connected to a directional control valve 250 by a passage 248 and a part of the passage 56, so that the outlet port 238 can communicate with the pump 62 or the reservoir 70 via the valves 246, 250. Similarly, the shutoff valve 246 is connected to the control valve 250 by a passage 252 and a part of the passage 58, so that the outlet port 240 can communicate with the pump 62 or the reservoir 70 via the valves 246, 250.

In a normal operation of the motor, the control valve 250 is placed in its position A or B, while the shutoff valve 246 is placed in its position AB, as indicated in the figure. When the motor is commanded to stop, both of the valves 246, 250 are switched to their position C. As a result, the motor-stop inlet port 226 is brought into communication with the pump 62, while the motor-stop outlet ports 238, 240 are brought into communication with the reservoir 70. In this motor stopping position C, the pressures in the fluid-chamber ports 222 communicating with the outlet ports 238, 240 are lowered, and do not enable the corresponding pistons to produce a torque.

During a normal operation of the motor, however, the outlet ports 238, 240 perform the same functions as the A-port 218 and the B-port 220, respectively. For example, if the motor is operated with the control valve 250 placed in its position A, the pressurized fluid from the pump 62 is supplied to the A-port 218 through the passage 56, while the fluid is discharged from the B-port 240 to the reservoir 70 through the passage 58. Further, the fluid from the pump 62 is supplied to the outlet port 238 through the passage 248, valve 246, and passage 242, while the fluid is discharged from the outlet port 240 to the reservoir 70 through the passage 244, valve 246, passage 252, and valve 250. In the normal operation, therefore, the selective communication of the fluid-chamber ports 222 with the outlet ports 238, 240 will cause a rotating torque. Thus, a feature of this embodiment lies in that during a normal operation of the motor, the outlet ports 238, 240 are not closed, but are positively utilized as parts of the A- and B-ports 238, 240.

The motor-stop inlet and outlet ports for concurrent fluid supply and discharge to and from the motor, as discussed above, may be applied to a fixed-cylinder type piston motor as shown in FIG. 1. In this case, the inlet and outlet ports are formed in a rotary valve member such as the rotary valve 34 (pintle) or rotary valve plate, contrary to the preceding embodiments wherein the inlet and outlet ports are formed in the stationary valve plate 214. Further, if the valve plate 214 is applied to a fixed-cylinder type piston motor, the concept of concurrent fluid supply and discharge through the motor-stop inlet and outlet ports may be embodied to provide the motor with a single stop or indexing position.

In a rotary-cylinder type piston motor as illustrated in FIG. 24, it is easier to form motor-stop ports in the stationary valve plate 214, as exemplified in all of the preceding embodiments associated with the rotary-cylinder type piston motor. Nevertheless, the motor-stop ports may be formed so as to communicate with a fluid chamber in the rotary cylinder 202. In this instance, the motor has a single stop or indexing position, as in the embodiment of FIG. 1.

Figure 34:
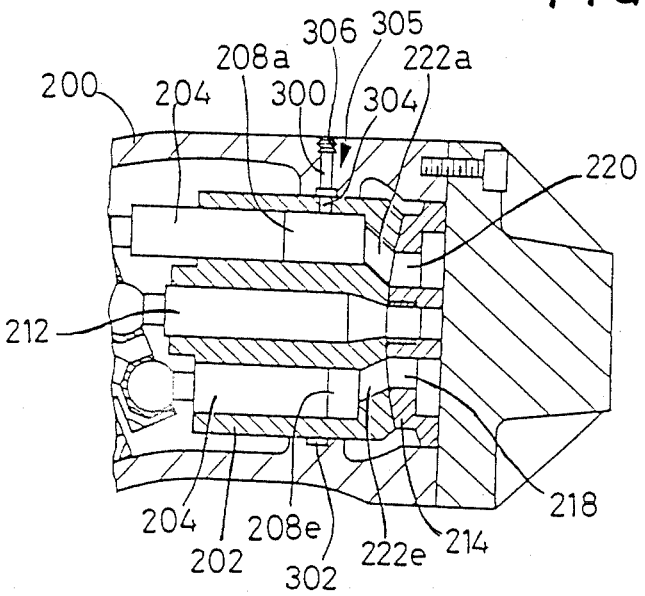
FIGS. 34 and 35 are fragmentary cross sectional views of modified forms of the motor of FIG. 24.

An example of such a modified arrangement is illustrated in FIG. 34, wherein a first hole 300 is formed through the casing 200 (through a small-diameter portion of the casing 200 whose inner surface is held in sliding contact with the outer surface of the cylinder 202), such that the first hole 300 opens at its one end in the outer surface of the casing 200, and communicates at its other end with an annular groove 302 formed in the inner surface of the casing 200. Further, the cylinder 202 has a second hole 304 which communicates at its one end with the fluid chamber 208*a*, for example, and at its other end with the annular groove 302. Thus, there is provided a motor-stop fluid passage 305 which opens in the outer surface of the casing 200 and communicates with the fluid chamber 208*a*. The first hole 300 is held in communication with the fluid chamber 208*a*, irrespective of a rotating motion of the rotary cylinder 202. The outer end of the first hole 300 is used as a connection port 306, and the second end is adapted to selectively communicate with the A-port 218 or the B-port 220 through the second hole 304, fluid chamber 208*a* and fluid-chamber port 222*a*. Where this motor-stop fluid passage 305 is used as a fluid inlet port, the motor is stopped at a position in which the volume of the fluid chamber 208*a* is maximum. Where the passage 305 is used as fluid outlet port, the motor is stopped at a position in which the volume of the fluid chamber 208*a* is minimum. Thus, the motor is given a single stop position. The instant arrangement may be modified so as to provide the motor with multiple indexing positions (as shown in FIG. 8) or two indexing positions (as shown in FIG. 23), as described in connection with the fixed-cylinder type.

Figure 35:
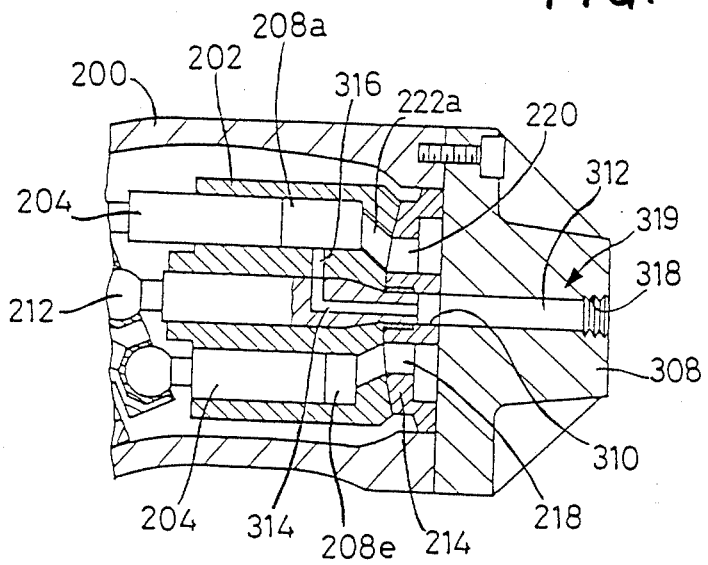

In a further modified example shown in FIG. 35, a first hole 312 is formed through a valve casing 308 which forms a part of the casing 200. The first hole 312 opens at its one end in the outer surface of the valve casing 308, and at its other end communicates with a center hole 310 formed in the valve plate 214. Further, a second hole 314 is formed in the cylinder shaft 212, and a third hole 316 is formed through the cylinder 202 so as to communicate at its one end with the fluid chamber 208*a*, and at its other end with the second hole 314. The outer end of the first hole 312 serves as a connection port 318. Thus, there is provided a motor-stop fluid passage 319 for communication between the connection port 318 and the fluid-chamber port 222*a*, through the first hole 312, center hole 310, second hole 314, third hole 316 and fluid chamber 208*a*. In the present arrangement, the cylinder 202 and the shaft 212 are fixed to each other and are simultaneously rotated.

There will be next described embodiments of a gear motor arrangement constructed according to the present invention.

Figure 36:
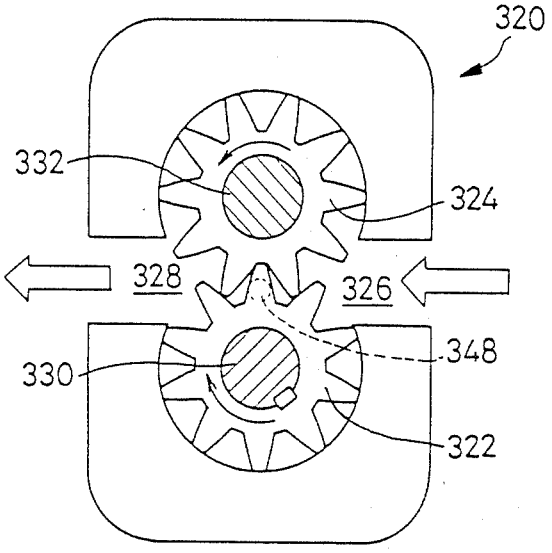
FIG. 36 is a schematic fron elevational view showing one embodiment of an external-mesh gear motor of the invention.
Figure 37:
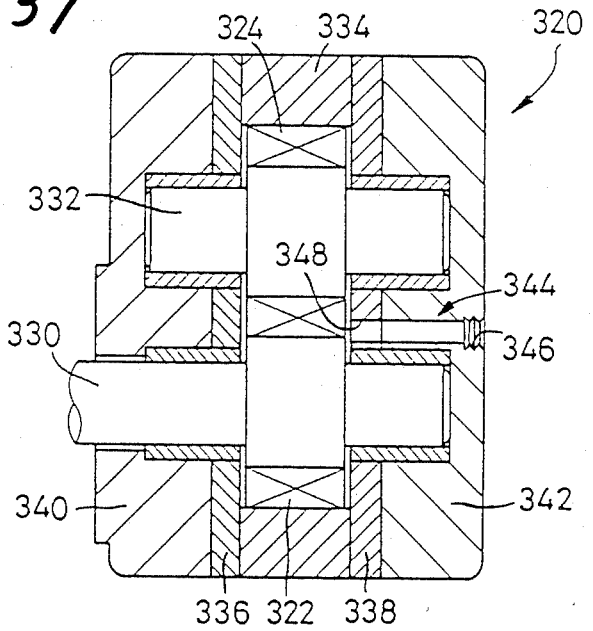
FIG. 37 is a cross sectional view of the gear motor of FIG. 36.

Referring to FIGS. 36 and 37, there is shown one form of an external-mesh gear motor. As well known in the art, this gear motor has a gear 322 and a gear 324 which are disposed within a casing 320 such that the two gears mesh with each other. The gears 322, 324 are rotated as indicated by arrows in FIG. 36, by a flow of a fluid into an inlet chamber 326 and a discharge flow of the fluid out of an outlet chamber. If the direction of the fluid flow through the motor is reversed, the rotating directions of the gears 322, 324 are reversed. The gear 322 is fixed on an output shaft 330, while the gear 324 is adapted to be rotated on a gear shaft 332 about its axis.

The casing 320 includes a main body 334 accommodating the gears 322, 324, a pair of side plates 336, 338 disposed on the opposite sides of the main body 334, and front and rear coverings 340, 342 disposed such that the main body 334 and the side plates 336, 338 are sandwiched by the coverings 340, 342, so as to provide a fluid-tight casing structure. A motor-stop fluid supply passage 344 is formed through the rear covering 344 and side plate 338 on one side of the casing 320. The outer end of this passage 344 serves as a connection port 346 connected to a hydraulic circuit (which will be described), while the inner end serves as a motor-stop inlet port 348 which opens in the inner surface of the side plate 338.

Figure 38:
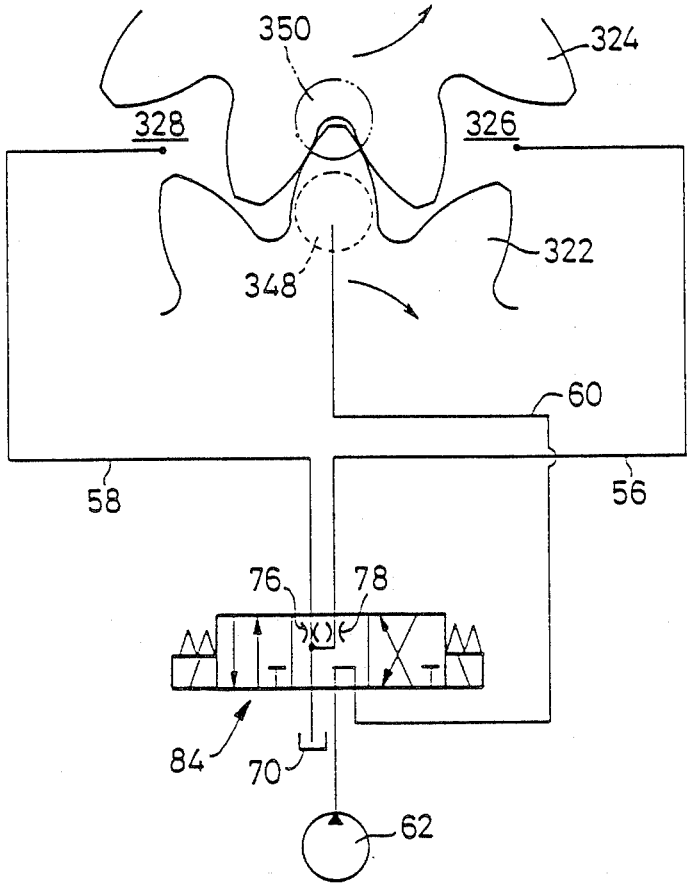
FIG. 38 is a diagrammatic view showing one form of a hydraulic circuit for the gear motor of FIG. 36.

As indicated in FIG. 38, the motor-stop inlet port 348 is located in alignment with meshing teeth of the gears 322, 324, that is, at a boundary bewteen the inlet and outlet chambers 326, 328. The inlet port 348 is located and dimensioned so that the port 348 is closable by the end face of each tooth of the gear 322. The inlet port 348 (passage 344) is connected to the motor-stop fluid supply circuit as previously described (circuit shown in FIG. 9), so that the inlet port 348 is supplied with the pressurized fluid from the pump 62.

Figure 39:
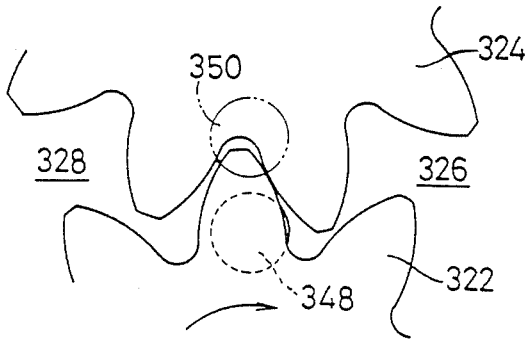
FIGS. 39 and 40 are views illustrating the operation of the gear motor of FIG. 38.
Figure 40:
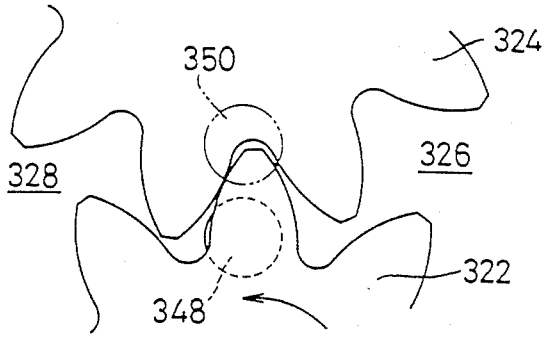

When the inlet port 348 is in communication with the inlet chamber 326 as shown in FIG. 39, the fluid flows from the inlet port 348 into the inlet chamber 326, causing the gears 322, 324 to be rotated in the motor-advancing direction. When the inlet port 348 is in communiction with the outlet chamber 328 as shown in FIG. 40, the fluid flows into the outlet chamber 328, causing the gears 322, 324 to be rotated in the motor-reversing direction. Thus, the motor is eventually stopped in equilibrium, at a position as shown in FIG. 38. Thus, the motor has stop positions whose number is equal to that of the teeth of the gear 322, i.e., ten stop positions corresponding to the ten teeth, in this specific example. The motor is stopped at one of these stop positions, depending upon the timing at which the control valve 84 is activated to stop the motor.

In the arrangement of FIG. 38, the inlet port 348 may be replaced by a motor-stop outlet port 350 as illustrated in two-dot chain line in the same figure. In this case, the outlet port 350 is connected to a suitable motor-stop fluid discharge circuit. The outlet port 350 is located at the boundary of the inlet and outlet chambers 326, 328, so that the port 350 may communicate with a gap formed between the top land of each tooth of the gear 322, and the bottom land of the adjacent teeth of the gear 324. In the condition of FIG. 39, the fluid is discharged from the outlet chamber 328 through the outlet port 350, causing the gears 322, 324 to be rotated in the advancing direction. In the condition of FIG. 40, the fluid is discharged from the inlet chamber 326, causing the gears 322, 324 to be rotated in the reversing direction. Thus, the motor is eventually stopped at the position of FIG. 38.

Figure 41:
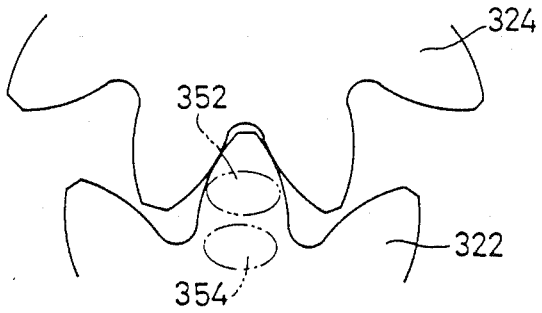
FIG. 41 is a fragmentary front elevational view of one modification of the arrangement of FIG. 38.

If the inlet and outlet ports 348, 350 are both provided, the fluid supply and discharge through these ports are effected concurrently for stopping the motor. In the condition of FIG. 39, the fluid is supplied to the inlet chamber 326 while at the same time the fluid is discharged from the outlet chamber 328. In the condition of FIG. 40, the directions of the fluid supply and discharge are reversed. It is possible to form inlet and outlet ports 352, 354 as shown in FIG. 41, so that the inlet port 352 is closable by the end face of each tooth of the gear 322 while the outlet port 354 is able to communicate with the bottom land of the teeth of the gear 322. If these two ports 352, 354 are selectively used for supplying or discharging the fluid to or from the motor, there are provided ten stop positions for each of the inlet and out ports 352, 354, namely, a total of twenty stop positions, since the stop positions provided by the inlet port 352 are offset from those provided by the outlet port 354, by a distance equal to a half of the indexing increment of the gear 322 (angular spacing of the gear teeth).

While the motor-stop fluid passage 344 used in the above examples is formed such that the passage 344 opens in the inner surface of the side plate 338 only, it is possible that the passage 344 opens in the inner surfaces of the two side plates 336, 338 so that the openings are provided on the opposite end faces of the gear 322, for example. This arrangement permits even loads acting on the motor in the opposite axial directions, and is therefore advantageous for smooth operation of the motor.

Figure 42:
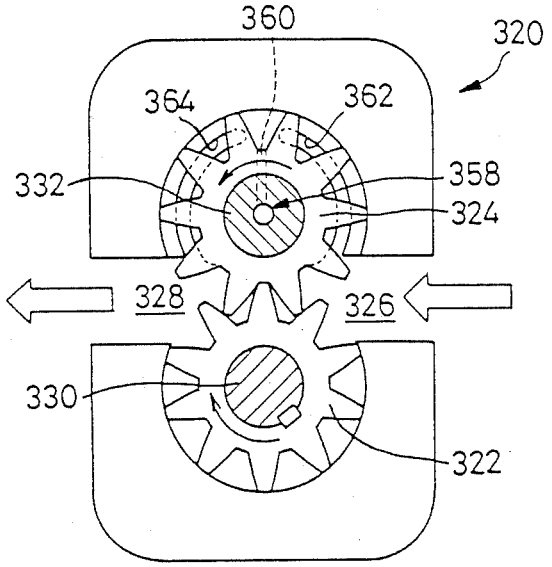
FIG. 42 is a schematic front elevational view of one modified arrangement of the gear motor of FIG. 36.
Figure 43:
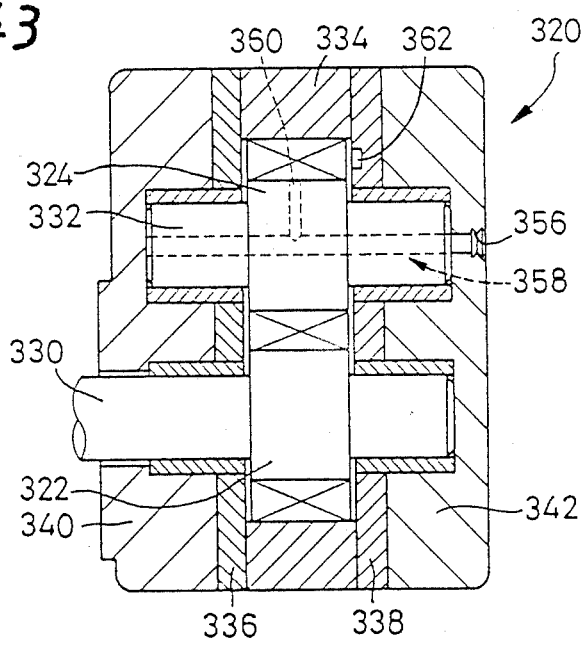
FIG. 43 is a cross sectional view of the gear motor of FIG. 42.

Referring to FIGS. 42 and 43, there is shown a modified embodiment wherein a motor-stop fluid supply passage 358 is formed in the rotating member of the gear motor. Described more particularly, the rear covering 342 has a connection port 356 open in its outer surface. The fluid supply passage 358, which originates from the connection port 356, is formed through the gear shaft 332 and through the gear 324. The inner end of the passage 358 remote from the connection port 356 serves as an inlet port 360 which opens in the bottom land of the gear 324. A pair of arcuate oil grooves 362 and 364 are formed in the inner surface of the side plate 338, in the circumferential direction of the gear 324, for example, along the pitch circle, as indicated in FIG. 42. The oil groove 362 is held in communication with the inlet chamber 326, while the oil groove 364 is held in communiction with the outlet chamber 328. The corresponding ends of these two oil grooves 362, 364 face each other, with a circumference spacing therebetween corresponding to a distance between the facing flanks of the adjacent teeth of the gear 324.

According to the above arrangement, the fluid flows into the inlet chamber 326 when the motor is in a position in which the inlet port 360 communicates with the oil groove 362. On the other hand, the fluid flows into the outlet chamber 328 when the motor is in a position in which the inlet port 360 communicates with the oil groove 364. Consequently, the gears 322, 324 are rotated in the advancing or reversing direction, and the motor is eventually stopped in equilibrium, at a predetermined stop position of FIG. 42. A plurality of stop positions may be provided if a corresponding number of mutually independent passages 358 (connected to respective inlet ports 360) are provided. In this case, the fluid is supplied selectively to one of the inlet ports 360 through the corresponding one of the passages 358. Further, if the port 360 is used as a motor-stop outlet port for discharging the fluid through that port, the motor is stopped at a position in which the port 360 communicates with a gap or space formed between the meshing teeth of the gears 322, 324, that is, at a position 180 degrees spaced from the stop position provided by the port 360 when used as the inlet port. Further, a motor-stop outlet port may be formed such that the port opens in one of opposite end faces of one tooth of the gear 324.

Figure 44:
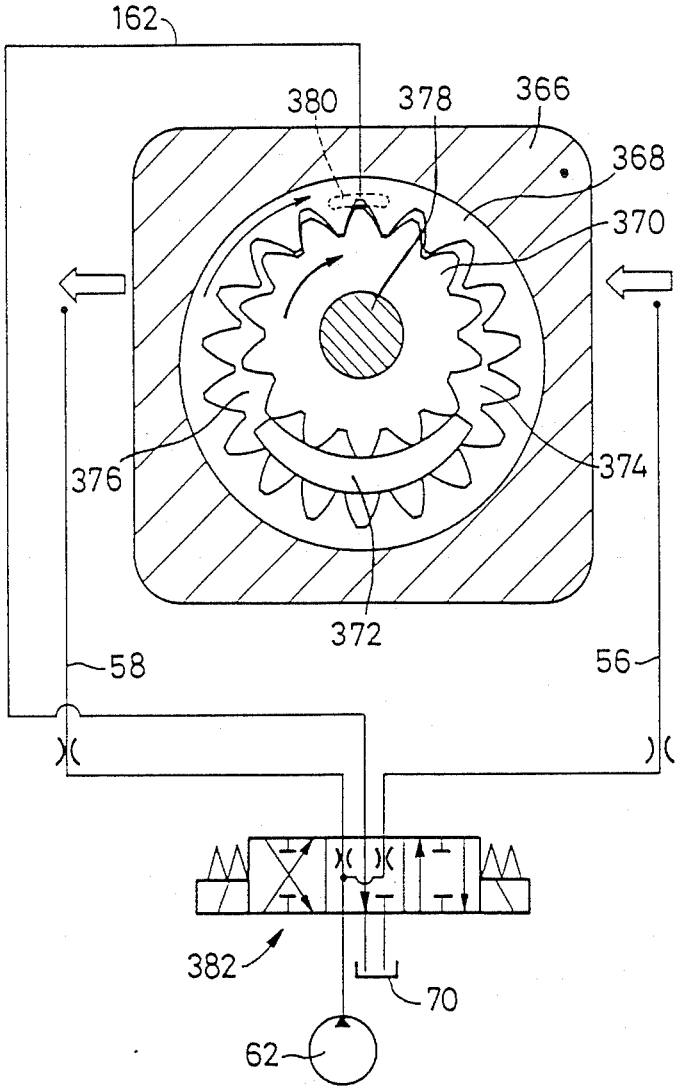
FIG. 44 is a schematic view showing one embodiment of an internal-mesh gear motor of the invention, together with a hydraulic circuit.

Referring to FIG. 44, there is shown an example of an internal-mesh gear motor, wherein an internally toothed gear 368 internally meshes with a pinion 370, within a casing 366. A sealing piece 372 is disposed between the gear 368 and the pinion 370, such that the piece 372 cooperates with the gear and pinion to fluid-tightly define an inlet chamber 374 and an outlet chamber 376. With the fluid supplied and discharged to and from these chambers 374, 376, the gear 368 and the pinion 370 are rotated as indicated by arrows in the figure, and an output of the motor is obtained from an output shaft 378. The side wall (side plate) of the casing 366 has a motor-stop outlet port 380 which opens at the engaging portion of the gear and pinion 368, 370. More specifically, the outlet port 380 is adapted to communicate with a gap or space formed between the bottom land of the gear 368 and the top land of the mating tooth of the pinion 370. The outlet port 380 is connected to a motor-stop fluid discharge circuit which incorporates a directional control valve 382, as shown in FIG. 44. The fluid is discharged from one of the inlet and outlet chambers 374, 376 which communicates with the motor-stop outlet port 380. Thus, the motor can be stopped at one of stop positions whose number is equal to the number of the teeth of the internally toothed gear 368.

Figure 45:
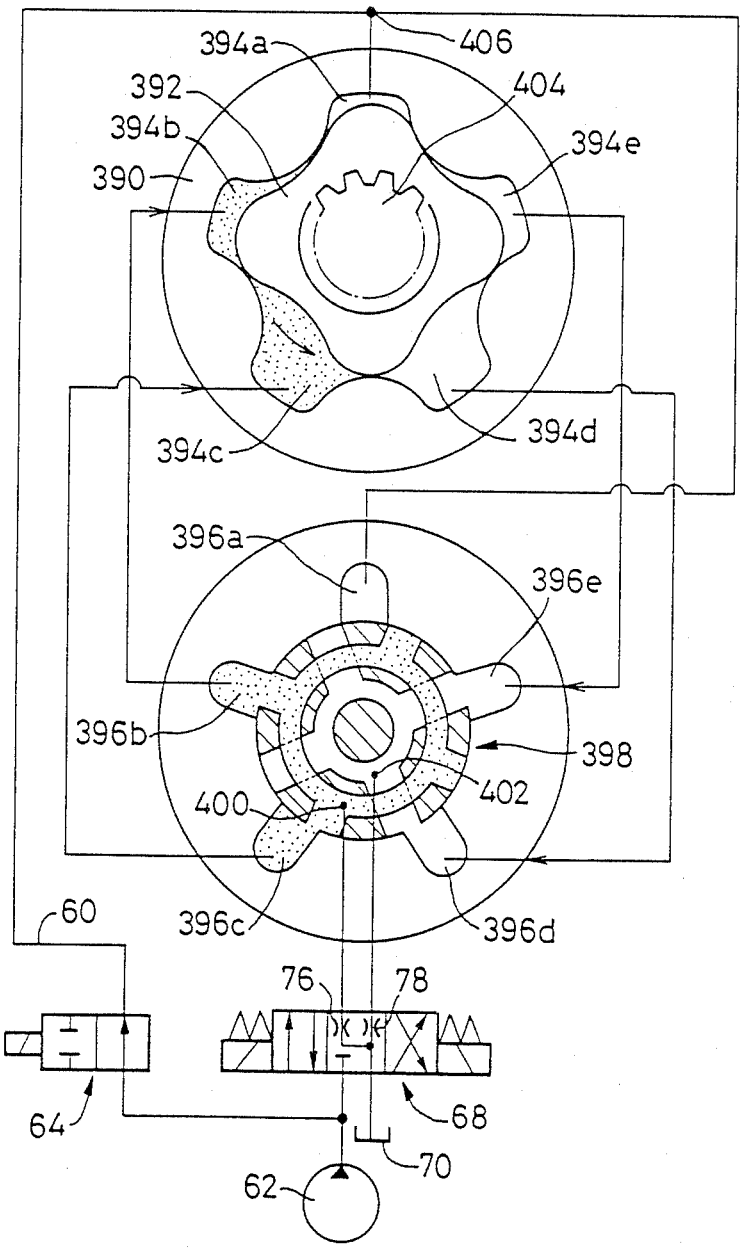
FIG. 45 is a schematic view showing one embodiment of a trochoid motor of the invention, together with a hydraulic circuit.

FIG. 45 shows an embodiment of a trochoid motor of the present invention.

The trochoid motor, also called "Gerotor motor" or "orbit motor", has a pair of trochoid gears, that is, a stator (ring) 390 and a rotor (star) 392. The stator and rotor 390, 392 have a profile generated following a trochoid or similar curve. In the present example, the rotor 392 having four teeth is eccentrically disposed in the stator having five teeth, so as to define five variable-volume fluid chambers 394*a–e* therebetween. The motor has five fluid-chamber ports 396*a–e* corresponding to the fluid chambers 394*a–e*. A rotary valve 398 is provided to effect selective fluid communication of the fluid chambers 394*a–e* with A- and B-ports 400, 402, through the fluid-chamber ports 396*a–e*, in order to produce a torque for rotating the rotor 392. If the fluid is supplied to the fluid chambers 394*b* and 394*c* and discharged from the fluid chambers 394*d* and 394*e*, in the condition shown in the figure, the rotor 398 is rotated in the counterclockwise direction (in the figure) substantially about the fluid chamber 394*a*. The rotor 392 is rotated about its axis by an angle corresponding to a difference between the numbers of teeth of the rotor and stator 392, 390, that is, 90 degrees corresponding to one tooth of the rotor 392, in one cycle of fluid supply and discharge flows to and from each of the four fluid chambers 394*a–e* (which may be considered to cause one orbital motion of the rotor). Four cycles of the above operation results in one full rotation of the rotor 392. This output of the rotor is obtained from an output shaft 404.

A connection port 406 is formed in the stator 390, so that the port 406 is open in the outer surface of the stator 390. This connection port 406 is connected to the fluid chamber 394*a*, for example. For stopping the motor, there is formed a motor-stop fluid passage whose first and second ends are defined by the connection port 406 and the fluid-chamber ports 496*a*, respectively. In the illustrated arrangement, the connection port 406 is connected to the same circuit as shown in FIG. 1, and therefore the motor-stop fluid passage is used as a motor-stop fluid supply passage.

If the control valve 68 is operated to its motor-stop position while the motor is in a position shown in FIG. 46, for example, the fluid is supplied to the fluid chambers 394*d* and 394*e* through the rotary valve 398, as well as to the fluid chamber 394*a*, whereby the rotor 392 is further rotated in the advancing direction. If the valve 68 is operated to the motor-stop position while the motor is in a position of FIG. 47, the fluid flows into the fluid chambers 394*a*, 394*b* and 394*c*, whereby the motor is rotated in the reverse direction. Eventually, the motor is stopped in equilibrium at a position in which the volume of the fluid chamber 394*a* is maximum, as shown in FIG. 48. In the figure, portion A of the rotor 392 defines the fluid chamber 394*a* whose volume is maximum. Since this condition occurs for the other three similar portions B, C and D of the rotor 392, the rotor has four stop positions. The rotor 392 is stopped at one of these four positions, depending upon the timing when the valves 64 and 68 are activated for stopping the motor. For example, a suitable signal to operate the valves 64, 68 is generated from a timer, or a limit switch or other suitable detectors. If the timer is used, one of four angular phases of the rotor corresponding to a desired one of the four stop positions is detected by measuring a time necessary for the rotor to establish the appropriate angular phase. If the limit switch is used, the angular phases are directly detected.

In the case where the connection port 406 is provided for all of the five fluid chambers 394*a–e*, there are provided a total of 20 stop positions, which is five times as many as that where only one connection port is provided. If the motor-stop port 406 is also used as an outlet port for discharging the fluid for stopping the motor, the stop positions are offset by a half of the indexing increment of the rotor. Therefore, where the connection port 406 is used selectively as a motor-stop inlet or outlet port, there are available a total of 40 stop positions.

Figure 49:
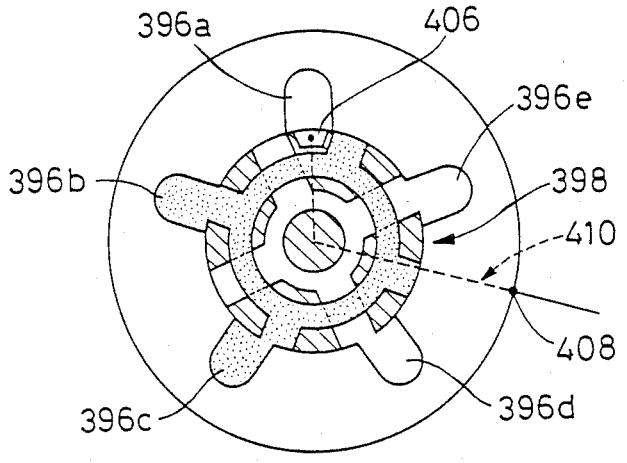
FIG. 49 is a view showing a modification of the embodiment of FIG. 45.

There is illustrated in FIG. 49 a modified embodiment wherein the motor-stop port 406 is open in the outer surface of the rotary valve 398, for selective communication with the fluid-chamber ports 396*a–e*. The motor-stop port 406 is connected to a connection port 408 by a motor-stop fluid passage 410. In this arrangement, five stop positions corresponding to the five fluid-chamber ports 396*a–e* are available for each of the two cases where the port 406 is used as an inlet port and an outlet port. Thus, the motor can be stopped at one of ten positions.

Figure 50:
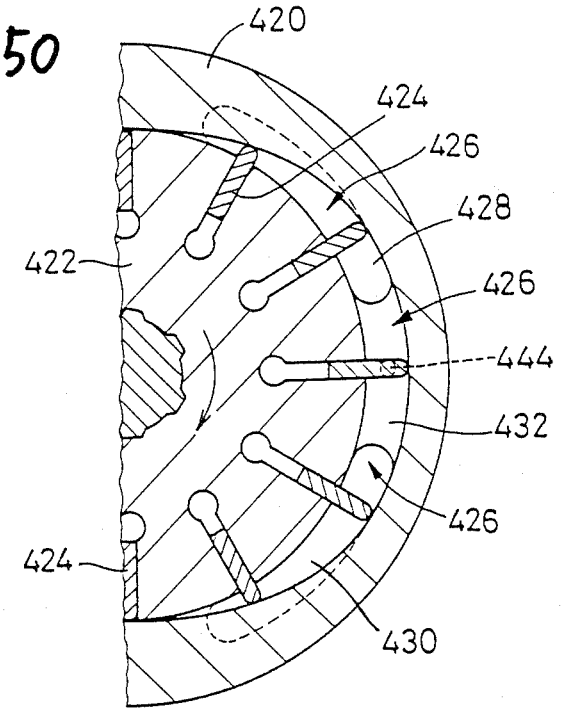
FIG. 50 is a fragmentary cross sectional view of one embodiment of a cam-ring type vane motor of the invention.

Referring to FIG. 50, there is shown an embodiment of a vane motor of the present invention.

The figure shows a half of the vane motor of a balanced type, wherein a cylindrical rotor 422 is disposed in a cam ring 420. The rotor 422 supports a plurality of vanes 424 such that the vanes are movable in substantially radial directions of the rotor. The vanes 424 are biased by springs (not shown) so that their outer ends are held in pressed contact with the inner surface of the cam ring 420, whereby a space formed in the cam ring 420 is divided by the vanes 424 into a plurality of variable-volume fluid chambers 426. The rotor 422 is rotated by a torque which is produced as a result of fluid flows into and from the fluid chambers 426 through an A-port 428 and a B-port 430, respectively.

These ports 428 and 430 are formed in a side plate 432 closing one of the opposite open ends of the cam ring 420. This side plate 432 further has a motor-stop port 444 open its inner surface, at a portion between the adjacent ends of the A- and B-ports 428, 430. The motor-stop port 44 is dimensioned so that it is closable by the side face of each vane 424.

Figure 51:
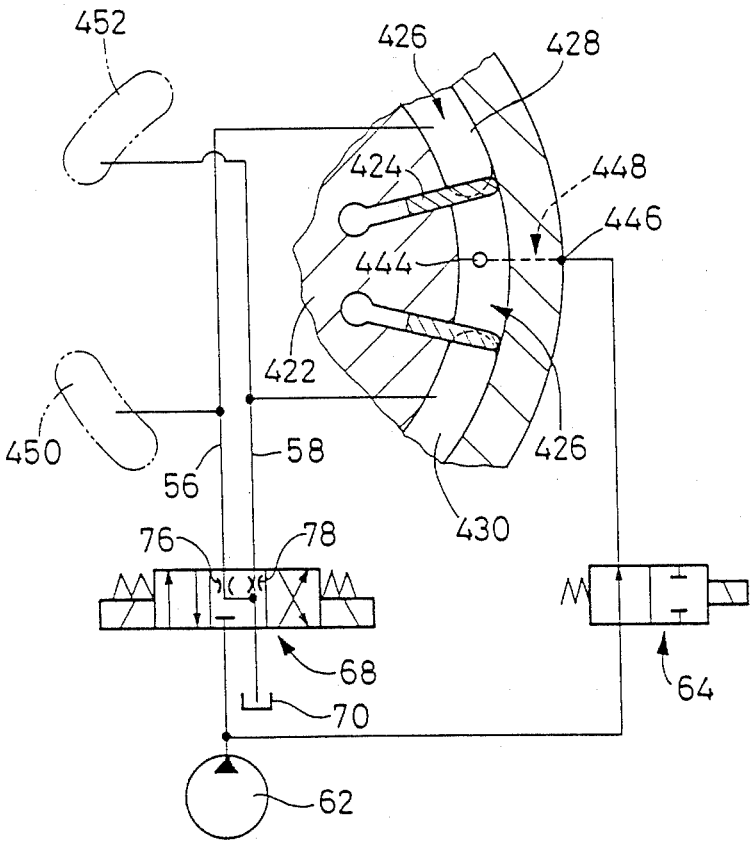
FIG. 51 is a diagrammatic view showing the vane motor of FIG. 50 in connection with a hydraulic circuit.

As schematically illustrated in FIG. 51, the motor-stop port 444 communicates with a connection port 446 through a motor-stop fluid passage 448. In other words, the ports 444 and 446 constitute the opposite ends of the passage 448. In the figure, the connection port is connected to the hydraulic circuit for supplying the fluid through the motor-stop fluid passage 448 into the motor-stop port 444. Thus, the port 444 acts as a motor-stop inlet port in this example. The motor has another pair of A- and B-ports 450, 452, at positions symmetrical with the positions of the ports 428, 430, with respect to the center of the rotor 422. The ports 428 and 450 communicate with each other, and the ports 430 and 452 communicate with each other.

If the fluid supplied into one of the fluid chambers 426 through the motor-stop port 444 flows into the A-port 428, the fluid also flows into the A-port 450. As a result, the fluid is supplied to the advancing fluid chambers 426, causing the rotor 422 to be further rotated in the advancing direction. If the fluid supplied through the motor-stop port 44 flows into the B-ports 430, 452, the rotor 422 is rotated in the reversing direction. Eventually, the rotor 422 is stopped in equilibrium, at the position shown in FIG. 51 in which the volume of the fluid chamber 426 communicating with the motor-stop port 44 is maximum. Thus, the number of stop positions available is equal to the number of the vanes 424. In the case where the motor-stop port 444 is used for discharging the fluid for stopping the motor, the stop positions are offset by a half of the indexing increment of the rotor 422. To avoid uneven axial load distribution of the rotor 422, it is preferred that the motor-stop port 444 is formed in each of the side plates 432. Further, it is possible that a motor-stop fluid passage is formed through the rotor 422 (rotating member) so that the motor-stop port 444 is open in the outer surface of the rotor, at a position between the adjacent vanes. In this case, the rotor 422 is stopped at one position.

Figure 52:
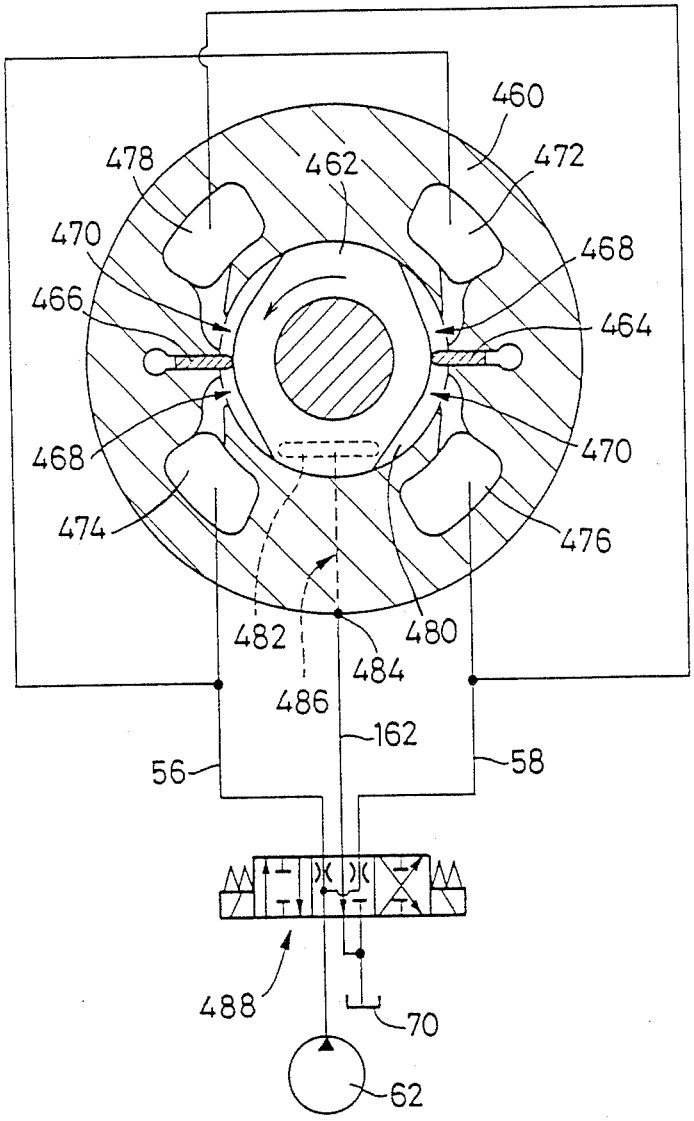
FIG. 52 is a cross sectional view showing one embodiment of a cam-rotor type vane motor of the invention, together with a hydraulic circuit.

Referring to FIG. 52, there is shown an embodiment of a cam rotor type vane motor, wherein a cam rotor 462 is accommodated within a cylindrical stator 460. The stator 460 has two vanes 464, 466 which are movable in opposite directions toward and away from the cam rotor 462. The vanes 464 are held in pressed contact with the cam rotor 462, thereby defining two pairs of fluid chambers 468, 470 that are symmetrical with each other, with respect to the center of the rotor 462. With the fluid flows into and from A-ports 472, 474 and B-ports 476, 478, the cam rotor 462 is rotated. Each of side plates 480 (side walls) closing the opposite ends of the stator 460 (cylinder) has a motor-stop outlet port 482 which is adapted to be closed by the end face of the cam rotor 462. The port 482 is connected to a connection port 484 through a motor-stop fluid discharge passage 486. In the figure, the connection port 484 is connected to the circuit including a directional control valve 488, for discharging the fluid from the motor to stop the motor.

Figure 53:
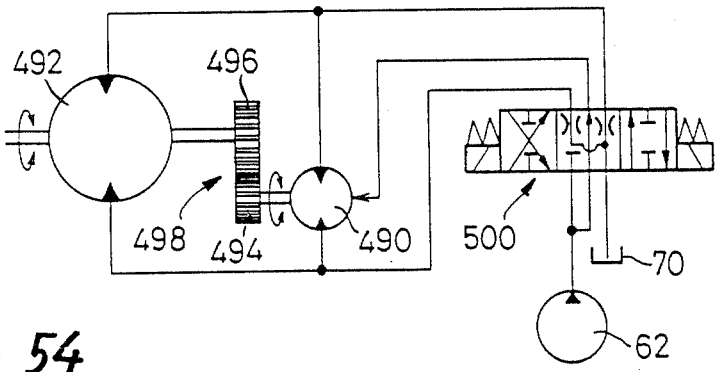
FIG. 53 is a schematic view of one embodiment of a composite motor arrangement of the invention.

FIG. 53 shows an embodiment of the invention which is more or less different from the embodiments discussed above. The motor arrangement shown in the figure can be considered a composite arrangement including a first motor portion 490 and a second motor portion 492. The first and second motor portions 490, 492 have fluid chambers which communicate with each other, or have common fluid chambers. More specifically, the advancing fluid chambers (A-ports) of the two motor portions 490, 492 communicate with each other, while the reversing fluid chambers (B-ports) of these portion communicate with each other. The first and second motor portions 490, 492 are coupled to each other directly, or by means of a suitable rotary transmission mechanism 498 such as gears 494, 496. The first motor portion 490 is provided with a motor-stop fluid passage which has been described in detail. This passage is connected to a circuit incorporating a directional control valve 500 (shown in the figure) for supplying the fluid to the motor portion 490, or to a suitable circuit (as previously illustrated) for discharging the fluid. However, the second motor portion 492 is not provided with a motor-stop fluid passage, and is connected to the pump 62 and reservoir 70 through the valve 500, in parallel with the first motor protion 490. When the fluid is supplied to or discharged from the first motor portion 490 through the motor-stop fluid passage, a motor stopping action occurs also in the second motor portion 492, whose fluid chambers communicate with those of the first motor portion 490. Hence, the second motor portion 492 which has no own provisions for stopping at a predetermined position, is able to provide a torque to stop. In other words, it can be said that the first motor portion 490 gives the second motor portion 492 a stopping or indexing function. In particular, it is possible that the first motor portion 490 is used as a pilot indexing motor, while the second motor portion 492 is used as a main motor connected to the pilot indexing motor by the transmission mechanism 498 at a fixed speed ratio. In this arrangement, the indexing operation of the main motor (492) is accomplished according to the number of indexing positions of the pilot indexing motor (490) and the speed ratio of the transmission mechanism 498. For instance, the pilot indexing motor has five indexing or stop positions, and the transmission mechanism 498 provides a speed reduction ratio of $\frac{1}{2}$, the main motor is given a function of indexing at ten positions. If the first motor portion 490 funtions as a pilot motor as indicated above, it can be said that the first motor portion acts like a servomotor, while the second motor protion 492 acts as an amplifier or booster whose output is commensurate with the rate of flow of the fluid. Further, it is noted that the first and second motor portions 490, 492 may be a combination of motors of different types. For example, the first motor portion 490 is a gear motor while the second motor portion 492 is a radial piston motor.

While the above motor arrangement has been regarded as a composite motor, the arrangement can be viewed otherwise, that is, application or utility of a motor according to the present invention. Suppose the first motor portion 490 is regarded as a motor constructed according to the invention, a motor not according to the invention may be easily provided with an indexing or braking function, by coupling this ordinary motor to the motor of the invention as shown in FIG. 53.

Figure 54:
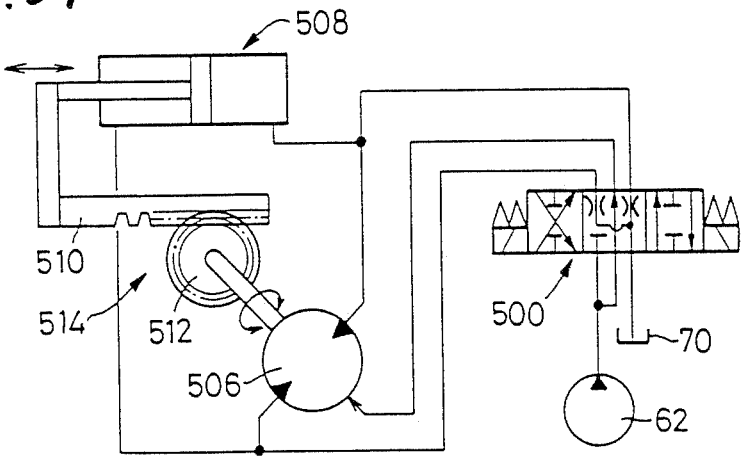
FIG. 54 is a schematic view of one modification of the arrangement of FIG. 53.

Another application of the motor according to the instant invention is illustrated in FIG. 54. The illustrated arrangement is considered a special motor wherein, a motor portion 506 and a cylinder portion 508 are substituted for the first and second motor portions 490, 492 of FIG. 53, respectively. The motor portion 506 is connected to the cylinder portion 508, by means of a suitable rotary-linear converter mechanism 514 such as a combination of a rack 510 and a pinion 512, for converting rotary movements into linear movements. The fluid chambers of the motor portion 506 and the cylinder portion 508 communicate with each other, so that the motor portion 506 enables the cylinder portion 508 to be moved in stepping fashion, or positioned with brake applied. The cylinder portion 508 may be replaced by an oscillating motor. If attention is directed to the cylinder portion 508, the entire arrangement can be viewed as an actuator which is capable of stopping at a predetermined position or positions. If the motor portion 506 is regarded as a motor according to the present invention, then the arrangement indicates a method of using or applying this motor.

Figure 55:
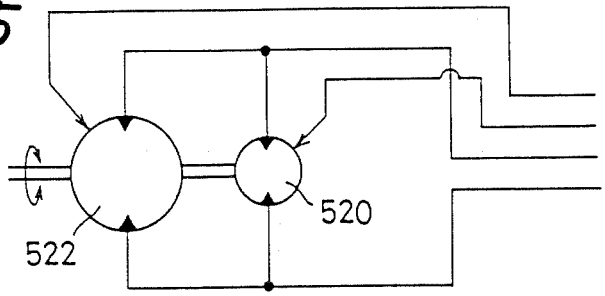
FIG. 55 is a schematic view of another modification of the arrangement of FIG. 53.

Referring to FIG. 55, there is shown an arrangement wherein first and second motor portions 520, 522 are both provided with a motor-stop fluid passage for indexing or braking the motor arrangement. The two motor portions 520, 522 are connected to each other with their fluid chambers communicating with each other, so that their indexing or stop positions are different. The fluid supply to or discharge from the motor-stop fluid passage is effected selectively on one of the two motor portions 520, 522, so that the stop position obtained on that one motor portion determines the stop position of the other motor portion. Therefore, the total number of indexing or stop positions is a sum of the indexing numbers of the two motor portions.

Figure 57:
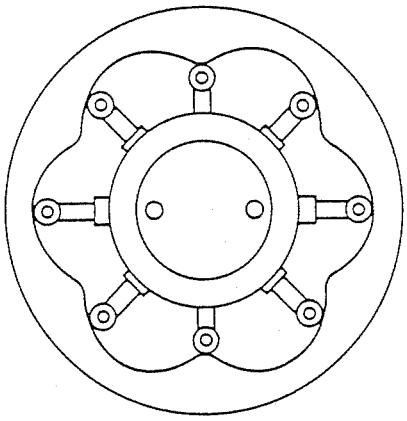
FIG. 57 is a schematic front elevational view of a multi-stroke type radial piston motor, which is also an embodiment of the present invention.

While the concept of the present invention has been described in greater detail in its variety of preferred embodiments, it is to be understood that the relatively limited number of pages used for the foregoing description do not cover all of the possible embodiments of the invention, and that the embodiments disclosed herein are given for illustrative purpose only. In particular, there exist many varied forms of application of the instant invention, and not a few modifications and changes not discussed herein. For example, the present invention may be modified as other rotary-cylinder types of motor, such as a radial piston motor of a multiple-stroke type as schematically illustrated in FIG. 57, and a motor of a swash-plate type or opposed swash-plate type (not shown), or as other fixed-cylinder types of motor such as swash-plate types. Also, the invention may be embodied as pneumatically operated motors. In essence, the principle of the present invention may be practiced in connection with any positive displacement motors that are operated by a fluid pressure.

It will be further understood that the invention may be embodied with various other changes, modifications and imrpovements, which may occur to those skilled in the art, without departing from the spirit of the invention.

What is claimed is:

1. A method of stopping a positive-displacement fluid motor at a desired one of at least one predetermined angular position, the fluid motor having a rotating member which is rotated continuously by means of flows of a pressurized fluid to and from a plurality of fluid chambers, said method comprising:

the step of supplying the pressurized fluid into at least one advancing fluid chamber of said plurality of fluid chambers which serves to rotate said rotating member in an operating direction of the motor, while causing the fluid to be discharged from at least one reversing fluid chamber of said plurality of fluid chambers which serves to rotate said rotating member in a direction opposite to said operating direction, if a motor stop command is generated when said desired determined angular position is ahead of a current position of said rotating member in said operating direction of the motor;

the step of supplying the pressurized fluid into said at least one reversing fluid chamber while causing the fluid to be discharged from said at least one advancing fluid chamber, if said motor stop command is generated when the current position of said rotating member is ahead of said desired angular position in said operating direction of the motor; and causing said rotating member to control the fluid flows into and from said at least one advancing fluid chamber and said at least one reversing fluid chamber, depending upon said current position of said rotating member relative to said desired angular position.

2. A method according to claim 1, wherein said pressurized fluid is a liquid.

3. A positive-displacement fluid motor having a plurality of fluid chambers, and a rotating member which is rotated continuously by means of flows of a pressurized fluid to and from said fluid chambers, and which can be stopped at a desired one of at least one predetermined angular position comprising:

a motor-stop fluid passage selectively communicating with at least one advancing fluid chamber of said plurality of fluid chambers which serves to rotate said rotating member in an operating direction of the motor, or at least one reversing fluid chamber of said plurality of fluid chambers which serves to rotate said rotating member in a direction opposite to said operating direction;

said rotating member being operable to select, by rotation thereof, the fluid communication of said motor-stop fluid passage with said at least one advancing fluid chamber or said at least one reversing fluid chamber; and a motor-stop fluid control circuit connected to said motor-stop fluid passage, for permitting the fluid to flow therethrough for supplying and discharging the fluid to and from said at least one advancing fluid chamber and said at least one reversing fluid chamber, so as to rotate said rotating member in a direction toward said desired predetermined angular position and thereby stop said rotating member at said desired angular position.

4. A positive-displacement fluid motor according to claim 3, wherein said motor-stop fluid passage consists of a motor-stop fluid supply passage which is controlled by the rotation of said rotating member, so as to communicate with said at least one advancing fluid chamber if said desired angular position is ahead of a current position of said rotating member in said operating direction of the motor, and communicate with said at least one reversing fluid chamber if the current position of said rotating member is ahead of said desired angular position, and wherein said motor-stop fluid control circuit is connected to a pressure source for pressuring the fluid and a reservoir, and is operable to bring said motor-stop fluid supply passage into communication with said pressure source, when the motor is commanded to stop, for supplying the fluid from said pressure source to said at least one advancing fluid chamber through said motor-stop fluid supply passage while permitting the fluid to be discharged from said at least one reversing fluid chamber to said reservoir if said desired angular position is ahead of said current position of the rotating member, and for supplying the fluid from said pressure source to said at least one reversing fluid chamber through said motor-stop fluid supply passage while permitting the fluid to be discharged from said at least one advancing fluid chamber to said reservoir if said current position of the rotating member is ahead of said desired angular position.

5. A positive-displacement fluid motor according to claim 3, wherein said motor-stop fluid passage consists of a motor-stop fluid discharge passage which is controlled by the rotation of said rotating member, so as to communicate with said at least one reversing fluid chamber if said desired angular position is ahead of a current position of said rotating member in said operating direction of the motor, and communicate with said at least one advancing fluid chamber if the current position of said rotating member is ahead of said desired angular position, and wherein said motor-step fluid control circuit is connected to a pressure source for pressuring the fluid and a reservoir, and is operable to bring said motor-stop fluid discharge passage into communication with said reservoir, when the motor is commanded to stop, for discharging the fluid from said at least one reversing fluid chamber to said reservoir through said motor-stop fluid discharge passage while supplying the fluid from said pressure source to said at least one advancing fluid chamber if said desired angular position is ahead of said current position of the rotating member, and for discharging the fluid from said at least one advancing fluid chamber to said reservoir through said motor-stop fluid discharge passage while supplying the fluid from said pressure source to said at least one reversing fluid chamber if said current position of the rotating member is ahead of said desired angular position.

6. A positive-displacement fluid motor according to claim 3, wherein said motor-stop fluid control circuit includes restrictor means for causing flows of the fluid to and from said at least one advancing fluid chamber and said at least one reversing fluid chamber so as to rotate said rotating member toward said desired angular position, depending upon said current position of the rotating member relative to said desired angular position when the motor is commanded to stop.

7. A positive-displacement fluid motor according to claim 3, wherein said motor-stop fluid passage consists of (a) a motor-stop fluid supply passage which is controlled by the rotation of said rotating member, so as to communicate with said at least one advancing fluid chamber if said desired angular position is ahead of a current position of said rotating member in said operating direction of the motor, and communicate with said at least one reversing fluid chamber if the current position of said rotating member is ahead of said desired angular position, (b) a motor-stop fluid discharge passage which is controlled by the rotation of said rotating member, so as to communicate with said at least one reversing fluid chamber if said desired angular position is ahead of a current position of said rotating member in said operating direction of the motor, and communicate with said at least one advancing fluid chamber if the current position of said rotating member is ahead of said desired angular position, and wherein said motor-stop fluid control circuit is connected to a pressure source for pressuring the fluid and a reservoir, and is operable to bring said motor-stop fluid supply passage and said motor-stop fluid discharge passage into communication with said pressure source and said reservoir, respectively, when the motor is commanded to stop, for supplying the fluid from said pressure source to said at least one advancing fluid chamber through said motor-stop fluid supply passage while discharging the fluid from said at least one reversing fluid chamber to said reservoir through said motor-stop fluid discharge passage if said desired angular position is ahead of said current position of the rotating member, and for supplying the fluid from said pressure source to said at least one reversing fluid chamber through said motor-step fluid supply passage while discharging the fluid from said at least one advancing fluid chamber to said reservoir through said motor-step fluid discharge passage if said current position of the rotating member is ahead of said desired angular position.

8. A positive-displacement fluid motor according to claim 4, wherein said motor-stop fluid supply passage is provided for each of at least two of said fluid chambers, and wherein said rotating member is stopped at one of a plurality of angular positions which correspond to said at least two fluid chambers, said motor-stop fluid control circuit connecting each of said motor-stop fluid supply passage to said pressure source, for selective communication of one of the motor-stop fluid supply passages to said pressure source when the motor is commanded to stop, to thereby stop said rotating member at one of said angular positions.

9. A positive-displacement fluid motor according to claim 5, wherein said motor-stop fluid discharge passage is provided for each of at least two of said fluid chambers, and wherein said rotating member is stopped at one of a plurality of angular positions which correspond to said at least two fluid chambers, said motor-stop fluid control circuit connecting each of said motor-stop fluid discharge passage to said reservoir, for selective communication of one of the motor-stop fluid discharge passages with said reservoir when the motor is commanded to stop, to thereby stop said rotating member at one of said angular positions.

10. A positive-displacement fluid motor having a plurality of fluid chambers, and a rotating member which is rotated by means of flows of a pressurized fluid to and from said fluid chambers, and which can be stopped at one of a first and a second predetermined angular position, comprising:

a motor-stop fluid supply passage and a motor-stop fluid discharge passage selectively communicating with at least one advancing fluid chamber of said plurality of fluid chambers which serves to rotate said rotating member in an operating direction of the motor, or at least one reversing fluid chamber of said plurality of fluid chambers which serves to rotate said rotating member in a direction opposite to said operating direction;

said rotating member being operable to select, by rotation thereof, the fluid communication of said motor-stop fluid supply and discharge passages with said at least one advancing fluid chamber and said at least one reversing fluid chamber;

switching means operable between a first position in which said motor-stop fluid supply passage communicates with a pressure source for pressurizing the fluid, and a second position in wihch said motor-stop fluid discharge passage communicates with a reservoir;

first fluid supply/discharge means, operable when said switching means is placed in said first position, for supplying the fluid from said pressure source to at least one approaching fluid chamber of said plurality of fluid chambers through said motor-stop fluid supply passage to rotate said rotating member toward said first predetermined position, while permitting the fluid to be discharged from at least one departing fluid chamber of said plurality of fluid chambers, said at least one approaching fluid chamber serving to rotate said rotating member in a direction toward said one of the first and second predetermined angular positions, while said at least one departing fluid chamber serving to rotate said rotating member in a direction away from said one predetermined angular position; and second fluid supply/discharge mens, operable when said switching means is placed in said second position, for discharging the fluid from said at least one departing fluid chamber to said reservoir through said motor-stop fluid discharge passage while supplying the fluid from said pressure source to said at least one approaching fluid chamber to rotate said rotating member toward said second predetermined position.

11. A positive-displacement fluid motor according to claim 10, wherein said motor-stop fluid supply passage and said motor-stop fluid discharge passage are provided by a common motor-stop passage which is held in communication with a predetermined one of said plurality of fluid chambers.

12. A positive-displacement fluid motor according to claim 10, wherein said motor-stop fluid supply passage and said motor-stop fluid discharge passage are provided by separate fluid passages, respectively.

13. A positive-displacement fluid motor having a a plurality of fluid chambers, and a rotating member which is rotated by means of flows of a pressurized fluid to and from said fluid chambers, and which can be stopped at a desired one of at least one predetermined angular position, comprising at least one of:

a motor-stop fluid supply passage having at one of opposite ends thereof a connection port adapted to be connected to a pressure source for pressuring the fluid, the other of said opposite ends communicating with at least one advancing fluid chamber of said plurality of fluid chambers which serves to rotate said rotating member in an operating direction of the motor when said desired predetermined angular position is ahead of a current position of said rotating member, said other end of said motor-stop fluid supply passage communicating with at least one reversing fluid chamber of said plurality of fluid chambers which serves to rotate said rotating member from said desired angular position in a direction opposite to said operating direction, when said current position of the rotating member is ahead of said desired angular position, said rotating member being operable to select, by means of rotation thereof, the fluid communication of said motor-stop fluid supply passage with said at least one advancing fluid chamber or said at least one reversing fluid chamber; and a motor-stop fluid discharge passage having at one of opposite ends thereof a connection port adapted to be connected to a reservoir, the other of said opposite ends communicating with said at least one reversing fluid chamber when said desired angular position is ahead of said current position of said rotating member in said operating direction of the motor, said other end of said motor-stop fluid discharge passage communicating with said at least one advancing fluid chamber when the current position of said rotating member is ahead of said desired angular position.

14. A positive-displacement fluid motor according to claim 13, which is a fixed-cylinder type piston motor having (a) a fixed cylinder, (b) a plurality of pistons received within said fixed cylinder, (c) a plurality of variable-volume fluid chambers defined by said fixed cylinder and said pistons, (d) a plurality of fluid-chamber ports formed in fluid communication with said fluid chambers, respectively, (e) a rotary valve member constituting a part of said rotating member, and having an entrance port and a discharge port formed therein so that said entrance and discharge ports sequentially communicate with said fluid-chamber ports as said rotary valve member is rotated, and (f) a converting mechanism for convering linear movements of said pistons produced by the flows of the fluid to and from said fluid chambers, into a rotary movement of said rotating member, and wherein at least one of said at least one of said motor-stop fluid supply and discharge passages is formed in communication with a predetermined one of said fluid-chamber ports, such that said connection port as said one end is open in an outer surface of said fixed cylinder, while said predetermined one of said fluid-chamber ports forms said other end, said each of said at least one of the motor-stop fluid supply and discharge passages selectively communicating with said plurality of fluid chambers through said entrance or discharge port as said rotary valve member is rotated.

15. A positive-displacement fluid motor according to claim 13, which is a fixed-cylinder type piston motor having (a) a fixed cylinder, (b) a plurality of pistons received within said fixed cylinder, (c) a plurality of variable-volume fluid chambers defined by said fixed cylinder and said pistons, (d) a plurality of fluid-chamber ports formed in fluid communication with said fluid chambers, respectively, (e) a rotary valve member constituting a part of said rotating member, and having an entrance port and a discharge port formed therein so that said entrance and discharge ports sequentially communicate with said fluid-chamber ports as said rotary valve member is rotated, and (f) a converting mechanism for convering linear movements of said pistons produced by the flows of the fluid to and from said fluid chambers, into a rotary movement of said rotating member, and wherein said other end of at least one of said at least one of said motor-stop fluid supply and discharge passages is open in said rotary valve member, so that said other end sequentially communicates with said plurality of fluid-chamber ports and thereby selectively communicates with said entrance and discharge ports, as said rotary valve member is rotated.

16. A positive-displacement fluid motor according to claim 13, which is a rotary-cylinder type piston motor having (a) a rotary cylinder block, (b) a plurality of pistons received within said rotary cylinder block, (c) a plurality of variable-volume fluid chambers defined by said cylinder block and said pistons, (d) a plurality of fluid-chamber ports formed in fluid communication with said fluid chambers, respectively, (e) a fixed valve member having an entrance port and a discharge port formed therein so that said entrance and discharge ports sequentially communicate with said fluid-chamber ports as said cylinder block is rotated, and (f) a converting mechanism for convering linear movements of said pistons produced by the flows of the fluid to and from said fluid chambers, into a rotary movement of said cylinder block, and wherein said other end of at least one of said at least one of said motor-stop fluid supply and discharge passages is open in said fixed valve member, so that said other end sequentially communicates with said plurality of fluid-chamber ports and thereby selectively communicates with said entrance and discharge ports, as said cylinder block is rotated.

17. A positive-displacement fluid motor according to claim 13, which is a rotary-cylinder type piston motor having (a) a rotary cylinder block, (b) a plurality of pistons received within said rotary cylinder block, (c) a plurality of variable-volume fluid chambers (208) defined by said cylinder block and said pistons, (d) a plurality of fluid-chamber ports formed in fluid communication with said fluid chambers, respectively, (e) a fixed valve member having an entrance port and a discharge port formed therein so that said entrance and discharge ports sequentially communicate with said fluid-chamber ports as said cylinder block is rotated, and (f) a converting mechanism for convering linear movements of said pistons produced by the flows of the fluid to and from said fluid chambers, into a rotary movement of said cylinder block, and wherein at least one of said at least one of said motor-stop fluid supply and discharge passages is held in communication with a predetermined one of said fluid-chamber ports, and said predetermined one of said fluid-chamber ports forms said other end, so that said each of said at least one of said motor-stop fluid supply and discharge passages selectively communicates with said plurality of fluid chambers through said entrance or discharge port.

18. A positive-displacement fluid motor according to claim 13, which is a trochoid motor having a rotor and a stator which have respective external and internal teeth whose profiles are generated following a trochoid curve or an equivalent thereof, said rotor being disposed within said stator in eccentric relation with each other such that said external teeth of said rotor is in partial contact with said internal teeth of said stator, so as to define therebetween a plurality of variable-volume fluid chamber, one cycle of supply and discharge flows to and from each of said fluid chambers causing said rotor to be rotated, by an angle determined by a difference between numbers of said external and internal teeth of the rotor and stator.

19. A positive-displacement fluid motor according to claim 13, which is a gear motor having a casing, and at least two gears which are disposed within said casing such that said gears mesh with each other so a to cooperate with said casing to define an inlet fluid chamber and an outlet fluid chamber, so that said gears are rotated by supply and discharge flows of the fluid into and from said inlet and outlet fluid chambers, meshing engagement of said gears providing a boundary between said inlet and outlet fluid chambers, and wherein said other end of said motor-stop fluid supply passage is open in a portion of an inner surface of said casing which neighbors said boundary, said other end being positioned and dimensioned so that said other end is substantially closable by an end face of one of the teeth of said gears which is located at said desired angular position of the motor.

20. A positive-displacement fluid motor according to claim 13, which is a gear motor having a casing, and at least two gears which are disposed within said casing such that said gears mesh with each other so as to cooperate with said casing to define an inlet fluid chamber and an outlet fluid chamber, so that said gears are rotated by supply and discharge flows of the fluid into and from said inlet and outlet fluid chambers, meshing engagement of said two gears providing a boundary between said inlet and outlet fluid chambers, and wherein said other end of said motor-stop fluid discharge passage is open in a portion of an inner surface of said casing which neighbors said boundary, said other end being positioned and dimensioned so that said other end can communicate with a space formed between a tooth of one of said gears which is located at said desired angular position of the motor, and a bottom land between the teeth of the other gear meshing said one gear.

21. A positive-displacement fluid motor according to claim 13, which is a gear motor having a casing, and at least two gears which are disposed within said casing such that said gears mesh with each other so as to cooperate with said casing to define an inlet fluid chamber and an outlet fluid chamber, so that said gears are rotated by supply and discharge flows of the fluid into and from said inlet and outlet fluid chambers, meshing engagement of said two gears providing a boundary between said inlet and outlet fluid chambers.

and wherein said other end of said motor-stop fluid supply passage is open in a portion of an inner surface of said casing which neighbors said boundary, said other end being positioned and dimensioned so that said other end is substantially closable by an end face of one of the teeth of said gears which is located at said desired angular position of the motor, said other end of said motor-stop fluid discharge passage being open in a portion of an inner surface of said casing which is aligned with said boundary, said other end being positioned and dimensioned so that said other end can communicate with a space formed between a tooth of one of said gears which is located at said desired angular position of the motor, and a bottom land between the teeth of the other gear meshing with said one gear.

22. A positive-displacement fluid motor according to claim 13, which is a gear motor having a casing, and at least two gears which are disposed within said casing such that said gears mesh with each other so as to cooperate with said casing to define an inlet fluid chamber and an outlet fluid chamber, so that said gears are rotated by supply and discharge flows of the fluid into and from said inlet and outlet fluid chambers, meshing engagement of said two gears providing a boundary between said inlet and outlet fluid chambers, and wherein at least one of said at least one of said motor-stop fluid supply and discharge passages is formed through one of said gears and is open in an outer surface of said one gear.

23. A positive-displacement fluid motor according to claim 13, which is a vane motor having (a) a casing, (b) a rotor disposed rotatably within the casing, (c) a plurality of vanes supported by said rotor such that the vanes are movable in substantially radial directions of the rotor, (d) a plurality of variable-volume fluid chambers defined by said casing, rotor and vanes, and (e) an entrance port and a discharge port which are formed in said casing, and wherein at least one of said at least one of said motor-stop fluid supply and discharge passages is open in a portion of an inner surface of said casing which is located between said entrance and discharge ports.

24. A positive-displacement fluid motor according to claim 13, which is a vane motor having (a) a casing, (b) a rotor rotatably disposed within the casing, (c) a plurality of vanes supported by said rotor such that the vanes are movable in substantially radial directions of the rotor, (d) a plurality of variable-volume fluid chambers defined by said casing, rotor and vanes, and (e) an entrance port and a discharge port which are formed in said casing, and wherein at least one of said at least one of said motor-stop fluid supply and discharge passages is formed through said rotor and is open in an outer surface of the rotor.

25. A positive-displacement fluid motor according to claim 13, which is a cam rotor vane motor having (a) a casing, (b) at least one vane supported by said casing such that the vane is movable in substantially radial direction of the casing, (c) a cam rotor disposed rotatably within the casing, (d) a plurality of variable-volume fluid chambers defined by said casing, rotor and vane, and (e) an entrance port and a discharge port which are formed in said casing, and wherein at least one of said at least one of said motor-step fluid supply and discharge passages is open in a portion of an inner surface of said casing which is located between said entrance and discharge ports.

26. A positive-displacement fluid motor according to claim 13, which is a cam rotor vane motor having (a) a casing, (b) at least one vane supported by said casing such that the vane is movable in substantially radial direction of the casing, (c) a cam rotor disposed rotatably within the casing, (d) a plurality of variable-volume fluid chambers defined by said casing, rotor and vane, and (e) an entrance port and a discharge port which are formed in said casing, and wherein at least one of said at least one of said motor-stop fluid supply and discharge passages is formed through said cam rotor and is open in an outer surface of the cam rotor.

27. A positive-displacement fluid motor according to claim 13, which includes a first motor portion having said rotating member, and said at least one of said motor-stop fluid supply and discharge passages, so that said rotating member can be stopped at said desired angular position, said motor further including a second motor portion which has said at least one advancing fluid chamber and said at least one reversing fluid chamber, and which is mechanically coupled to said first motor portion, said at least one advancing fluid chamber of said first motor portion communicating with said at least one advancing fluid chamber of said second motor portion, while said at least one reversing fluid chamber of said first motor portion communicating with said at least one reversing fluid chamber of said second motor portion, so that said second motor portion can be stopped at an angular position thereof in synchronization with a stopping action of said first motor portion, such that said angular position of the second motor portion is determined by said first motor portion.

28. A positive-displacement fluid motor according to claim 13, which includes a motor portion having said rotating member, and said at least one of said motor-stop fluid supply and discharge passages, so that said rotating member can be stopped at said desired angular position, said motor further including a cylinder portion, and a converting mechanism for converting a rotary movement of said motor portion into a linear movement of said cylinder portion, said cylinder portion is connected to said motor portion such that said at least one advancing fluid chamber of said motor portion communicates with a corresponding advancing fluid chamber of said cylinder portion while said at least one reversing fluid chamber of said motor portion communicates with a corresponding reversing fluid chamber of said cylinder portion, so that said cylinder portion can be stopped at a linear position thereof in synchronization with a stopping action of said motor portion, such that said linear position of said cylinder portion is determined by said motor portion.

29. A fluid control circuit for controlling a positive-displacement fluid motor which has (a) a rotating member, (b) a plurality of fluid chambers, (c) an entrance port and a discharge port, and (d) a motor-stop fluid supply passage which selectively communicates with at least one advancing fluid chamber of said plurality of fluid chambers which serves to rotate said rotating member in an operating direction of the motor, or at least one reversing fluid chamber of said plurality of fluid chambers which serves to rotate said rotating member in a direction opposite to said operating direction, said motor being normally operated with said rotating member rotated by means of flows of a fluid to and from the motor through said entrance and discharge ports, said rotating member being stopped at a desired one of at least one predetermined angular position by means of a flow of the fluid into the motor through said motor-stop fluid supply passage, said fluid control circuit comprising:

a first fluid passage for connecting said entrance port and a pressure source for pressurizing the fluid;

a second fluid passage for connecting said discharge port and a reservoir;

a third fluid passage for connecting said motor-stop fluid supply passage and said pressure source;

shutoff means for closing said third fluid passage when the motor is normally operated, and opening said third fluid passage when the motor is commanded to stop;

restrictor means disposed in each of said first and second fluid passages; and selector means for effecting fluid communication between said entrance port and said pressure source through said first fluid passage, and between said discharge port and said reservoir through said second fluid passage, without restricting the fluid flows through said first and second fluid passages by said restrictor means, while said motor is normally operated, said selector means being operable to effect restricted fluid communication of said first and second fluid passages with said reservoir through said restrictor means, at least when the motor is stopped.

30. A fluid control circuit according to claim 29, wherein said restrictor means restricts the flows of the fluid through said first and second fluid passages, such that a cross sectional area of flow of said first and second fluid passages is smaller than a maximum cross sectional area of communication between said motor-stop fluid supply passage and said entrance or discharge port when the motor is stopped.

31. A fluid control circuit for controlling a positive-displacement fluid motor which has (a) a rotating member, (b) a plurality of fluid chambers, (c) an entrance port and a discharge port, and (d) a motor-stop fluid discharge passage which selectively communicates with at least one advancing fluid chamber of said plurality of fluid chambers which serves to rotate said rotating member in an operating direction of the motor, or at least one reversing fluid chamber of said plurality of fluid chambers which serves to rotate said rotating member in a direction opposite to said operating direction, said motor being normally operated with said rotating member rotated by means of flows of a fluid to and from the motor through said entrance and discharge ports, said rotating member being stopped at said desired predetermined angular position by means of a flow of the fluid from the motor through said motor-stop fluid discharge passage, said fluid control circuit comprising:

a first fluid passage for connecting said entrance port and a pressure source for pressurizing the fluid;

a second fluid passage for connecting said discharge port and a reservoir;

a third fluid passage for connecting said motor-stop fluid discharge passage and said reservoir;

shutoff means for closing said third fluid passage when the motor is normally operated, and opening said third fluid passage when the motor is commanded to stop;

restrictor means disposed in each of said first and second fluid passages; and selector means for effecting fluid communication between said entrance port and said pressure source through said first fluid passage, and between said discharge port and said reservoir through said second fluid passage, without restricting the fluid flows through said first and second fluid passages by said restrictor means, while said motor is normally operated, said selector means being operable to effect restricted fluid communication of said first and second fluid psssages with said pressure source through said restrictor means, at least when the motor is stopped.

32. A fluid control circuit according to claim 31, wherein said restrictor means restricts the flows of the fluid through said first and second fluid passages, such that a cross sectional area of flow of said first and second fluid passages is smaller than a maximum cross sectional area of communication between said motor-stop fluid discharge passage and said entrance or discharge port when the motor is stopped.

33. A fluid control circuit for controlling a positive-displacement fluid motor which has (a) a rotating member that can be stopped at a desired one of at least one predetermined angular position, (b) a plurality of fluid chambers, (c) an entrance port and a discharge port, and (d) a motor-stop fluid supply passage which selectively communicates with at least one advancing fluid chamber of said plurality of fluid chambers which serve to rotate said rotating member in an operating direction of the motor against a load torque, or at least one reversing fluid chamber of said plurality of fluid chambers which serves to rotate said rotating member in a direction opposite to said operating direction, said motor being normally operated with said rotating member rotated against said load torque by means of flows of a fluid to and from the motor through said entrance and discharge ports, said rotating member being stopped at said desired predetermined angular position by means of a flow of the fluid into the motor through said motor-stop fluid supply passage, said fluid control circuit comprising:

a first fluid passage for connecting said entrance port and a pressure source for pressurizing the fluid;

a second fluid passage for connecting said discharge port and a reservoir;

a third fluid passage for connecting said motor-stop fluid supply passage and said pressure source;

shutoff means for closing said third fluid passage when the motor is normally operated, and opening said third fluid passage when the motor is commanded to stop; and selector means for effecting fluid communication between said entrance port and said pressure source through said first fluid passage, and between said discharge port and said reservoir through said second fluid passage, while said motor is normally operated, said selected means being operable to close said first fluid passage and maintain the fluid communication between said second fluid passage and said reservoir when the motor is stopped.

34. A fluid control circuit for controlling a positive-displacement fluid motor wherein a rotating member can be stopped at a desired one of at least one predetermined angular position, and which has (a) a plurality of fluid chambers, (b) an entrance port and a discharge port, and (c) a motor-stop fluid discharge passage which selectively communicates with at least one advancing fluid chamber of said plurality of fluid chambers which serves to rotate said rotating member in an operating direction of the motor against a load torque, or at least one reversing fluid chamber of said plurality of fluid chambers which serves to rotate said rotating member in a direction opposite to said operating direction, said motor being normally operated against a load torque with said rotating member rotated by means of flows of a fluid to and from the motor through said entrance and discharge ports, said rotating member being stopped at said desired predetermined angular position by means of a flow of the fluid from the motor through said motor-stop fluid discharge passage, said fluid control circuit comprising:

a first fluid passage for connecting said entrance port and a pressure source for pressurizing the fluid;

a second fluid passage for connecting said discharge port and a reservoir;

a third fluid passage for connecting said motor-stop fluid discharge passage and said reservoir;

shutoff means for closing said third fluid passage when the motor is normally operated, and opening said third fluid passage when the motor is commanded to stop; and selector means for effecting fluid communication between said entrance port and said pressure source through said first fluid passage, and between said discharge port and said reservoir through said second fluid passage, while said motor is normally operated, said selector means being operable to maintain the fluid communication between said first fluid passage and said pressure source and close said second fluid passage when the motor is stopped.

35. A fluid control circuit for controlling a positive-displacement fluid motor which has (a) a rotating member, (b) a plurality of fluid chambers, (c) an entrance port and a discharge port which selectively communicate with said plurality of fluid chambers, and (d) a motor-stop fluid passage which selectively communicates with at least one fluid advancing fluid chamber of said plurality of fluid chambers which serve to rotate said rotating member in an operating direction of the motor against a load torque, or at least one reversing fluid chamber of said plurality of fluid chambers which serve to rotate said rotating member in a direction opposite to said operating direction, said fluid control circuit comprising:

a first fluid passage whose one end is adapted to be connected to said entrance port;

a second fluid passage whose one end is adapted to be connected to said discharge port;

a third fluid passage whose one end is adapted to be connected to said motor-stop fluid passage;

first switching means connected to the other ends of said first and second fluid passages, said first switching means being operable between a first position in which said first fluid passage communicates with a pressure source while said second fluid passage communicates with a reservoir, and a second position in which said first fluid passage is closed while said second fluid passage is held in communication with said reservoir; and second switching means connected to said first fluid passage, and receiving a pressure in said third fluid passage as a pilot pressure, said second switching means being normally closed, and being opened when said pilot pressure exceeds a predetermined limit and thereby connecting said first fluid passage which has been disconnected from said pressure source by said first switching means, to said pressure source, said rotating member being rotated in said operating direction against said load torque while said first switching means is placed in said first position, and being stopped at a desired predetermined angular position when said first switching means is operated to said second position.

* * * * *